US005959586A

United States Patent [19]

Benham et al.

[11] Patent Number: 5,959,586

[45] **Date of Patent: *Sep. 28, 1999**

[54] SHEET ANTENNA WITH TAPERED RESISTIVITY

[75] Inventors: Glynda O. Benham; John R. Benham, both of Sterling; Marshall W. Cross, Stow, all of Mass.

[73] Assignee: Megawave Corporation, Boylston, Mass.

[ * ] Notice: This patent issued on a continued prosecution application filed under 37 CFR 1.53(d), and is subject to the twenty year patent term provisions of 35 U.S.C. 154(a)(2).

[21] Appl. No.: 08/896,896

[22] Filed: Jul. 18, 1997

Related U.S. Application Data

[63] Continuation of application No. 08/387,131, Feb. 6, 1995, abandoned.

[51] Int. Cl.[6] ..... H01Q 1/38

[52] U.S. Cl. ..... 343/713; 343/846

[58] Field of Search ..... 343/713, 700 MS, 343/846, 848, 895; H01Q 1/32

[56] References Cited

U.S. PATENT DOCUMENTS

| | | | |
|---|---|---|---|
| 2,978,703 | 4/1961 | Kuecken | 343/795 |
| 3,369,245 | 2/1968 | Rea | 343/795 |
| 3,673,044 | 6/1972 | Miller et al. | 156/433 |

(List continued on next page.)

FOREIGN PATENT DOCUMENTS

| | | | |
|---|---|---|---|
| 162009 | 8/1953 | Australia . | |
| 77 148/81 | 12/1983 | Australia . | |
| 4307232 | 7/1993 | Germany | H01Q 1/32 |
| 0062902 | 4/1983 | Japan | 343/795 |
| 63-13402 | 7/1986 | Japan | H01Q 1/22 |
| 0171202 | 8/1986 | Japan | H01Q 1/32 |
| 0043905 | 2/1987 | Japan | H01Q 1/32 |
| 0081101 | 4/1987 | Japan | H01Q 1/32 |
| 3-196703 | 12/1989 | Japan | H01Q 1/32 |
| 4-213903 | 12/1990 | Japan | H01Q 1/32 |
| 5-14028 | 6/1991 | Japan | H01Q 1/32 |
| 6291530 | 10/1994 | Japan | H01Q 1/32 |

OTHER PUBLICATIONS

U.S. application No. 08/445,910, filed May 22, 1995, "Multi–Element Antenna with Tapered Resistive Loading in Each Element".

Rao et al., "Wideband HF Monopole Antennas with Tapered Resistivity Loading", Mitre Corporation, presented at MilCom'90, 1990 IEEE Military Comm. Conference, Monterey, CA Sep. 30–Oct. 3, 1990, pp. 1223–1227.

Kanda, A Relatively Short Cylindrical Broadband Antenna with Tapered Resistive Loading for Picosecond Pulse Measurements, vol. AP 26, No. 3, May 1978, pp. 439–447.

Maloney et al., "Optimization of a Resistively Loaded Conical Antenna for Pulse Radiation", IEEE APS Symposium Proceedings, Jul. 1992, pp. 1968–1972.

Clouston, "The Butterfly: A Broadband, Aerodynamic Antenna for Airborne Missile Scoring Using Impulse Radar", IEEE APS Symposium Proceedings, 1991, pp. 715–718.

Wu et al., "The Cylindrical Antenna with Nonreflecting Resistive Loading", IEEE Transactions on Antennas and Propagation, vol. AP–13, No. 3, pp. 369–373, May 1965.

Kanda, "Time Domain Sensors for Radiated Impulsive Measurements", IEEE Transactions on Antennas and Propagation, vol. AP–31, No. 3, May 1983, pp. 438–444.

(List continued on next page.)

*Primary Examiner*—Don Wong
*Assistant Examiner*—Tan Ho
*Attorney, Agent, or Firm*—Fish & Richardson PC

[57] ABSTRACT

An antenna exhibiting a wide bandwidth, a low standing wave ratio, and a substantially omnidirectional radiation pattern. The antenna includes a sheet-like antenna element having a feedpoint, and an electromagnetic characteristic having non-uniform variation with distance across the element from the feedpoint. One use of the antenna is on a windshield.

25 Claims, 81 Drawing Sheets

U.S. PATENT DOCUMENTS

| | | | |
|---|---|---|---|
| 3,721,990 | 3/1973 | Gibson et al. | 343/795 |
| 3,836,976 | 9/1974 | Monser et al. | 343/795 |
| 3,958,245 | 5/1976 | Cherenko et al. | 343/713 |
| 3,987,449 | 10/1976 | DeAngelis et al. | 343/713 |
| 4,038,662 | 7/1977 | Turner | 343/752 |
| 4,072,954 | 2/1978 | Comastri et al. | 343/713 |
| 4,114,163 | 9/1978 | Borowick | 343/795 |
| 4,141,011 | 2/1979 | Boaz | 343/713 |
| 4,145,694 | 3/1979 | Sletten | 343/727 |
| 4,163,236 | 7/1979 | Kaloi | 343/700 |
| 4,302,760 | 11/1981 | Laufer | 343/715 |
| 4,358,769 | 11/1982 | Tada et al. | 343/742 |
| 4,485,385 | 11/1984 | Ralston | 343/795 |
| 4,513,290 | 4/1985 | Lefevre et al. | 343/745 |
| 4,707,700 | 11/1987 | Nagy | 343/712 |
| 4,736,206 | 4/1988 | Sakurai et al. | 343/703 |
| 4,746,925 | 5/1988 | Toriyama | 343/713 |
| 4,768,037 | 8/1988 | Inaba et al. | 343/713 |
| 4,791,426 | 12/1988 | Lindenmeier et al. | 343/713 |
| 4,825,220 | 4/1989 | Edward et al. | 343/795 |
| 4,827,274 | 5/1989 | Armbruster | 343/712 |
| 4,849,766 | 7/1989 | Inaba et al. | 343/713 |
| 4,860,019 | 8/1989 | Jiang et al. | 343/795 |
| 4,910,380 | 3/1990 | Reiss et al. | 219/203 |
| 4,931,764 | 6/1990 | Gaston | 338/185 |
| 5,012,255 | 4/1991 | Becker | 343/704 |
| 5,119,106 | 6/1992 | Murakami | 343/713 |
| 5,126,716 | 6/1992 | Munger | 338/306 |
| 5,173,713 | 12/1992 | Yves et al. | 343/749 |
| 5,255,002 | 10/1993 | Day | 343/713 |
| 5,264,858 | 11/1993 | Shiina | 343/713 |
| 5,285,048 | 2/1994 | Nakase | 219/203 |
| 5,353,039 | 10/1994 | Tsukada et al. | 343/713 |
| 5,355,144 | 10/1994 | Walton et al. | 343/713 |
| 5,363,114 | 11/1994 | Shoemaker | 343/713 |
| 5,365,242 | 11/1994 | Shiina | 343/713 |
| 5,406,295 | 4/1995 | Baranski et al. | 343/713 |

OTHER PUBLICATIONS

Shen, "An Experimental Study of the Antenna with Nonreflecting Resistive Loading", IEEE Transactions on Antennas and Propagation, vol. AP15, No. 5, Sep. 1967, pp. 606–611.

Maloney, "Optimization of a Conical Antenna for Puulse Radiation: An Efficient Design Using Resistive Loading", IEEE Transactions on Antennas and Propagation, vol. 41, No. 7, Jul. 1993, pp. 940–947.

Torres et al., "Analysis and Design of a Resistively Coated Windshield Slot Antenna", Technical Report 312559–1, The Ohio State University, PPG Industries, Inc., Jun. 1991.

Torres et al., "Integral Equation Analysis of a Sheet Impedance Coated Window Slot Antenna", IEEE Transactions on Antennas and Propagation, vol. 42, No. 4, Apr. 1994, pp. 541–544.

Lindenmeier et al., Multiple FM Window Antenna System for Scanning Diversity with an Integrated Processor, IEEE Transactions on Antennas and Propagation, 1990, pp. 1–6.

Austin et al., "Conformal On–glass Vehicle Antennas at VHF", IEE International Conference on Antennas and Propagation, England, 1993.

Kanda, "The Time–Domain Characteristics of a Traveling–Wave Linear Antenna with Linear and Nonlinear Parallel Loads", IEEE Transactions on Antennas and Propagation, vol. AP–28, No. 2, Mar., 1980, pp. 267–276.

Rao, "Optimized Tapered Resistivity Profiles for Wideband HF Monopole Antenna", presented at the 1991 IEEE Antenna and Prop. Society International Symposium, London, Ontario, Canada, Mitre Corporation.

Austin, "Numerical Modelling and Design of Loaded Broadband Wire Antennas", University of Liverpool, U.K., pp. 125–129.

Rao, "Resistivity Tapered Wideband High Frequency Antennas for Tactical Communications", The Mitre Corporation.

Clapp, "A Resistively Loaded, Printed Circuit, Electrically Short Dipole Element for Wideband Array Applications", IEEE, May 1993, pp. 478–481.

McMillan, "Log Spiral Design for Direction of Arrival Estimatin," IEEE APS Symposium Proceedings, 1991, pp. 719–722.

1 SECTION OF SEGMENTED TARGET
LINEAR MAGNETRON

| Frequency (in MHz) | Emax/Emin (in dB) for candidate | | Emax/Emin (in dB) for reference | Δ Emax/Emin | | Relative surfacewave power gain (in dB)* | |
|---|---|---|---|---|---|---|---|
| | 10-150 Ω/□ | 5-75 Ω/□ | | 10-150 Ω/□ | 5-75 Ω/□ | 10-150 Ω/□ | 5-75 Ω/□ |
| 40 MHz | 6 | 4 | 8 | -2 | -4 | -11.8 | -10 |
| 50 MHz | 6 | 6 | 7 | -1 | -1 | -4.9 | -3.4 |
| 130 MHz | 6 | 7 | 7 | -1 | -1 | -6.2 | -5.3 |
| 150 MHz | 7 | 7 | 10 | -3 | -3 | -7.3 | -6.4 |
| 170 MHz | 16 | 12 | 13 | +3 | -1 | -7.5 | -6.1 |

FIG. 37

| Frequency (in MHz) | Emax/Emin (in dB) for candidate | | Emax/Emin (in dB) for reference | Δ Emax/Emin | | Relative surfacewave power gain (in dB)* | |
|---|---|---|---|---|---|---|---|
| | 10-150 Ω/□ | 5-75 Ω/□ | | 10-150 Ω/□ | 5-75 Ω/□ | 10-150 Ω/□ | 5-75 Ω/□ |
| 40 MHz | 6 | 5 | 8 | -2 | -3 | -11.6 | -10 |
| 50 MHz | 7 | 7 | 7 | 0 | 0 | -5.8 | -3.1 |
| 130 MHz | 8 | 9 | 7 | +1 | +2 | -4 | -4.8 |
| 150 MHz | 11 | 13 | 10 | +1 | +3 | -4 | -4.9 |
| 170 MHz | 10 | 9 | 13 | -3 | -4 | -4.4 | -5.7 |

FIG. 41

LOADED ANTENNA

32" REFERENCE WHIP

LOADED ANTENNA

20" REFERENCE WHIP

LOADED ANTENNA

32" REFERENCE WHIP

SHEET ANTENNA WITH TAPERED RESISTIVITY

This is a continuation of application Ser. No. 08/387,131, filed Feb. 6, 1995, now abandoned.

Portions of this invention were made with Government support under Contract No. DAAH01-94-C-R128 awarded by Advanced Research Projects Agency (contracting agency: U.S. Army Missile Command). The Government has certain rights in the invention.

BACKGROUND OF THE INVENTION

This invention relates to antennas.

In the field of consumer electronics, for example, antennas are used to transmit and receive signals across a very broad range of frequencies including AM and FM radio, VHF and UHF TV, cellular telephone, CB radio, and other applications.

Antenna designers aim to achieve an appropriate combination of bandwidth, voltage standing wave ratio (VSWR), directionality, mechanical strength, and visual unobtrusiveness for the application involved. A wide variety of techniques have been used to achieve good performance in each of these areas. Broad bandwidth, for example, may be achieved in some cases using so-called tapered loading of the antenna element. Unobtrusiveness, in the case of a car, for example, has been achieved by embedding the antenna in the windshield.

SUMMARY OF THE INVENTION

In general, in one aspect, the invention features an antenna exhibiting a wide bandwidth, a low standing wave ratio, and an essentially omnidirectional radiation pattern. The antenna includes a sheet-like antenna element having a feedpoint, and an electromagnetic characteristic having non-uniform variation with distance across the element from the feedpoint.

Implementations of the invention may include the following features. The element may be generally rectangular or triangular. There may be multiple sheet-like antenna elements, e.g., in the form of fingers that radiate from the feedpoint. The antenna may be in the form of a monopole with more than two elements. The element may be generally planar. The electromagnetic characteristic may be an electrical characteristic such as resistance, or a magnetic characteristic. The non-uniform variation may be a monotonically increasing value with distance from the feedpoint. The sheet-like element may have a thickness profile that varies across the element. The shape of the element may be visually camouflaged, e.g., using a width profile that varies along the length. The width profile may vary randomly. The element may be effectively transparent. The element may be attached to a transparent rigid support layer such as a window. A sheet-like ground may be provided in the vicinity of the feedpoint.

In general, in another aspect, the invention features a method of forming an antenna by applying, to a rigid or flexible substrate, a sheet-like antenna element, the element having a feedpoint, and an electromagnetic characteristic having non-uniform variation with distance across the element from the feedpoint.

In general, in another aspect, the invention features providing a ground for an antenna mounted in a windshield by including in the windshield a sheet-like conductor, and providing a connection point for connecting the conductor as a ground to an external feeding circuit.

Advantages of the invention include the following. A single antenna can cover extremely large portions of the RF spectrum. Uniform radiation pattern and impedance characteristics are achieved. The antenna can be incorporated as a safety laminate between layers of window glass. The antenna can be unobtrusive and therefore aesthetically appealing. The antenna can be made mechanically robust. The antenna can be fabricated as a unique layer in glass manufacture or as a retrofit layer, and is insensitive to existing metalized coatings. It provides multiple transmission/reception functions including CB radios, cellular phones, DSB/DAB broadcast receivers, and global positioning (GPS) receivers, vehicle recovery systems, amateur and public service FM transceivers, anti-collision warning radar antennas for cars and light aircraft, automatic toll collection systems, and remote vehicle identification systems. The antenna does not require external mounting on an automobile. One antenna can be used to replace several externally mounted antennas. It is a vandal and damage resistant alternative to current automobile AM/FM whips and external cellular phone antennas. The tapered impedance loading renders the antenna relatively insensitive to movement of people or objects near the antenna and to the properties of the mounting surface (providing it is dielectric). An azimuthal radiation pattern without deep nulls can be achieved. In fact, the pattern variation in all cases is comparable to or better than a fender mounted whip.

Other advantages and features of the invention will become apparent from the following description and from the claims.

DESCRIPTION OF THE DRAWINGS

FIG. 37 shows azimuth pattern variation and relative surfacewave power gain of loaded rectangular sheet on-glass antenna.

FIG. 41 shows azimuth pattern variation and relative surfacewave power gain of loaded conical sheet on-glass antenna.

DESCRIPTION OF THE PREFERRED EMBODIMENT

Configuration

Figure 7:
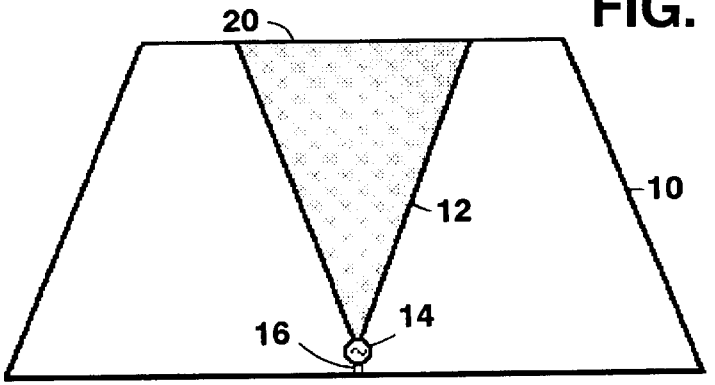
Figure 8:
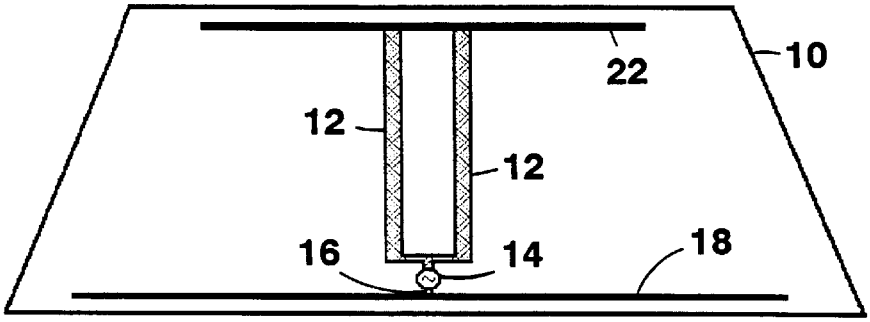

In FIGS. 1 through 8, a windshield 10 bears a sheet-like antenna element 12. The sheet-like antenna element includes a feedpoint 14. The feedpoint provides an electrical connection to the antenna and permits feeding the antenna against a ground. In FIGS. 1 through 7, the ground is not shown but is assumed to be the metal of the car and the connection to the ground is implied by reference numeral 16. In FIG. 8, the ground is provided on the windshield itself by a sheet-like ground 18 so that no connection needs to be made at the bottom of the windshield to the metal of the car, saving cost and improving ease of installation, manufacturability, and radiation pattern performance.

The antennas of FIGS. 1 through 7 are top loaded by having the sheet-like element connected to the top metal of the car at locations 20. In FIG. 8, the top loading is achieved by a sheet-like top loading element 22 included on the windshield so that no connection needs to be made at the top of the windshield to the metal of the car, saving cost and improving ease of installation, manufacturability and radiation pattern performance.

Although the ground 18 and top loading element 22 are only shown in FIG. 8, they could also be used with other antenna configurations including those of FIGS. 1 through 7.

The feeding circuitry would be arranged to permit connection by a variety of electrical devices used in and on the car.

Figure 2:
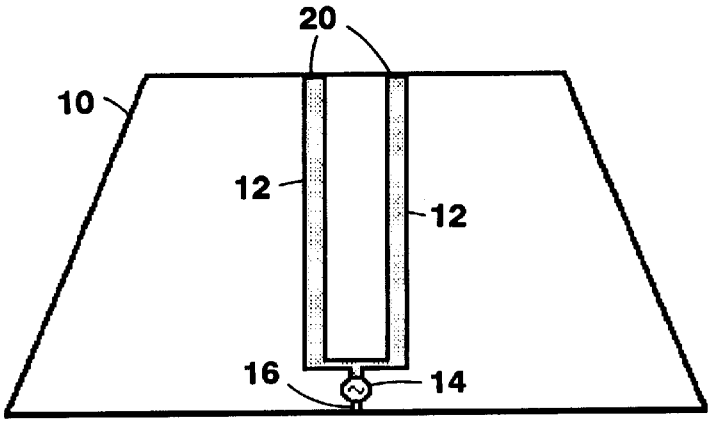
FIGS. 1 through 8 are schematic front views of car windshields bearing antennas.
Figure 1:
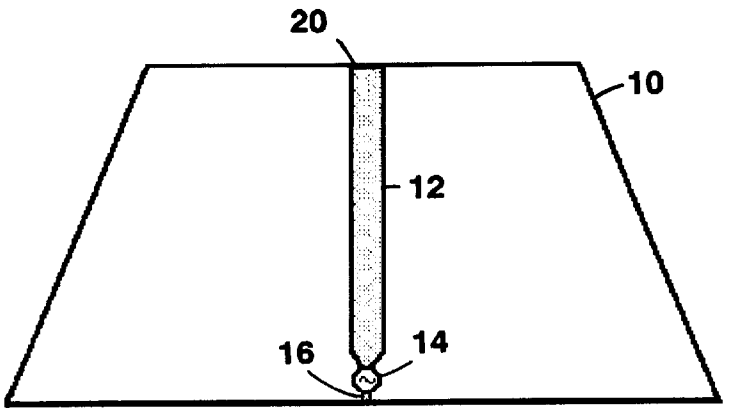
Figure 3:
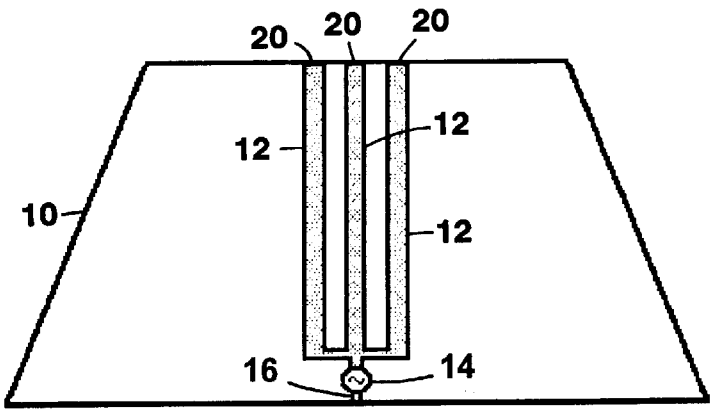
Figure 5:
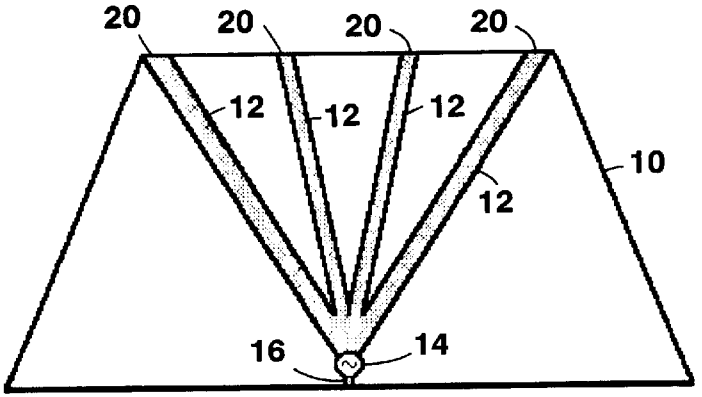
Figure 4:
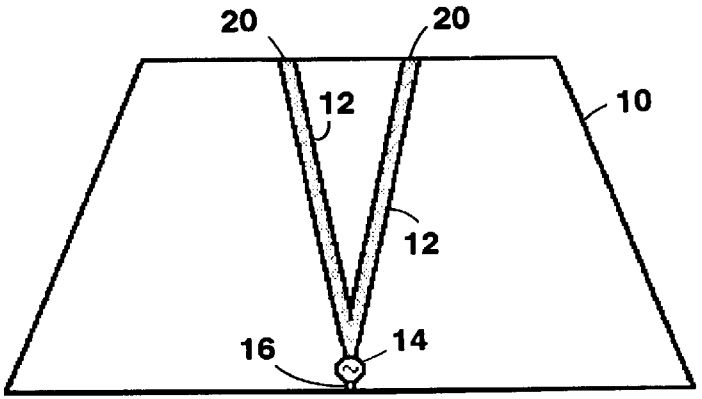
Figure 6:
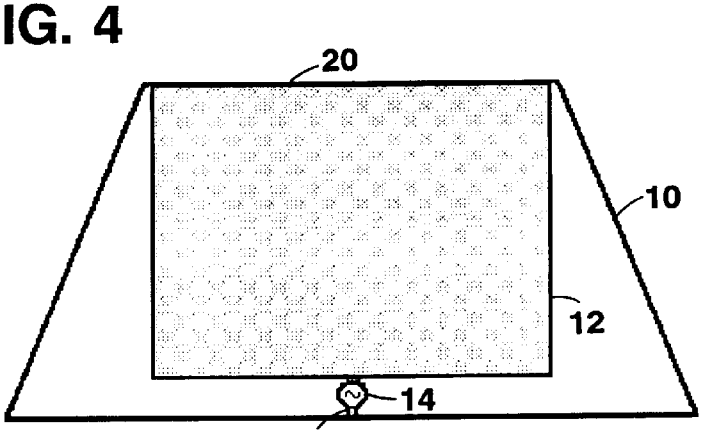

The antennas of FIGS. 1 through 7 have different configurations as follows. In FIGS. 1 through 3 the antenna is of the monopole type with respectively one, two, and three finger-like elements 12 connected in common to the feedpoint. In FIGS. 4 and 5, the antennas are of a planar conical type in which the finger-like elements 12 are connected in common at one end to the feedpoint and radiate away from that point. The antennas of FIGS. 6 and 7 are broader sheets in the shapes, respectively, of a rectangle and a planar cone (triangle). In all cases, the elements have tapered loading with increasing distance from the feedpoint.

The antennas of FIGS. 1 and 6 are limiting cases of a top-loaded monopole. In effect, the antenna of FIG. 1 represents a narrow strip monopole antenna which is top-loaded at its upper end either by capacitive coupling to the car structure or by the top-loading strip incorporated in the glass. The strip width can range from as narrow as, e.g., 1 inch to as wide as the sheet representation shown in FIG. 6, that almost entirely spans the glass area.

The two and three element monopoles of FIGS. 2 and 3 can again be viewed as a subset of the above, because they are "discretized" versions of the continuous sheet of FIG. 6. Element widths for these two cases are from as narrow as, e.g., 0.5" up to a width where the individual elements would merge to once again become a continuous sheet. A greater number than 3 monopole elements could also be used.

The planar conical embodiments of FIGS. 4, 5, and 7 are also related. For the two element embodiment of FIG. 4, the angle between the elements can be in the range from zero degrees (where it is equivalent to the antenna of FIG. 1) to approximately 70 degrees. Azimuth pattern variation tends to increase with larger angles between the elements. For the 4 element planar cone antenna of FIG. 5, the same range of angles applies for both the inner and outer elements. More than 4 discrete elements could be used.

For the conical sheet antenna of FIG. 7, the apex angle of the cone can range from zero where with a finite element width it is equivalent to FIG. 1 to as large as 70 degrees. In general, the upper limit on the cone angle is determined by the size of the windshield where width of the upper edge of the cone approximates the width of the upper edge of the glass. For other applications not involving a conducting mounting platform, wider cone angles may be acceptable.

Element lengths are dependent on the size of the glass area available and the required frequency range. In general, the effective length of the radiating element should approach a quarter of a wavelength at the lowest operating frequency.

With top-loading present, the length of the vertical elements, 12, will be less than a quarter wavelength at the lowest frequency. In one example of the monopole of FIG. 1, the length of the vertical element is 80 cm, the top-loading strip is 3" wide and 48" long, and the ground strip is 3" wide by 48" long.

Fabrication

One method of fabricating these antennas is from plastic films sputtered with thin metallic layers. The antenna elements may be constructed from a variety of conductive materials: evaporated or sputtered thin metal films; conductive inks or paints; conductive ceramics or glasses; ferromagnetic materials. Control of the impedance along the element length can be effected by a variety of means including: variation of the thickness or width of the element material; the use of materials or combinations of materials with differing electrical conductivities, permittivities and permeabilities at various places on the element; the perforation of the material from which the element is fabricated with holes or voids such that the impedance is controlled by the size and quantity of holes or voids within the element material.

Of the possible materials to be used for the metallization the overall choice would be based on a trade-off of the material resistivity and metallization thickness. In general less resistive (more conductive) metals and alloys, e.g., silver, bronze, copper, allow the use of thinner metallization thicknesses to achieve the same conductivity, but tend to exhibit greater optical reflection and absorption coefficients and therefore may be more visibly objectionable. Higher resistivity metals and alloys, for example, NiChrome and stainless steel can also be vacuum sputtered and while requiring greater thickness to achieve the same conductivity, they tend to have lower optical reflection and absorption coefficients and therefore can be made less visually objectionable. Also the antenna may be used in conjunction with a second metallized film used for UV protection or as an electrical heater for demisting purposes, in which case the antenna element material needs to match the color of the second film in order to make it less visible.

The thickness of material required to achieve the tapered loading on the antenna element depends on the conductivity of the material selected, the range of element conductivities required and the required optical transmittance. For example, high conductivity materials such as copper, bronze or silver would require material thicknesses in the range $3.4\times10^{-8}$ to $3.3\times10^{-9}$ meters. Other materials would require different material thicknesses.

Both top loading and artificial ground strips are several inches wide; the thickness of material is sufficient to make it a good conductor—around $2.2\times10^{-7}$ meters for NiChrome material.

Figure 9:
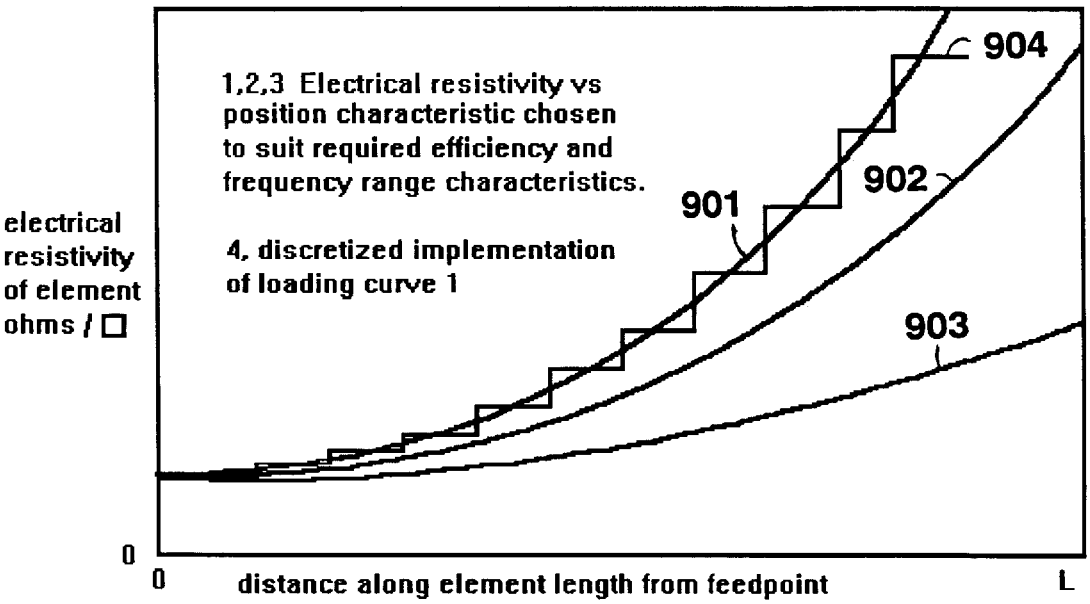
FIG. 9 shows a variation of element resistivity with distance along element (simple Wu-King loading).

The relationship between element position and resistivity is chosen to provide the required efficiency and bandwidth performance for the element (see curves 901, 902, 903 in FIG. 9). The desired loading characteristic may be implemented as a continuous curve, or for convenience in production, the desired continuous resistive profile may be approximated by means of a series of stepped resistivity increments, the antenna element being divided into a series of connected segments of differing resistivities. The resistivity of each connected section is then made equal to the mean resistivity value of an equivalent continuous loaded antenna over the same range of element longitudinal and lateral coordinates. Providing the segment dimensions are sufficiently small compared to a wavelength, $\lambda$ (e.g.,$<\lambda/10$ at the highest frequency of interest), the change in the actual current distribution produced by this discretization is small at any location on the surface of the antenna. The performance of the antenna implemented with discretized resistivity values is therefore virtually identical with that obtained from an antenna with truly continuous resistive loading.

An example of this discretization is shown as curve 904 in FIG. 9 for a simple Wu-King loading profile (resistivity varies only as a function of antenna length). For a sheet antenna the resistivity value for each discretized segment is the average value of the resistivities at the coordinates on an equivalent continuously loaded antenna which correspond to the corners of the segment in the discretized antenna.

Assuming the material used for the antenna element has a resistivity $\rho$ ohm meters, and the segment of the element is desired to have a resistance of R ohms/square, for simple sheet materials with isotropic electrical resistivity, the required material thickness T can be calculated as:

$$T=\rho/R\text{meters}$$

Figure 10:
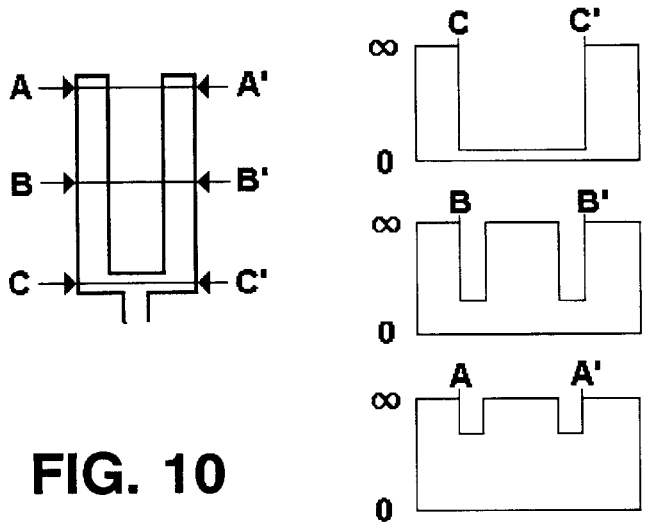
FIG. 10 shows longitudinal and lateral element loading for simple Wu-King loading (not visually optimized).

The profiling of resistivity may be chosen to enhance the unobtrusiveness of automobile antennas. The resistivity profile of the dual monopole element without any optimization for visual unobtrusiveness would be as shown in FIG. 10 (simple Wu-King case, resistivity varies only with element length). The resistivity profiles for three cross sections are shown in FIG. 10, the resistivity being constant across the element width.

Figure 11:
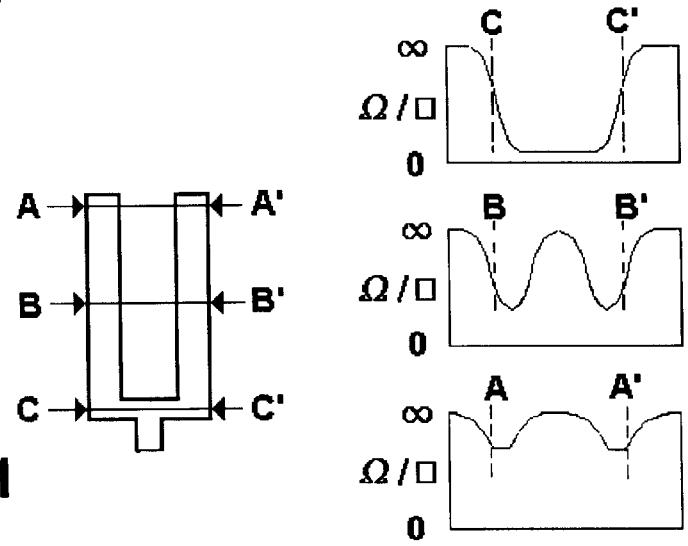
FIG. 11 shows longitudinal and lateral element loading for improved visually unobtrusive antenna.

To decrease the visual obtrusiveness of the antenna element on the windshield, the metal film may also be profiled laterally across the element width. This has the effect of providing a smoother and therefore less perceptible change in optical characteristics (reflection coefficient and transmission coefficients) between the antenna element and the surrounding window glass as shown in FIG. 11.

Figure 12:
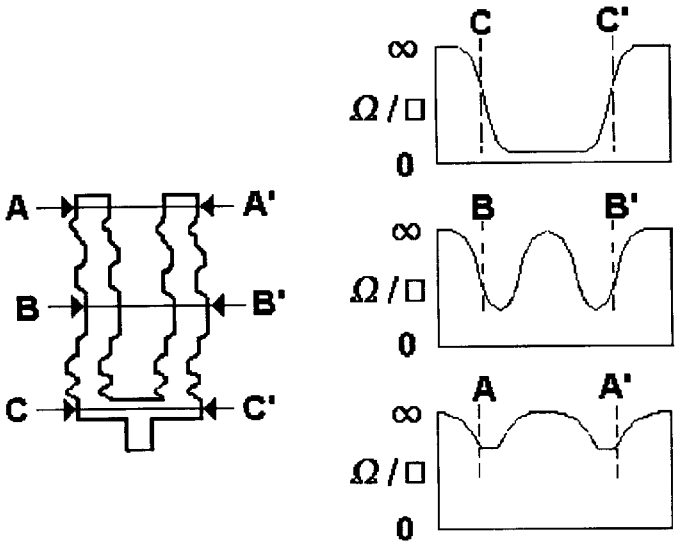
FIG. 12 shows longitudinal and lateral element loading combined with randomized element edge location for minimum obtrusiveness.

Additional reduction in the visual profile can be produced by a small randomization of the edge position of the element combined with the lateral profiling. If the variance of the edge position is small, i.e., 1–2 inches, and the change in edge direction is smooth or sinuous and not stepwise, the element can be rendered visually less obtrusive without significant degradation of the antenna performance (see FIG. 12).

Figure 13:
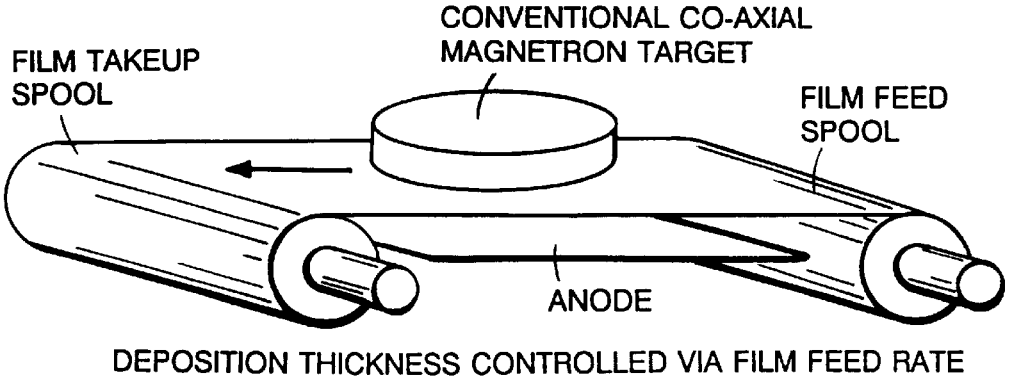
FIG. 13 shows a technique for producing variable resistivity metal films (longitudinal variation only).

As shown in FIG. 13, existing sputtering technology can provide tapered resistivity along the element length. Cyclic adjustments of film feed rate with time may be used to produce multiple sections of film with the required longitudinal resistive profile produced as metallized sections along the length of the film sheet. High feed rates result in thinner, more resistive film being deposited, slow feed rates result in thicker, less resistive metallization. Existing production techniques are designed to metallize plastic film to a high degree of uniformity across the width except for the sections close to the edge of the magnetron target. Use of a small diameter magnetron target assembly could therefore be used to provide some degree of edge tapering for the simple sheet or dual monopole type elements.

Conventional photolithography techniques could be used to remove unwanted metallization, using a suitable photoresist and etching medium. The mask edges could be shaped to provide the randomization shown in FIG. 12 to improve the non-obtrusive characteristics of the antenna elements, although profiling of the metal film thickness may not be entirely possible using this production method.

Figure 14A:
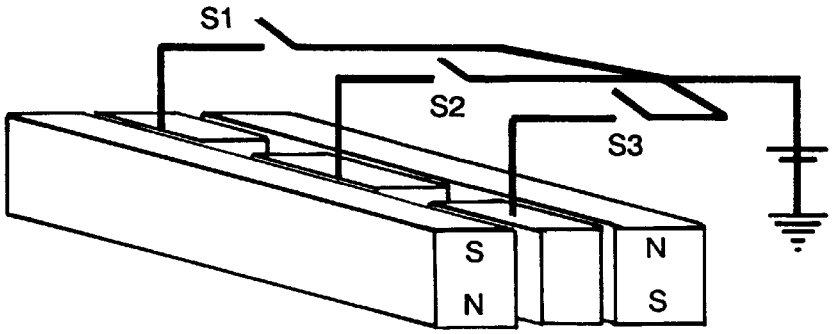
FIG. 14 shows a technique for sputtering metal films with longitudinal and lateral variance in resistivity.
Figure 14B:
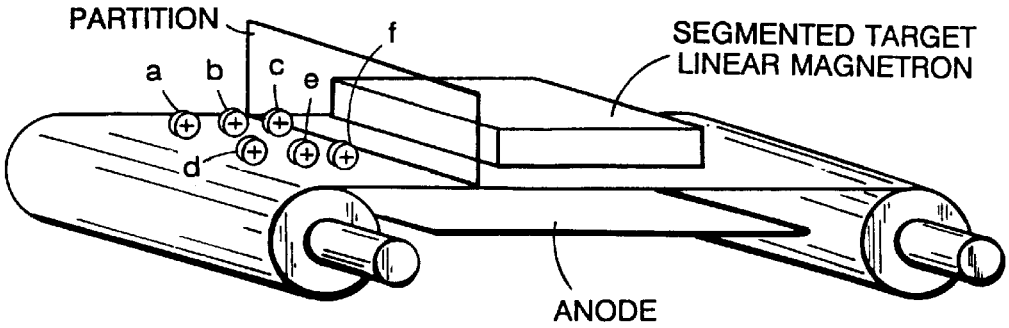

An alternative production method, shown in FIG. 14, would sputter metallic films with controlled variation in resistivity in both the longitudinal and lateral directions.

The target fabricated from the metal to be sputtered would be divided into a series of smaller linear targets. These target segments are placed in rows. The width of the individual targets, as measured at right angles to the direction of film flow, are selected to be small enough to provide the required resolution for the individual features of the antenna element to be produced while not being so small as to require frequent replacement. The thickness of the targets, as measured in the direction of film flow, is also selected to ensure that element features can be produced with sufficient resolution, too large a thickness having an integrating effect on the resolution of the element shape. Each linear array of targets is flanked by magnets with alternating polarization in order to provide a crossed electric and magnetic field which is known to promote plasma ionization and therefore efficient sputtering. Arrays of targets designed to produce different antenna element features are stacked side-by-side with their longest axis orthogonal to the direction of film flow. In order to increase film throughput several arrays of identically sized targets may be used, especially where an essentially conductive and therefore heavily metallized element is required, such as the artificial grounding strips required for the window antennas.

In operation, selective sputtering is achieved, by a combination of film flow speed, as in conventional longitudinal resistivity control, and selective enabling of the individual targets as required, in order to selectively sputter features onto small, localized segments of the film. The antenna element shape is formed by overlapping these smaller sputtered segments into a composite whole. The targets can be enabled as shown in FIG. 14, by switched connection (S1, S2, S3) to a source of negative voltage, or by connection of each target to an individual source of variable negative voltage, whose magnitude is controlled to produce the required local instantaneous rate of deposition.

To monitor the resistivity of the completed antenna element, a series of rollers or other electrical probes is used to monitor the local resistivity between different position on the surface of the metallized film, the position of these probes being selected with regard to the resistivity profile and shape characteristics of the particular shape of the antenna element to be produced. In order to simultaneously monitor the resistivity of multiple points on the surface of the metallized film, the probes b, c, d, e, f, . . . are connected to calibrated AC voltage sources of differing frequency with contact (a) as a common current return. The current flowing from each source is then measured, frequency domain filtering being used to discriminate between the current flowing in the film path between contact (a) and the (nth) contact and the current flowing between the, (mth) contact and contact (a), where $m \neq n$. By measuring the current flowing in the contacts b, c, d, e, f . . . , and knowing the excitation voltages, the metallized film resistances between contact (a) and the other contacts b, c, d, e, f . . . , can be calculated. The diagonal resistances between these other probes, e.g., between (b) and (c) can easily be calculated using matrix methods, and subsequently compared for process control purposes with expected resistance values obtained from modeling of the antenna element resistivity by means of techniques such as finite element methods.

The flow of the plastic substrate film and the point in time and degree to which each targets is enabled is controlled by a computer which also monitors the data from the resistance measurement contacts. A variety of control algorithms can be used to implement an adaptive process control system whereby the measured resistance values from the last antenna element are compared with the desired resistance values and the errors between these two sets of values are then used to modify the film feed rate and target potential waveforms in order to reduce the resistance errors in the next antenna element produced. This process compensates for performance variations in the sputter targets as they erode during use.

Figure 15:
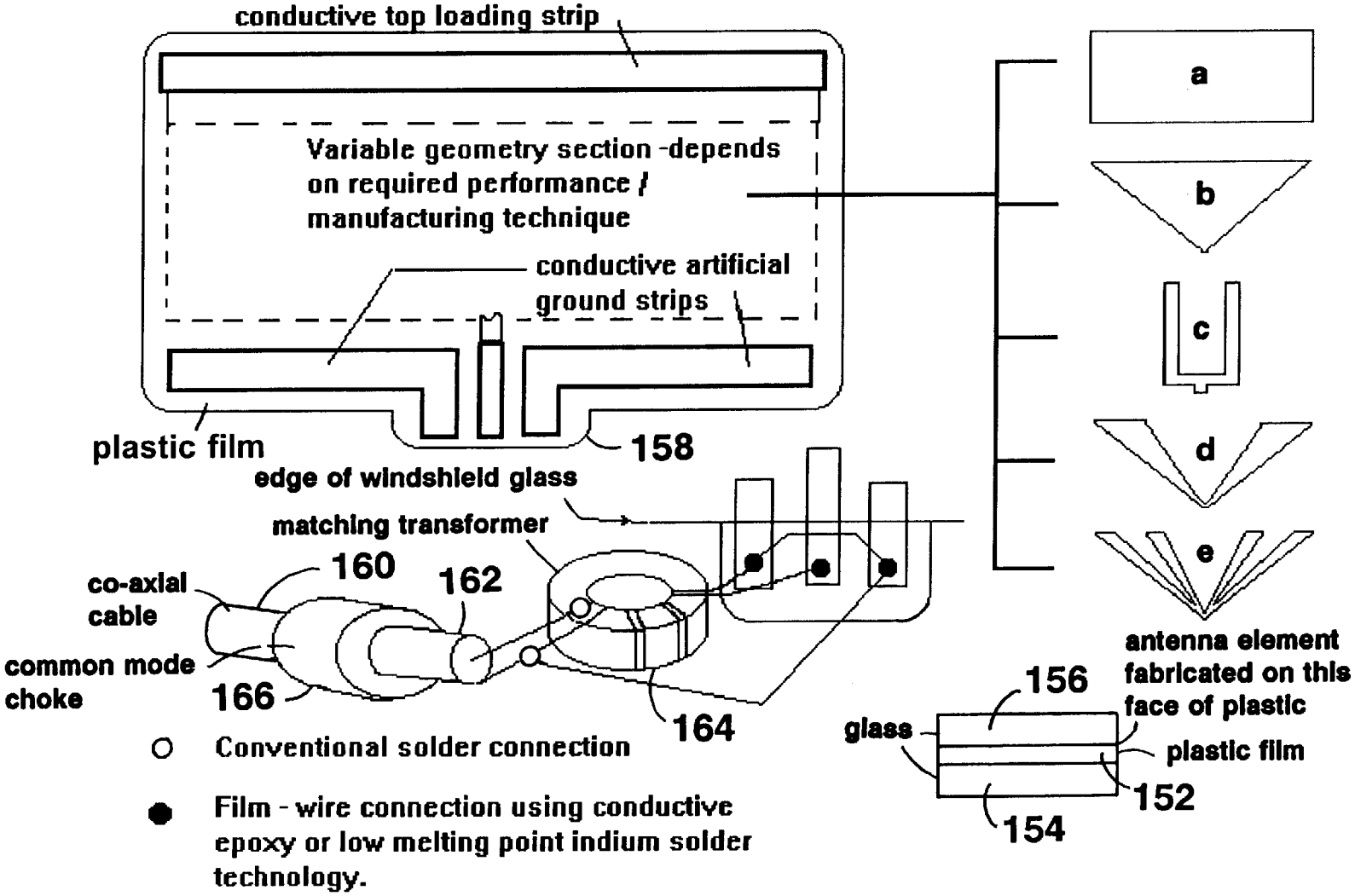
FIG. 15 shows antenna and antenna matching assembly general features.

Referring to FIG. 15, once the elements are formed on the plastic substrate (including the antenna, the top loading strip, and the two segments of the ground strip), the film 152 is laminated between two layers of glass to form a windshield but with a tab 158 of the film extending beyond the periphery of the glass. After the windshield has been installed connection can be made to the antenna from, e.g., a coaxial cable 160 by connecting the central conductor 162 via a matching transformer 164 and connecting the ground sheath 166 directly to the two ground strips. The connections to the windshield may be made using conductive epoxy of a low-temperature melting indium solder. Other connections can be made by conventional soldering.

A wide variety of devices can be attached to the antenna including transmitters and receivers, CB radios, AM and FM radios, cellular phones, DBS/DAB broadcast receivers, Global Positioning System (GPS) receivers, vehicle recovery systems, amateur and public service FM transceivers, anti-collision warning radar antennas for cars and light aircraft, automatic toll collection systems and remote vehicle identification systems.

Performance

For purposes of evaluating the radiation pattern and surfacewave gain performance of the on-glass antennas, a 32" long, ⅛" diameter AM/FM broadcast whip on a Ford Taurus was chosen as a reference. The mismatch loss, which is substantial between 40 and 50 MHz, was not included when computing the surfacewave gain of the on-glass antennas relative to the reference.

The antennas of FIGS. 1, 2, and 4 were evaluated as a function of strip width and loading profile to determine sensitivity of pattern, impedance and surfacewave gain to these parameters. The Numerical Electromagnetics Code (NEC) was used for the analysis. NEC is an accepted, widely used, electromagnetics analysis tool. The antenna, the vehicle and the effects of a real earth were modelled.

Figure 16:
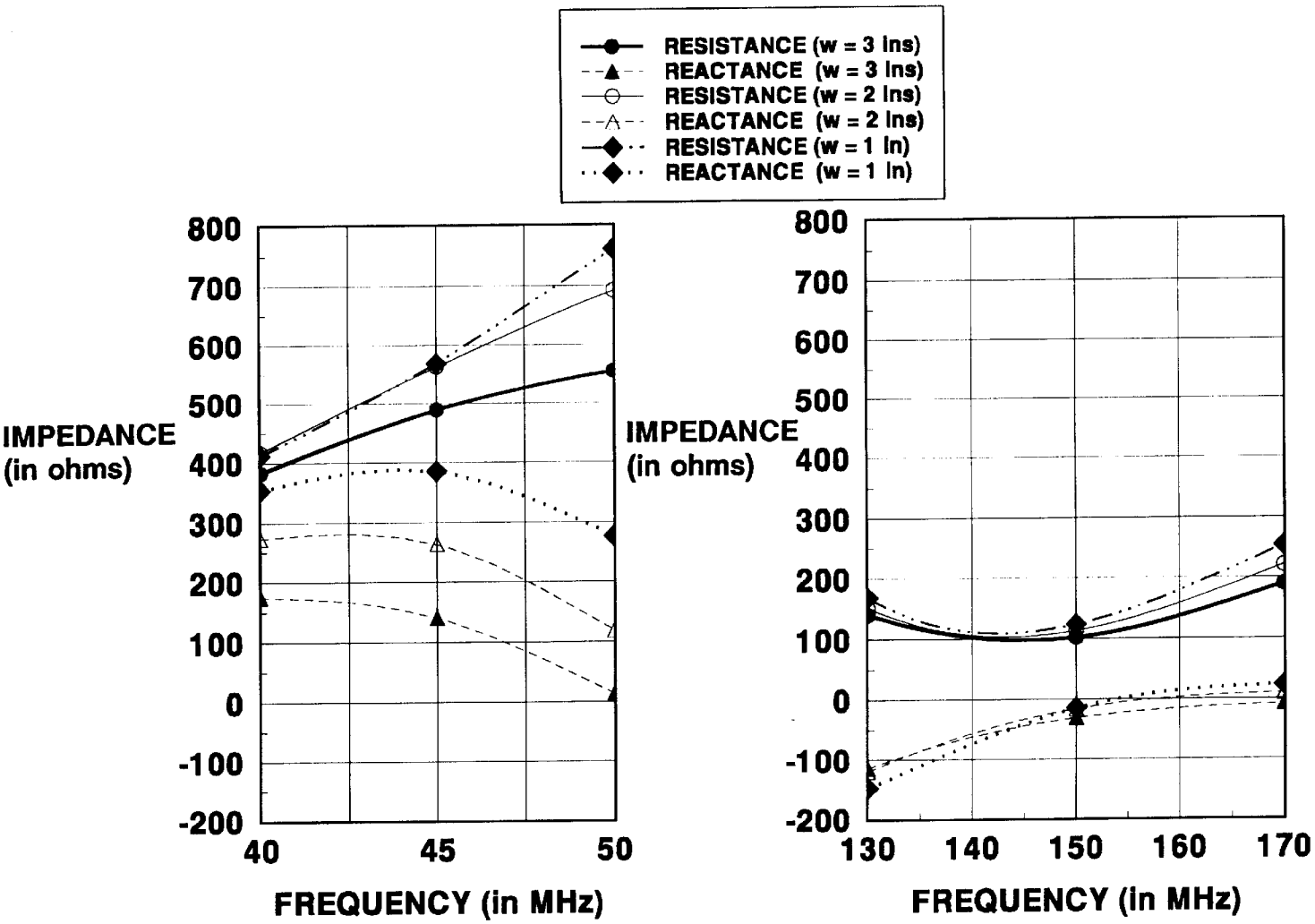
FIG. 16 shows input impedance of top-loaded monopole as a function of antenna element width.
Figure 17:
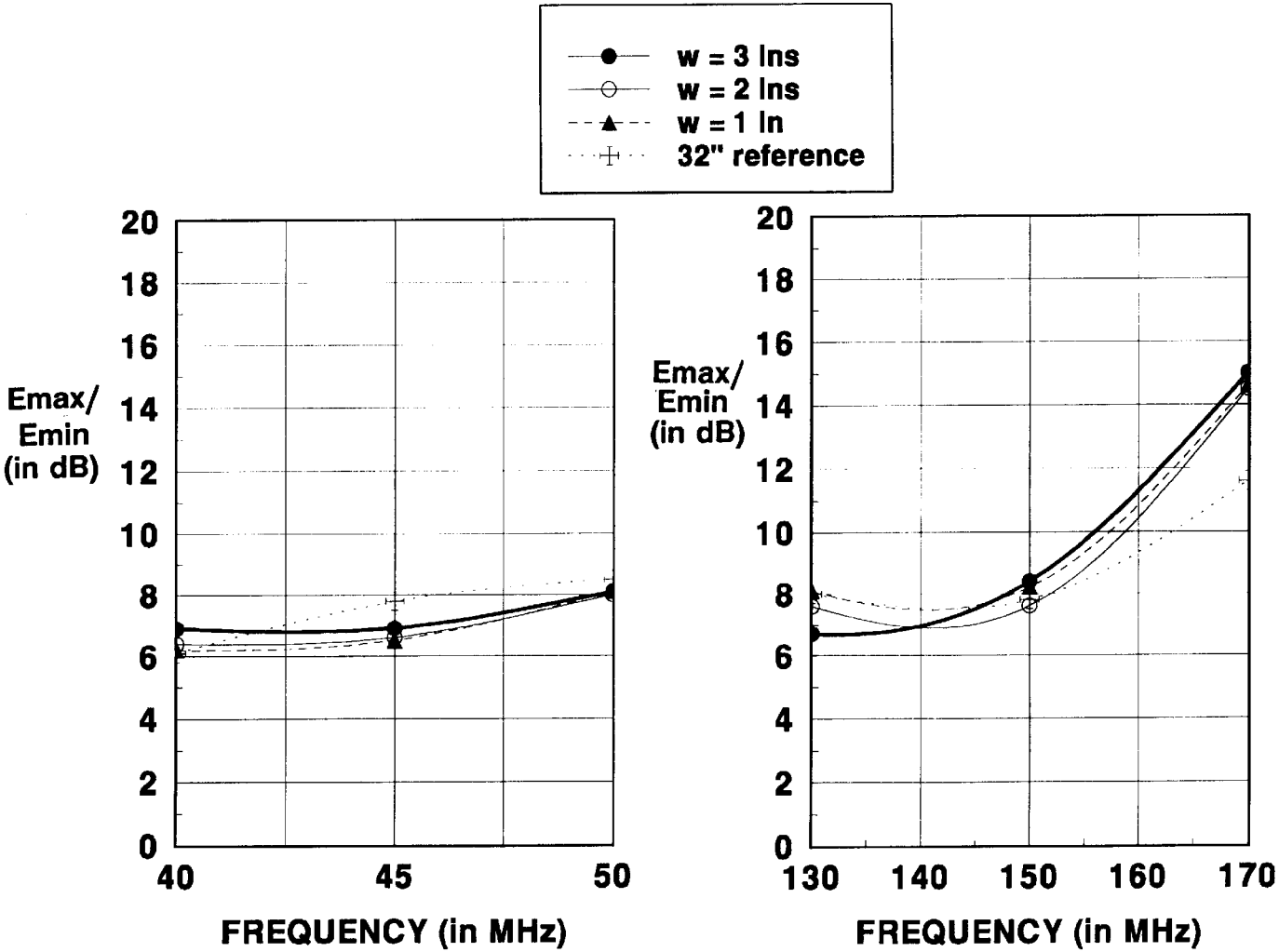
FIG. 17 shows azimuth pattern variation of top-loaded monopole as a function of antenna element width.
Figure 18:
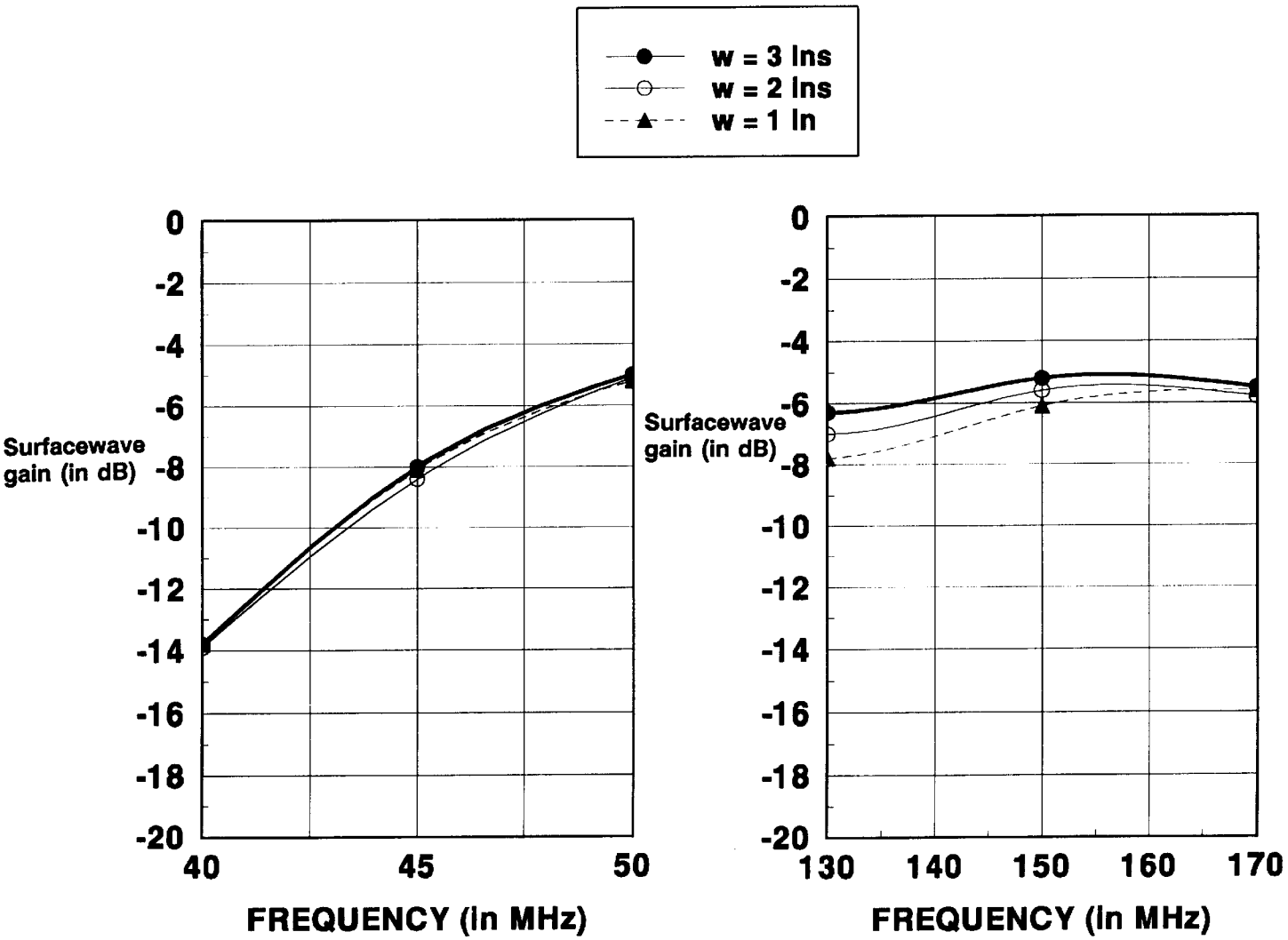
FIG. 18 shows surfacewave gain of top-loaded monopole relative to 32" reference as a function of antenna element width.
Figure 19:
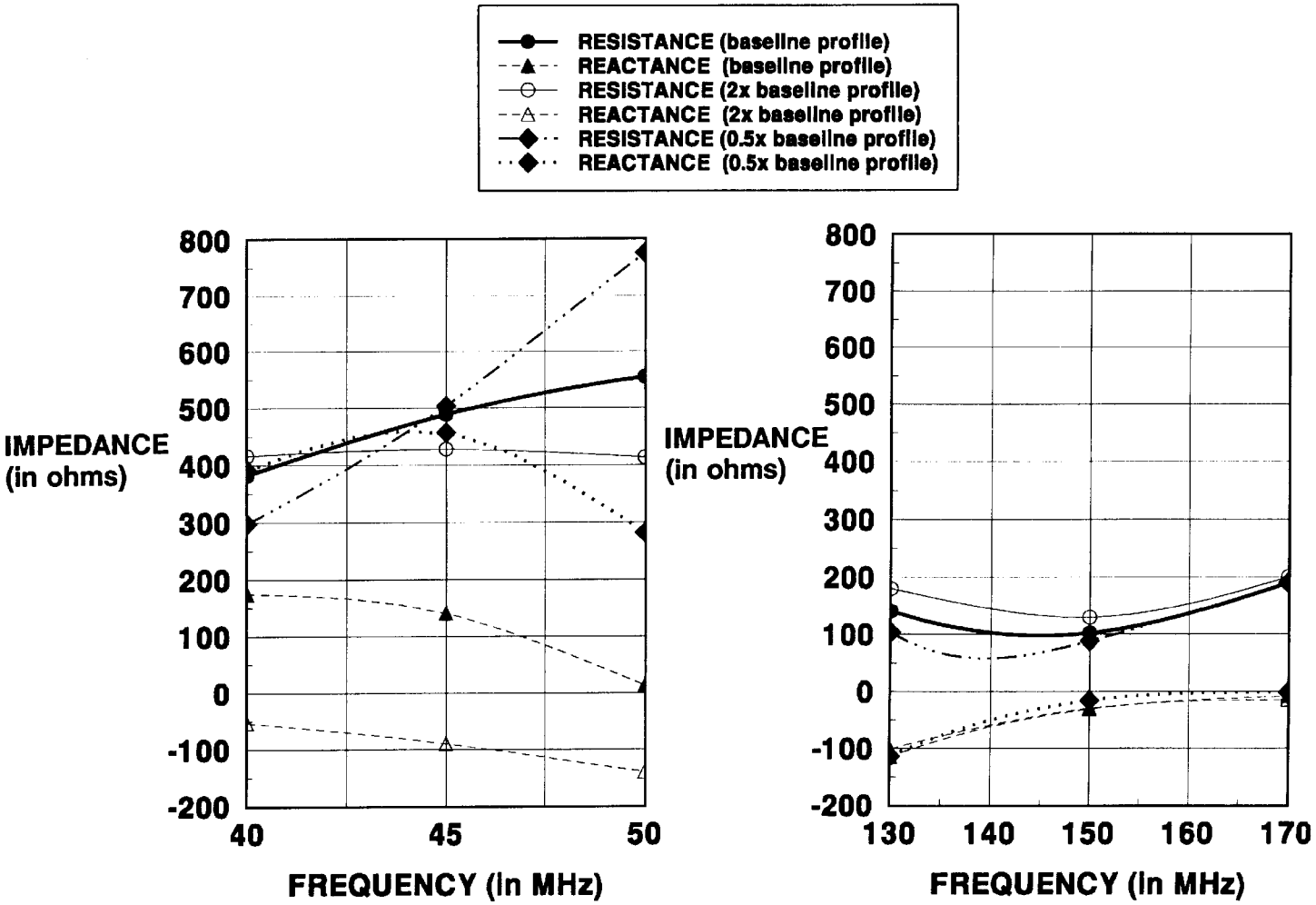
FIG. 19 shows input impedance of top-loaded monopole as a function of antenna loading profile.
Figure 20:
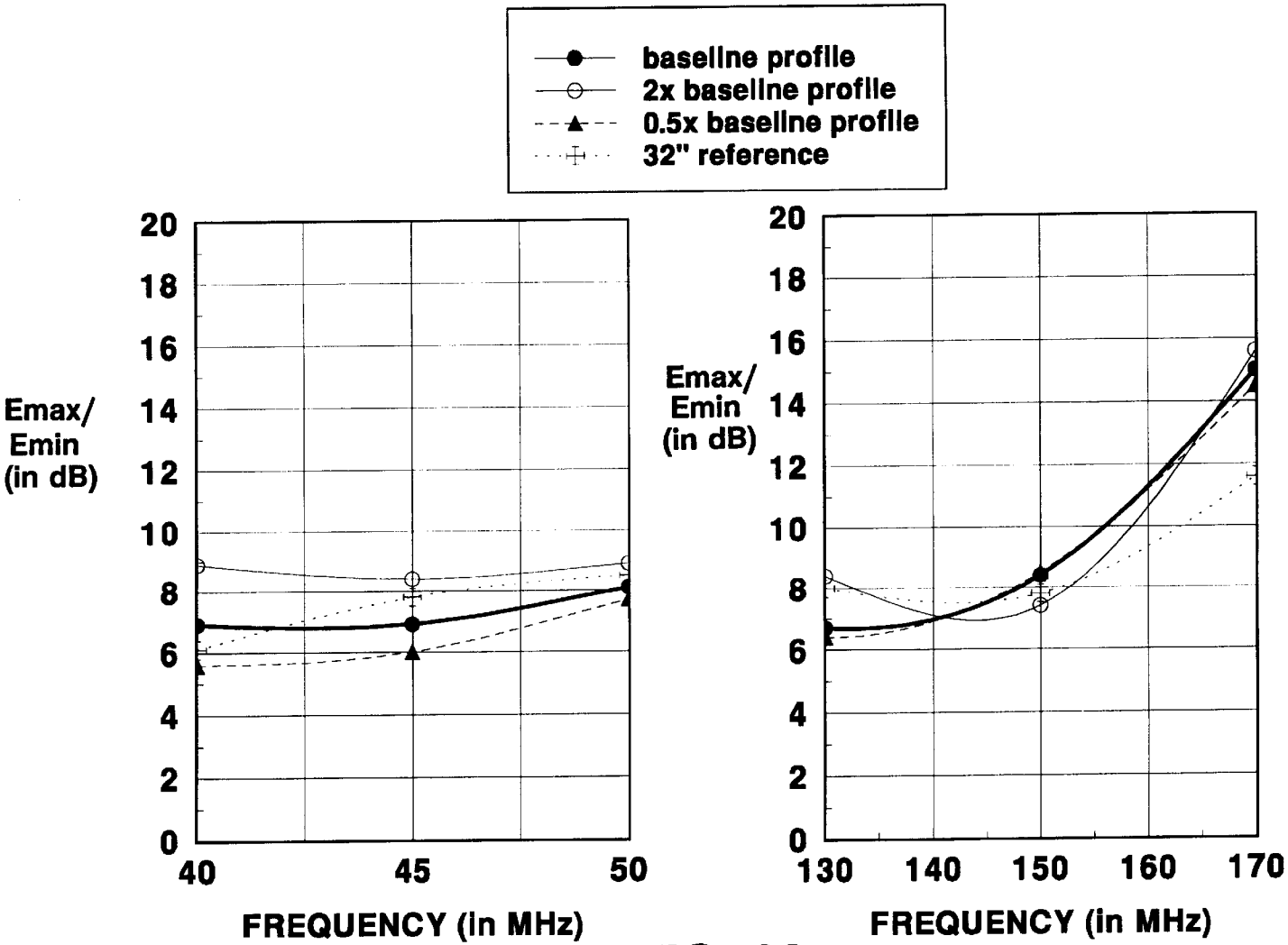
FIG. 20 shows azimuth pattern variation of top-loaded monopole as a function of antenna loading profile.
Figure 21:
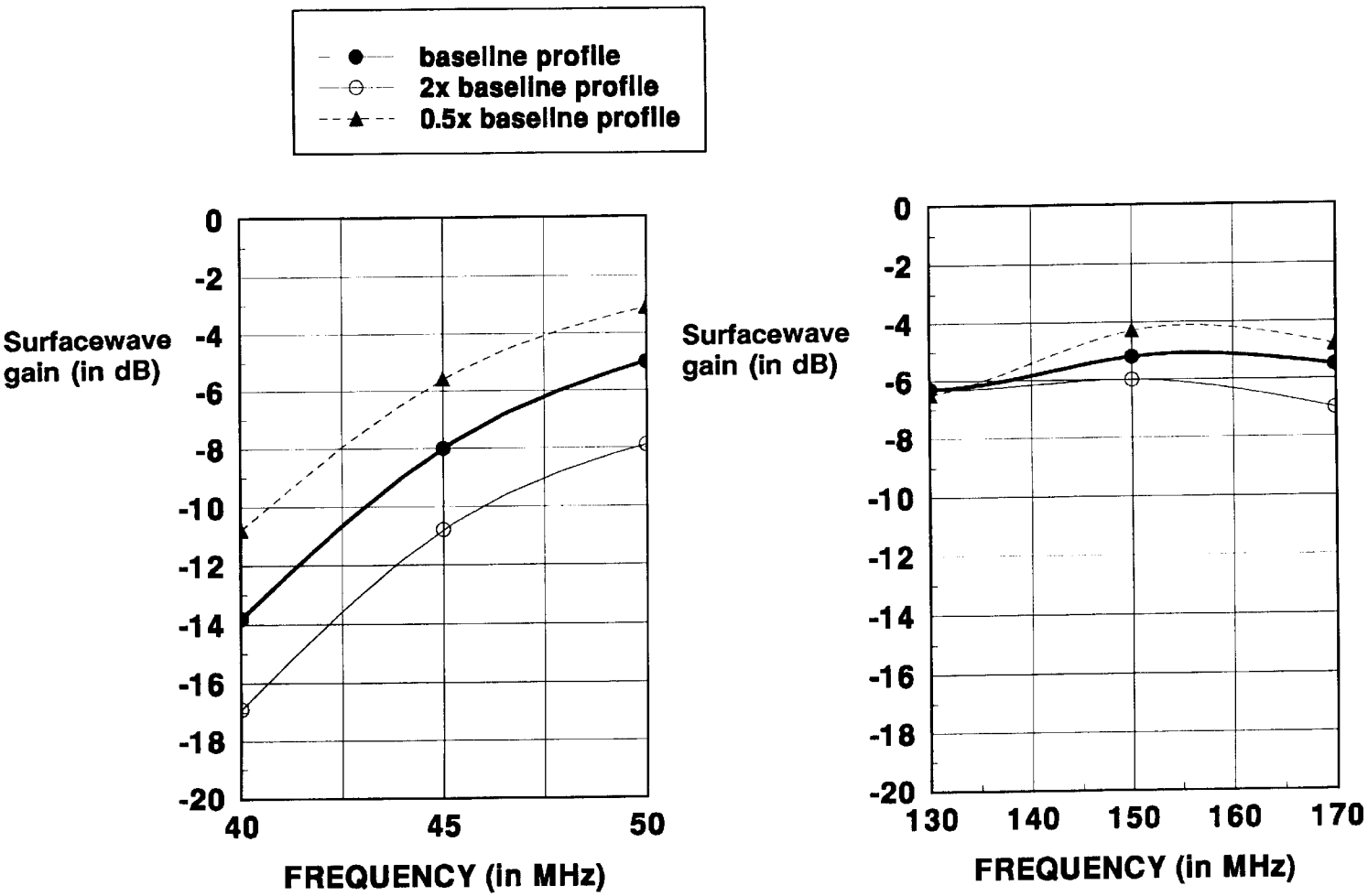
FIG. 21 shows surfacewave gain of top-loaded monopole relative to 32" reference as a function of antenna loading profile.

For the monopole antenna of FIG. 1, three different strip widths were considered, and three different loading profiles. The baseline profile varies the loading from 6.9 ohms at the feed point to 87.5 ohms at the upper end. Loading profiles of twice and half these values were considered. The input impedance, pattern variation $E_{max}/E_{min}$ and surfacewave gain relative to the 32" reference antenna, are shown in FIGS. 16–18 as a function of strip width and in FIGS. 19–21 as a function of loading profile.

Figure 22:
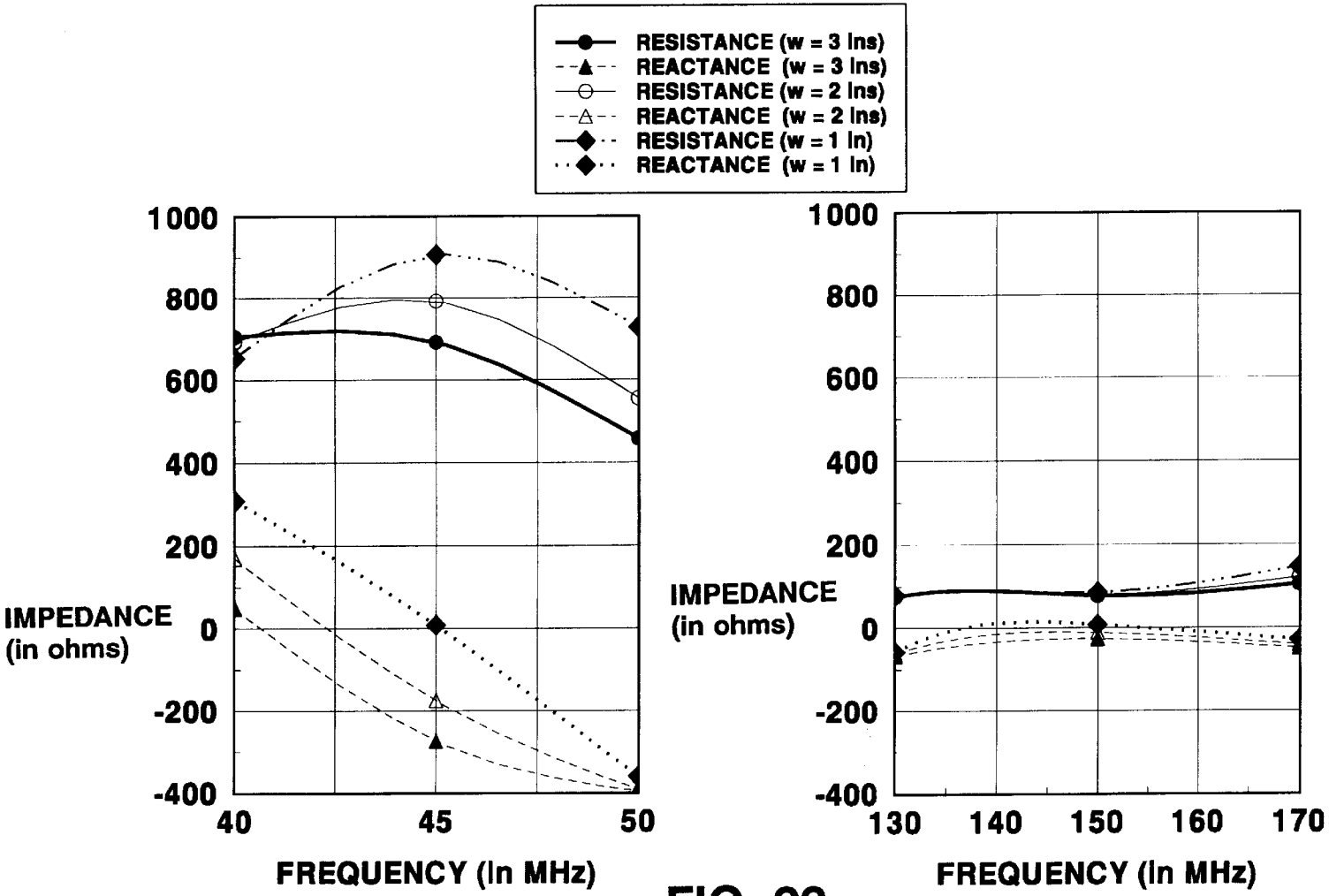
FIG. 22 shows input impedance of two element monopole as a function of antenna element width.
Figure 23:
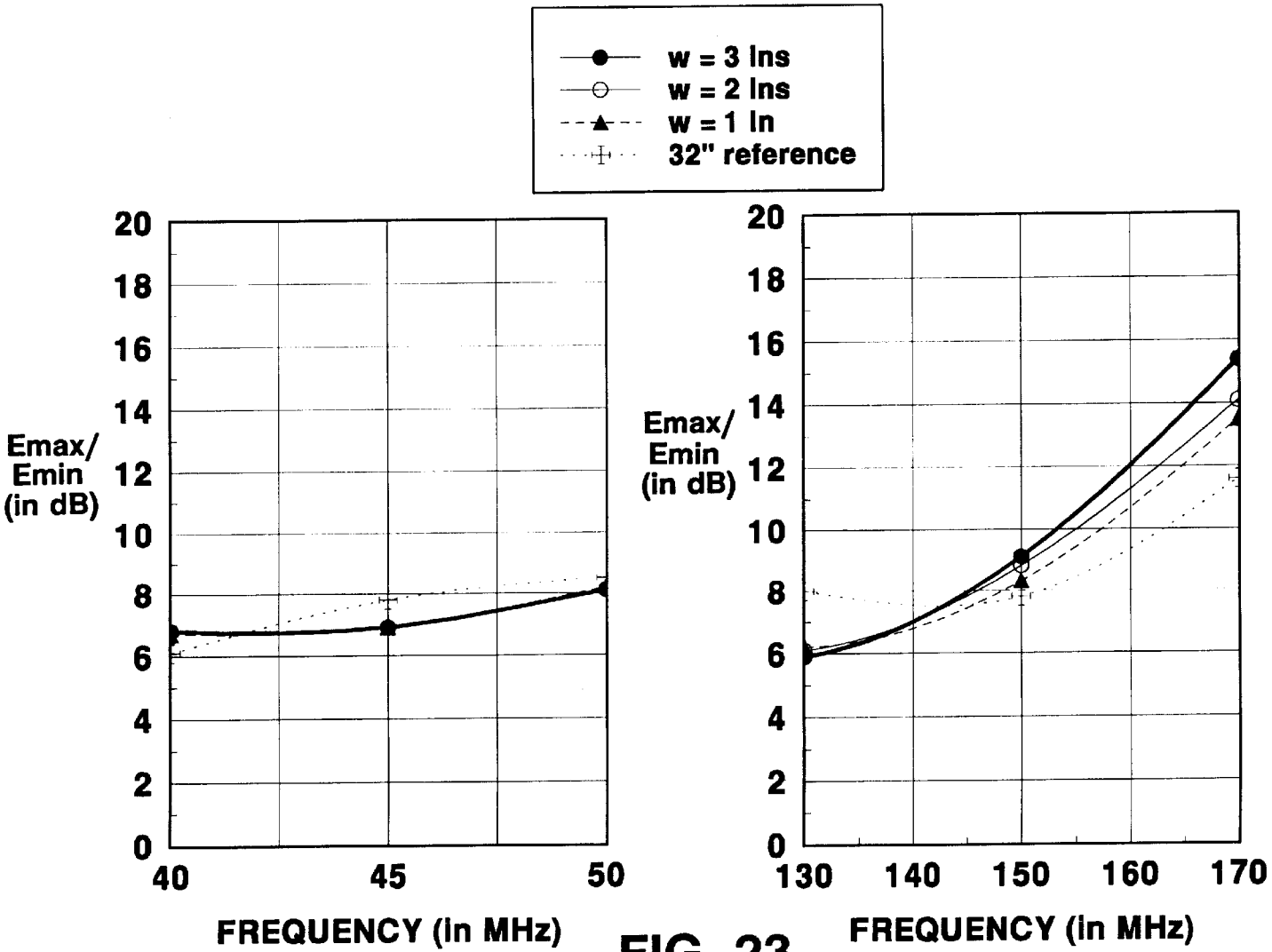
FIG. 23 shows azimuth pattern variation of two element monopole as a function of antenna element width.
Figure 24:
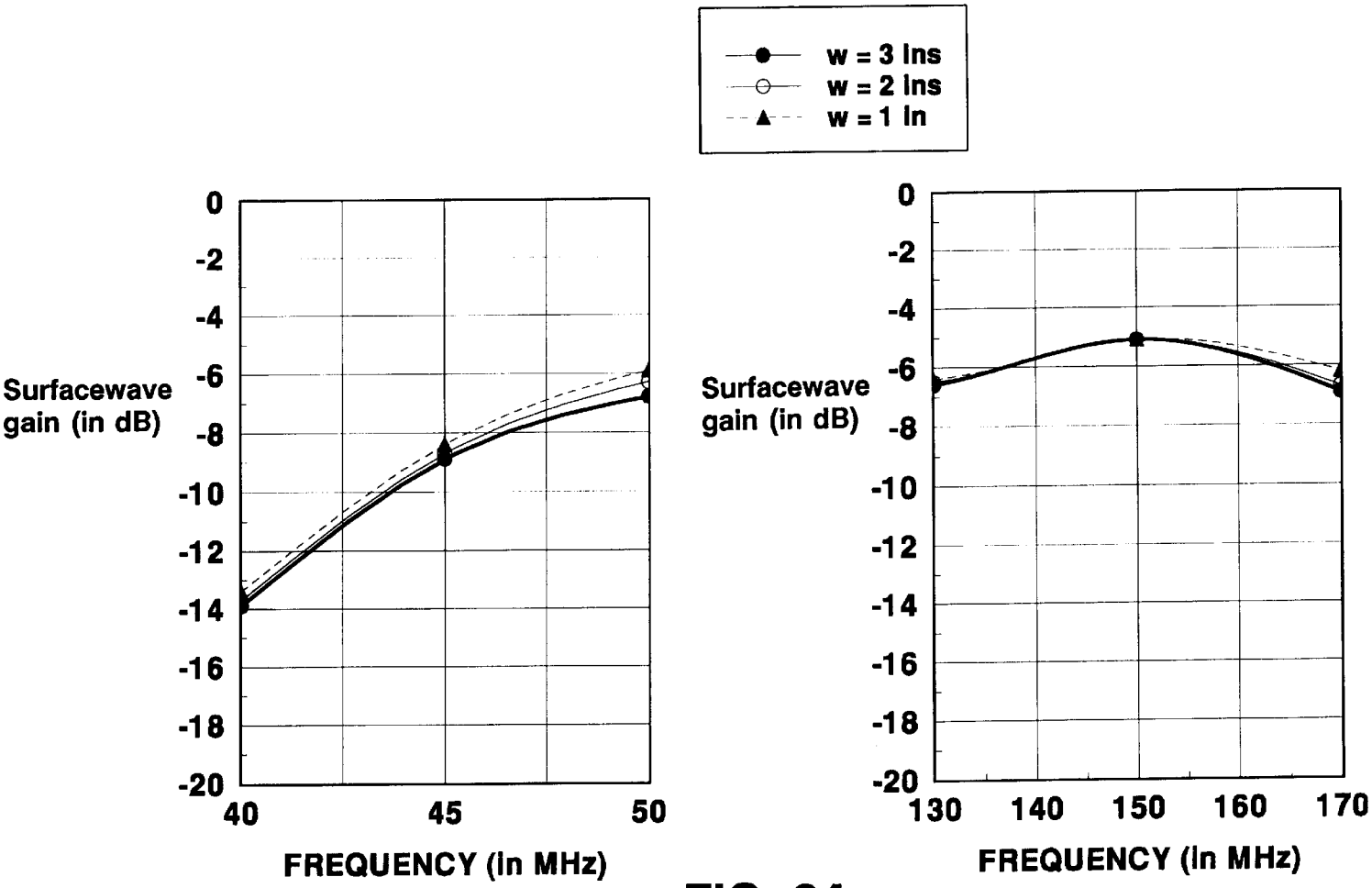
FIG. 24 shows surfacewave gain of two element monopole relative to 32" reference as a function of antenna element width.
Figure 25:
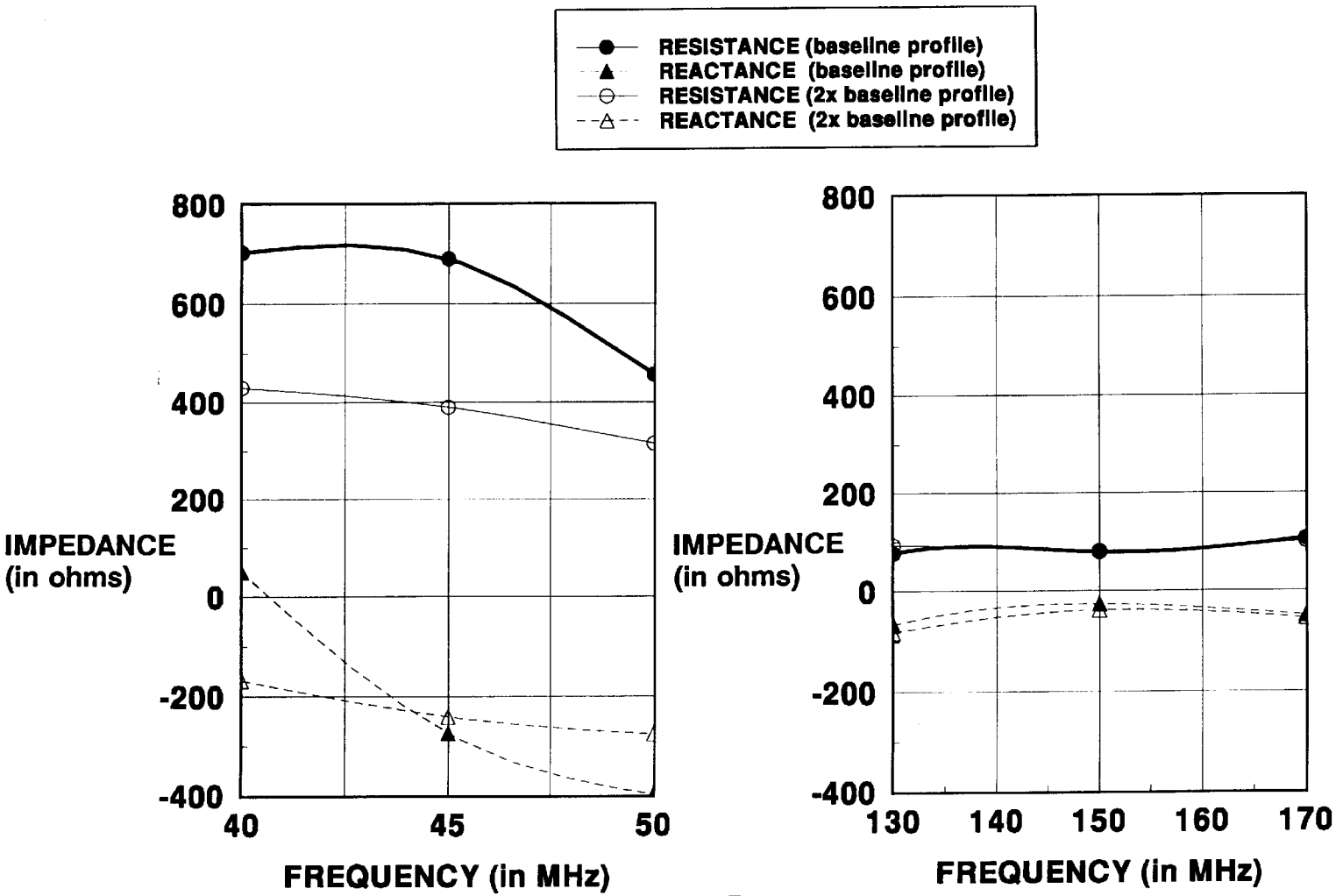
FIG. 25 shows input impedance of two element monopole as a function of antenna loading profile.
Figure 26:
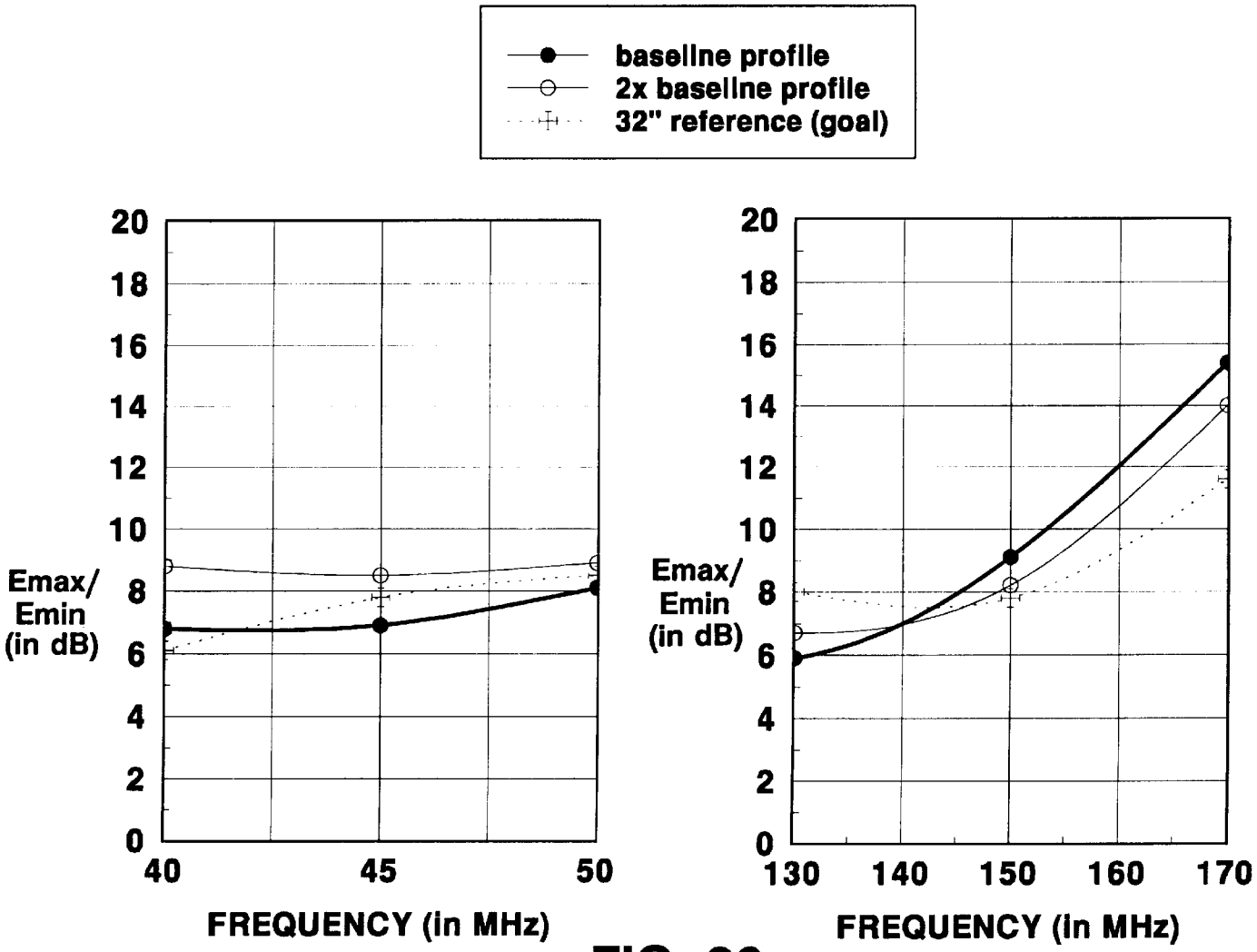
FIG. 26 shows azimuth pattern variation of two element monopole as a function of antenna loading profile.
Figure 27:
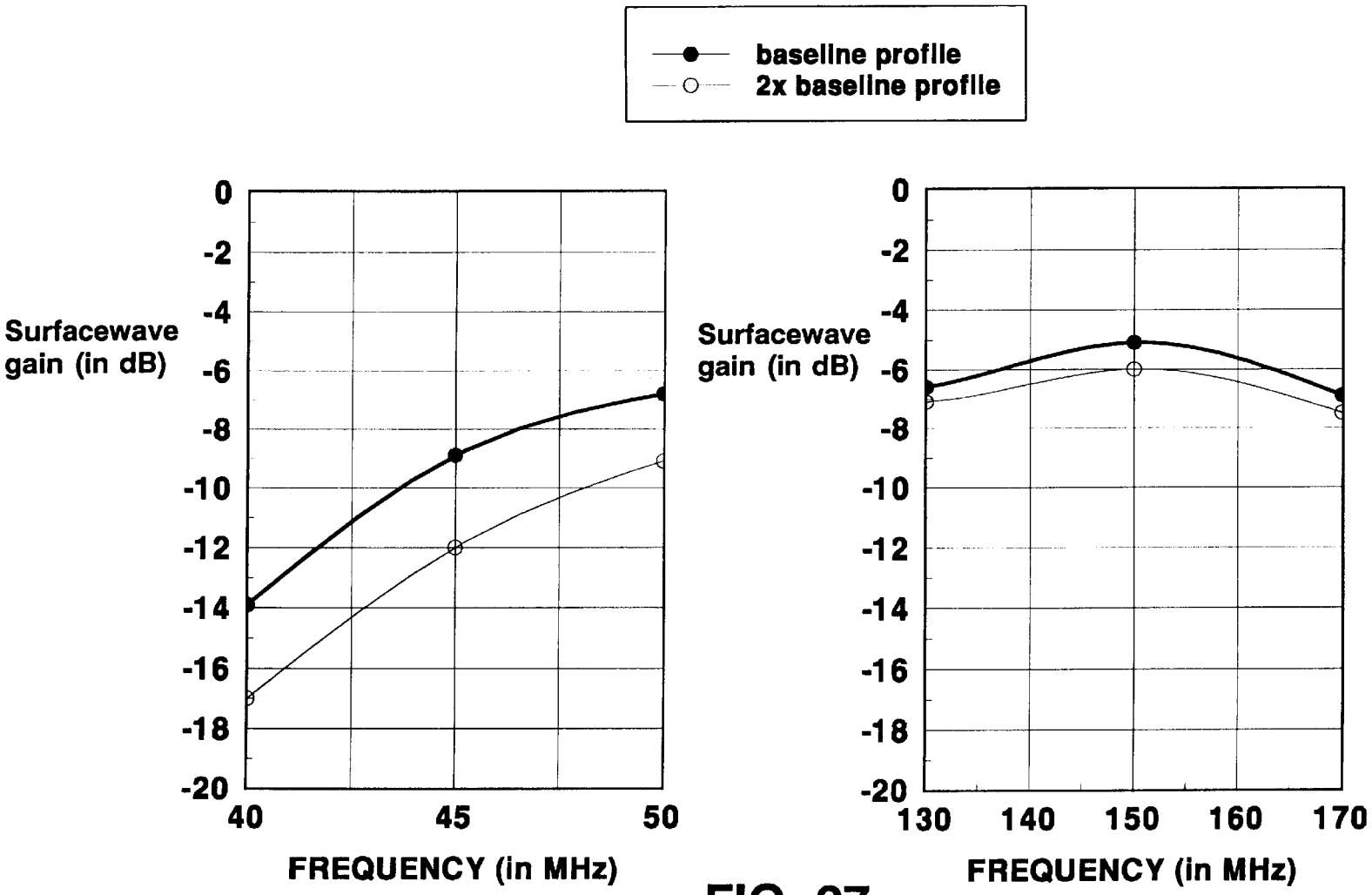
FIG. 27 shows surfacewave gain of two element monopole relative to 32" reference as a function of antenna loading profile.
Figure 28:
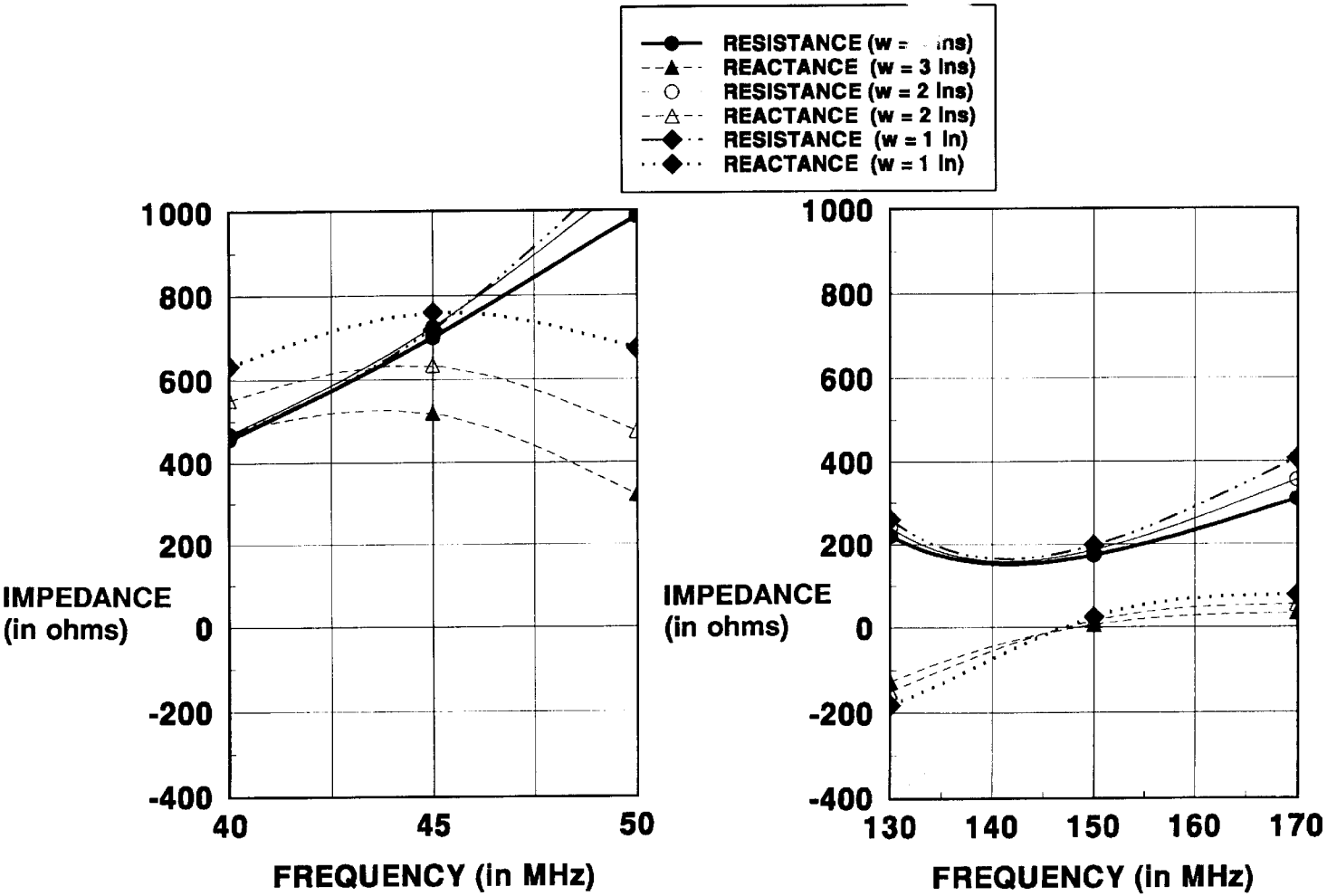
FIG. 28 shows input impedance of two element conical monopole as a function of antenna element width.
Figure 29:
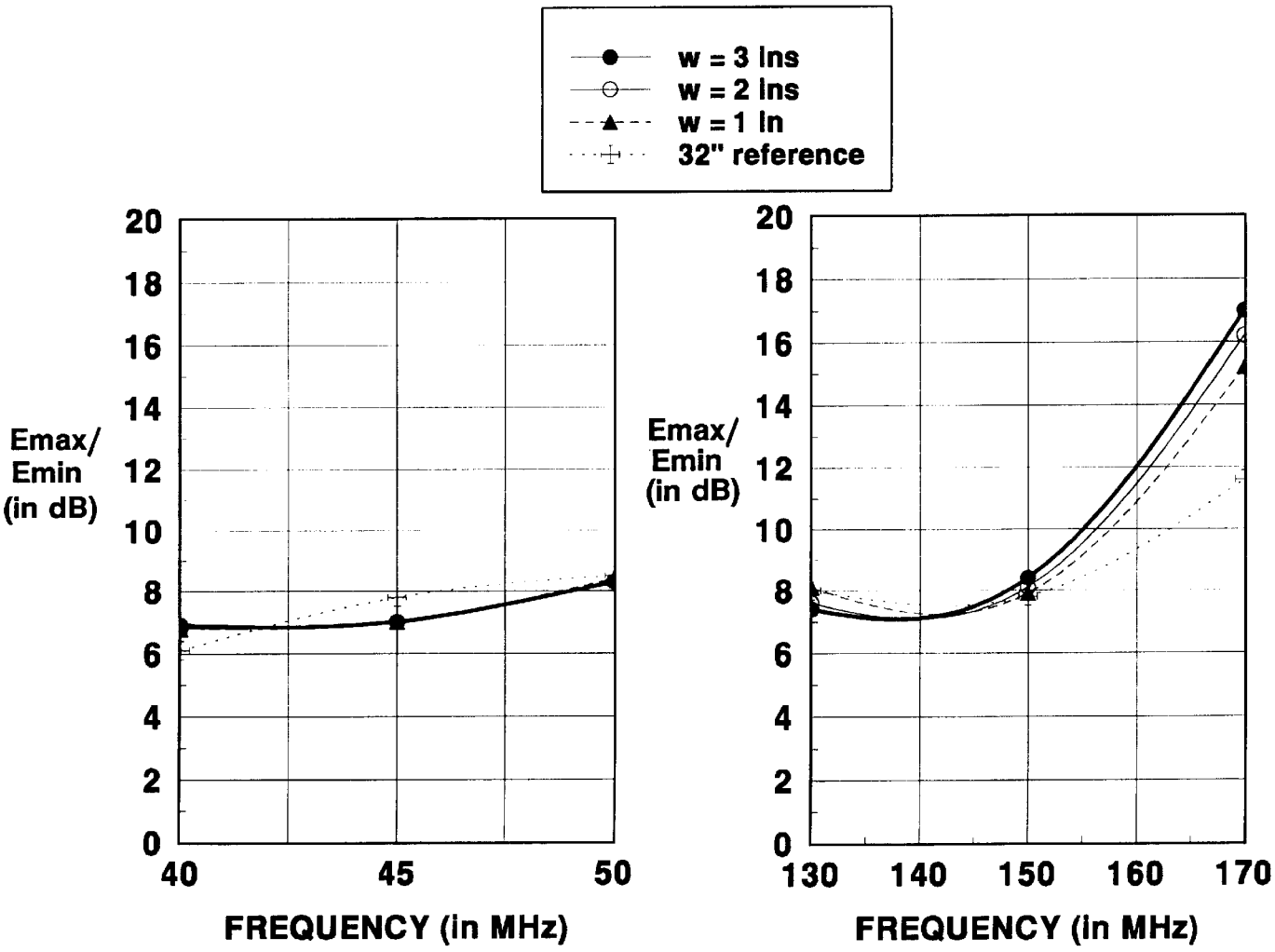
FIG. 29 shows azimuth pattern variation of two element conical monopole as a function of antenna element width.
Figure 30:
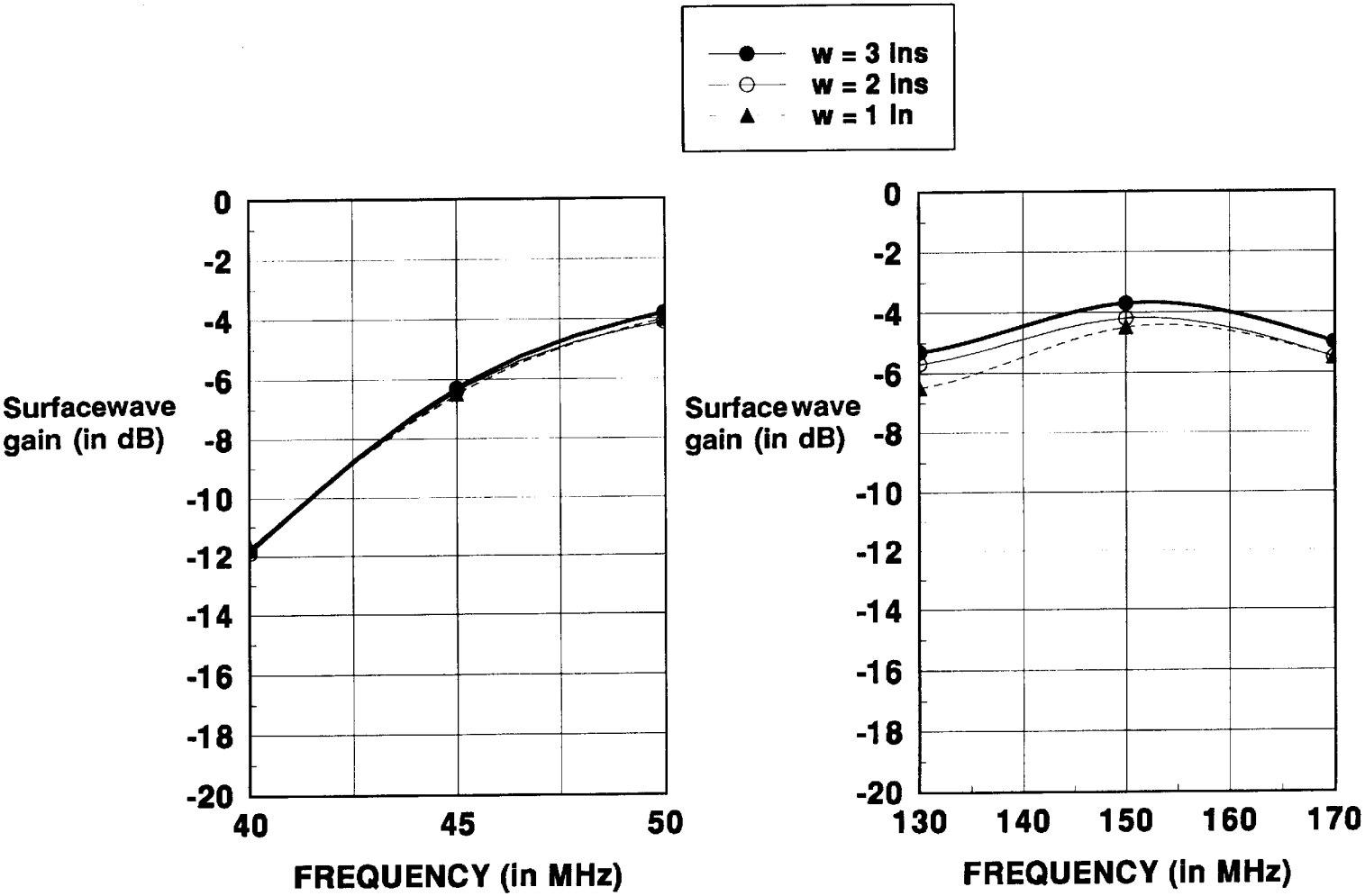
FIG. 30 shows surfacewave gain of two element conical monopole relative to 32" reference as a function of antenna element width.
Figure 31:
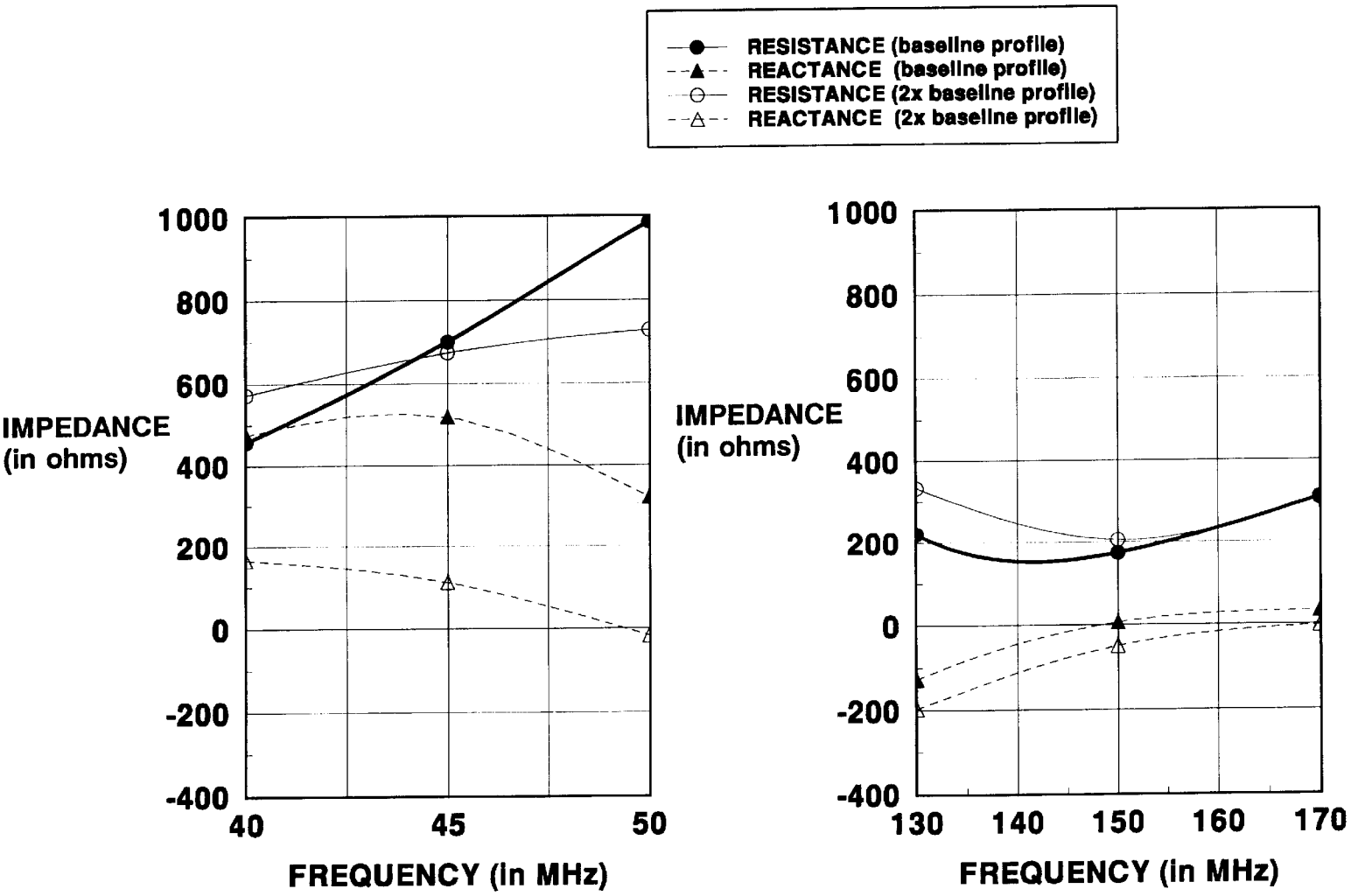
FIG. 31 shows input impedance of two element conical monopole as a function of antenna loading profile.
Figure 32:
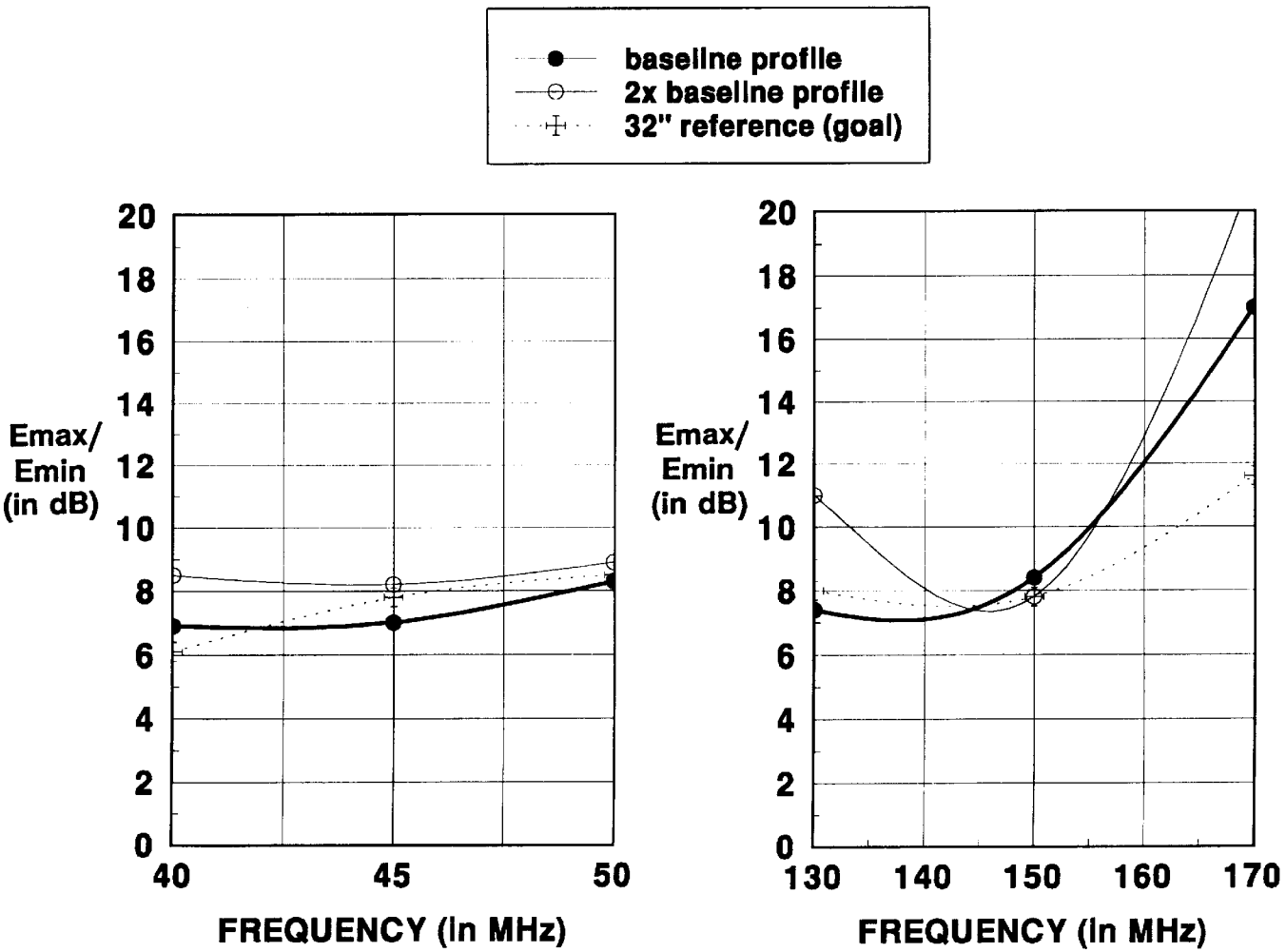
FIG. 32 shows azimuth pattern variation of two element conical monopole as a function of antenna loading profile.
Figure 33:
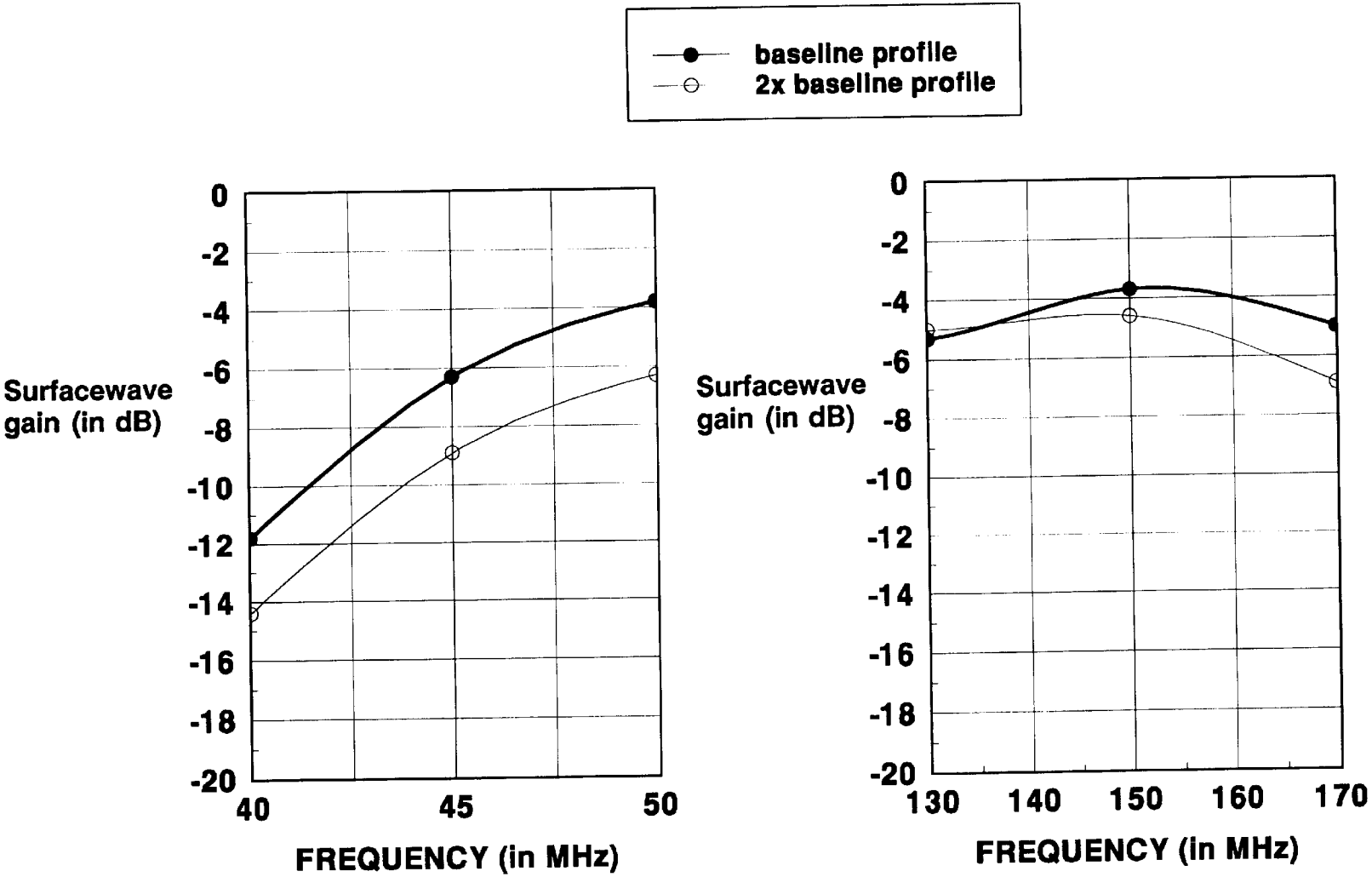
FIG. 33 shows surfacewave gain of two element conical monopole relative to 32" reference as a function of antenna loading profile.

For the antenna of FIG. 2, again three different strip widths were considered, and the baseline and twice the baseline loading profiles. The input impedance, pattern variation $E_{max}/E_{min}$ and surfacewave gain relative to the 32" reference antenna, are shown in FIGS. 22–24 as a function of strip width and in FIGS. 25–27 as a function of loading profile.

Similar results are given in FIGS. 28–30 and FIGS. 31–33 for the antenna of FIG. 4.

The following general behavior was observed for all three candidates: 1. Increasing the loading profile reduces the variation in input impedance with frequency. 2. The input impedance varies less with larger antenna element widths. 3. The variation in the azimuth surfacewave radiation patterns, $E_{max}/E_{min}$, does not change significantly with the width of the antenna element or with loading profile for the top-loaded and two-element monopoles. The maximum change in $E_{max}/E_{min}$ for these was <2 dB. The two-element conical antenna appears to be more sensitive to changes in the loading profile, but not to changes in element width.

Figure 34:
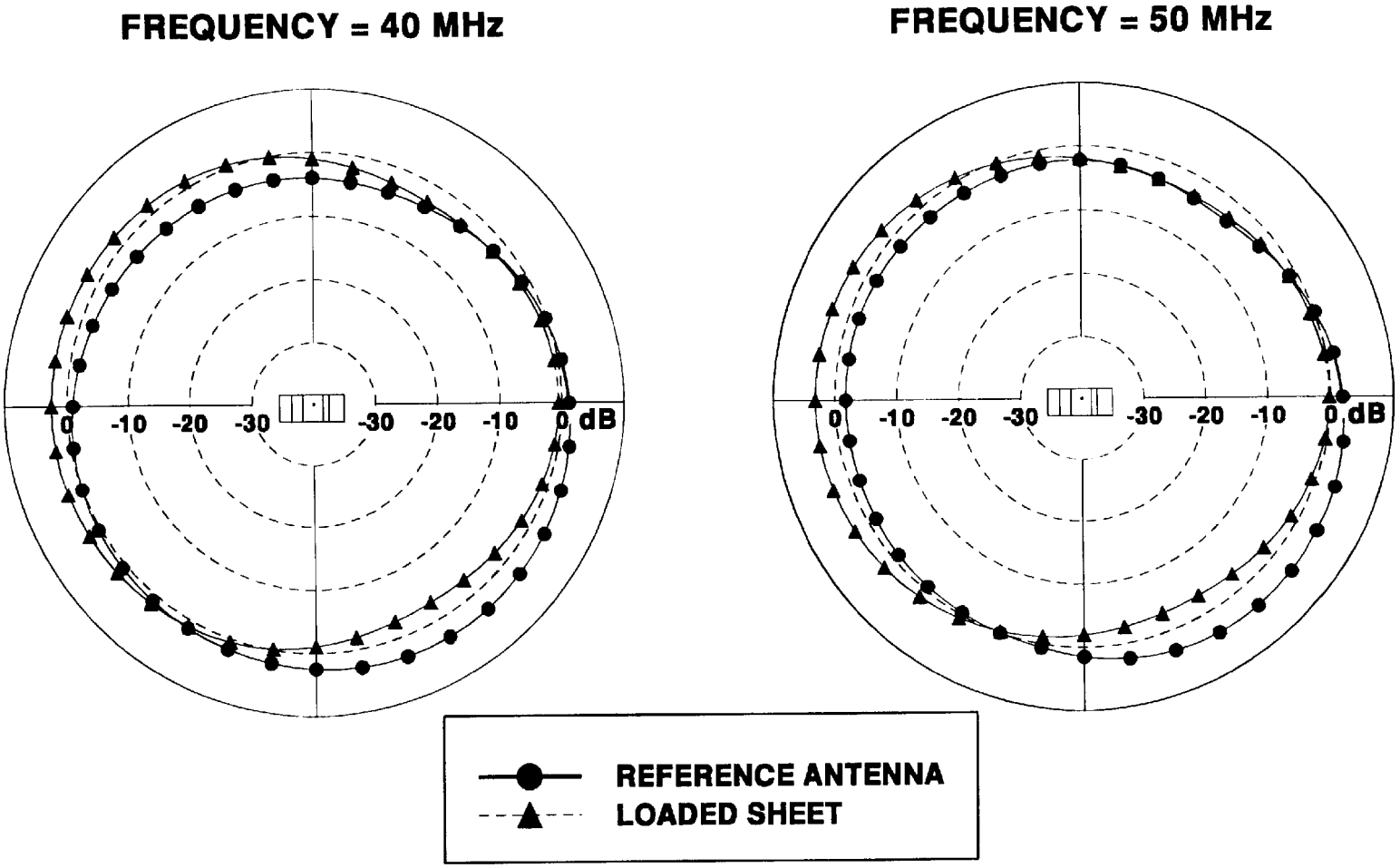
FIG. 34 shows computed azimuth surfacewave radiation patterns of rectangular sheet on-glass antenna.
Figure 35:
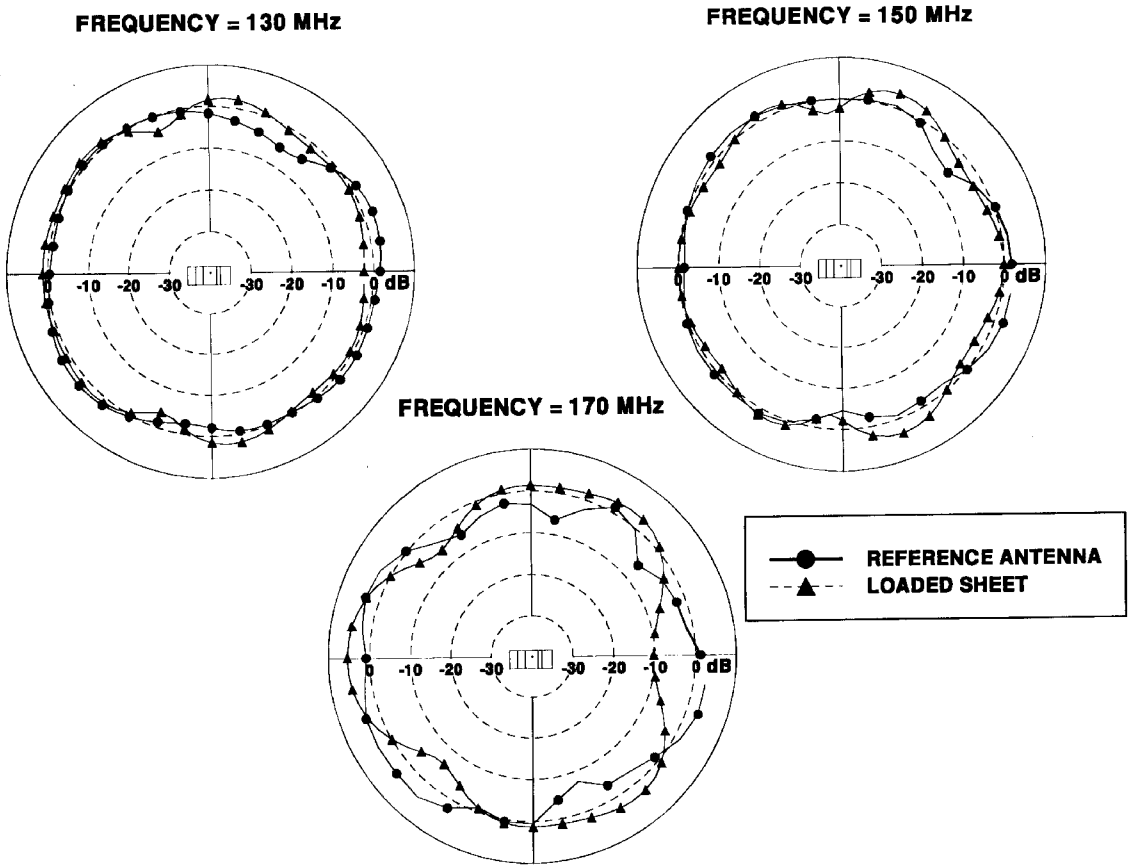
FIG. 35 shows computed azimuth surfacewave radiation patterns of rectangular sheet on-glass antenna.
Figure 36:
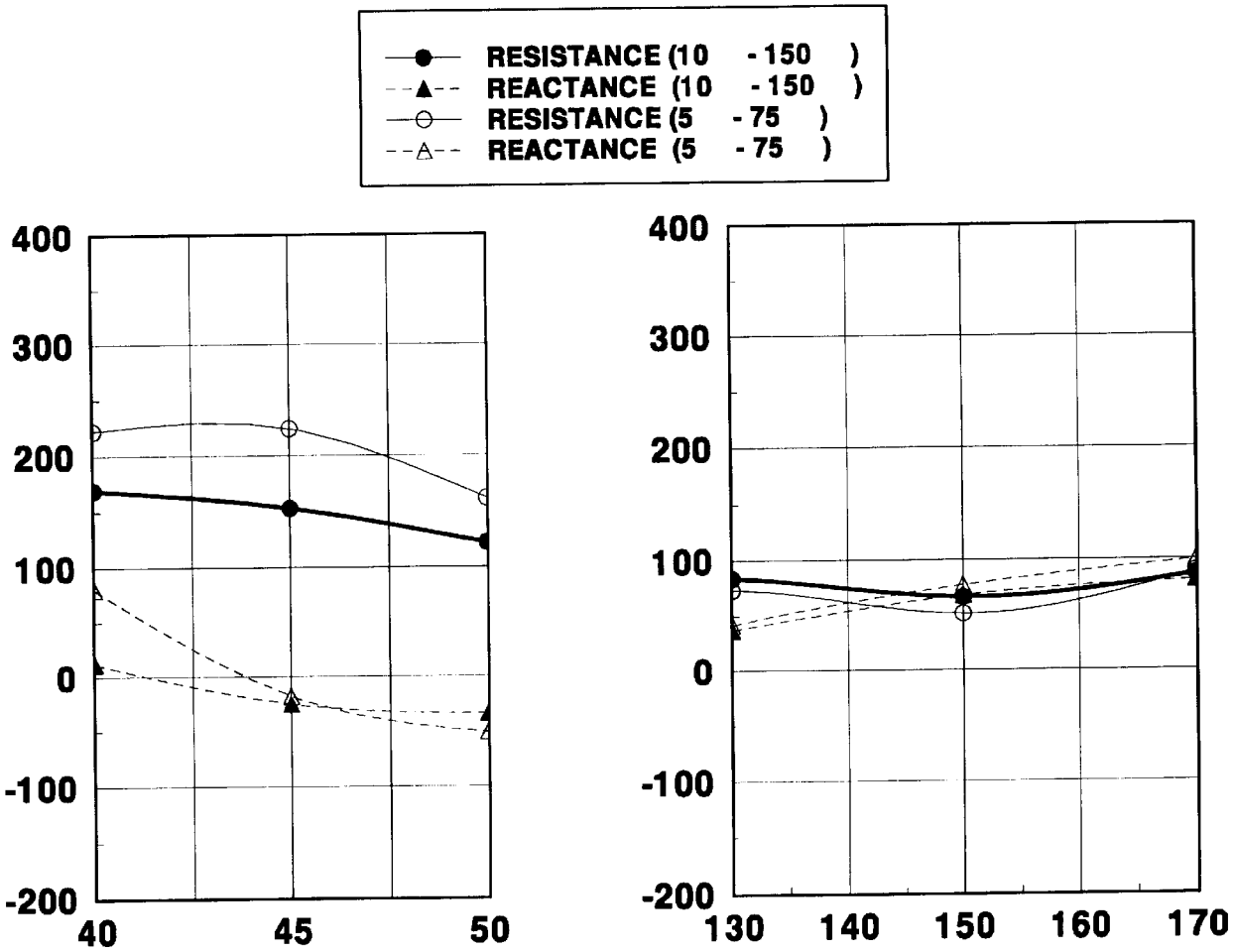
FIG. 36 shows input impedance of loaded rectangular sheets.
Figure 38:
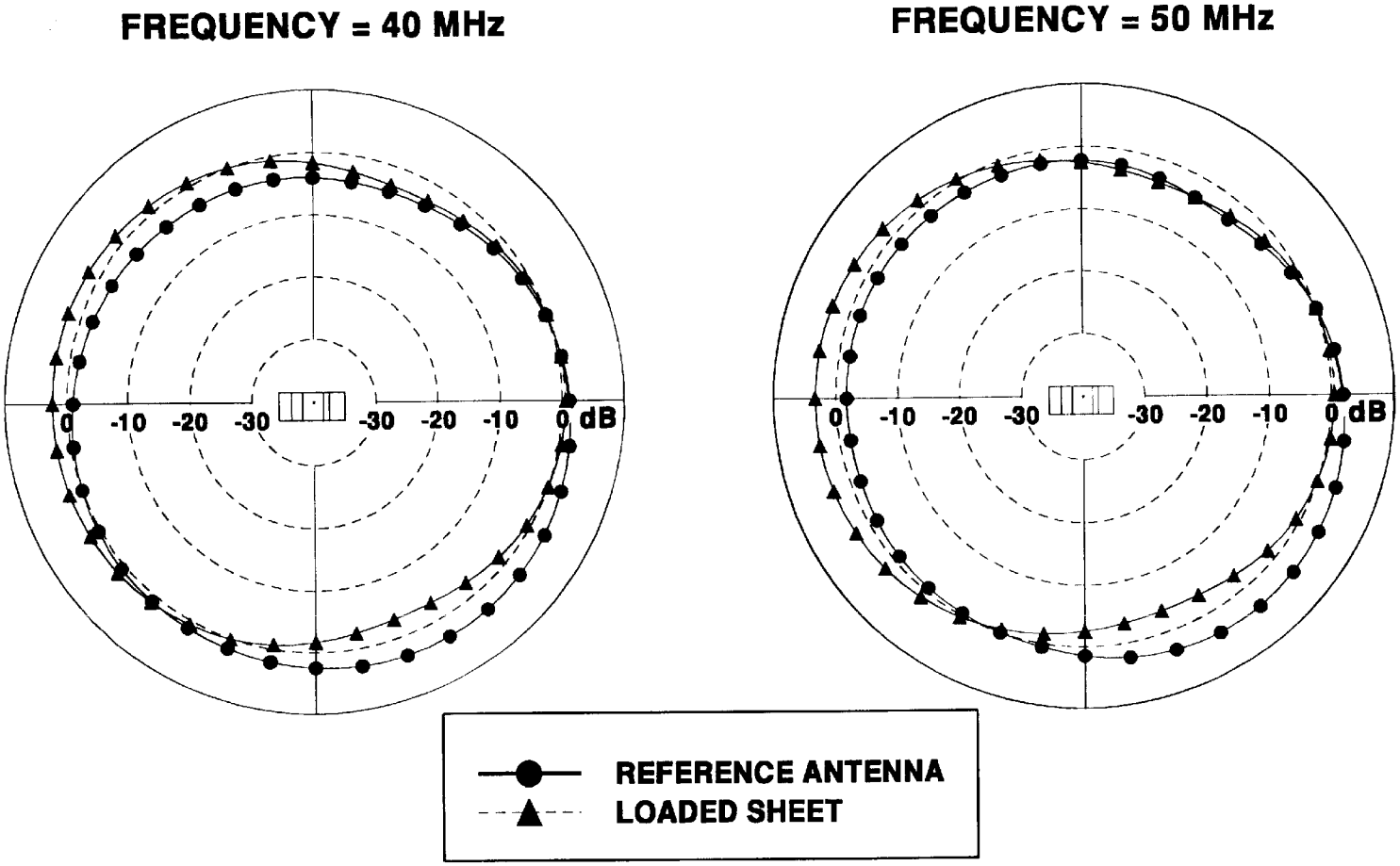
FIG. 38 shows computed azimuth surfacewave radiation patterns of conical sheet on-glass antenna.
Figure 39:
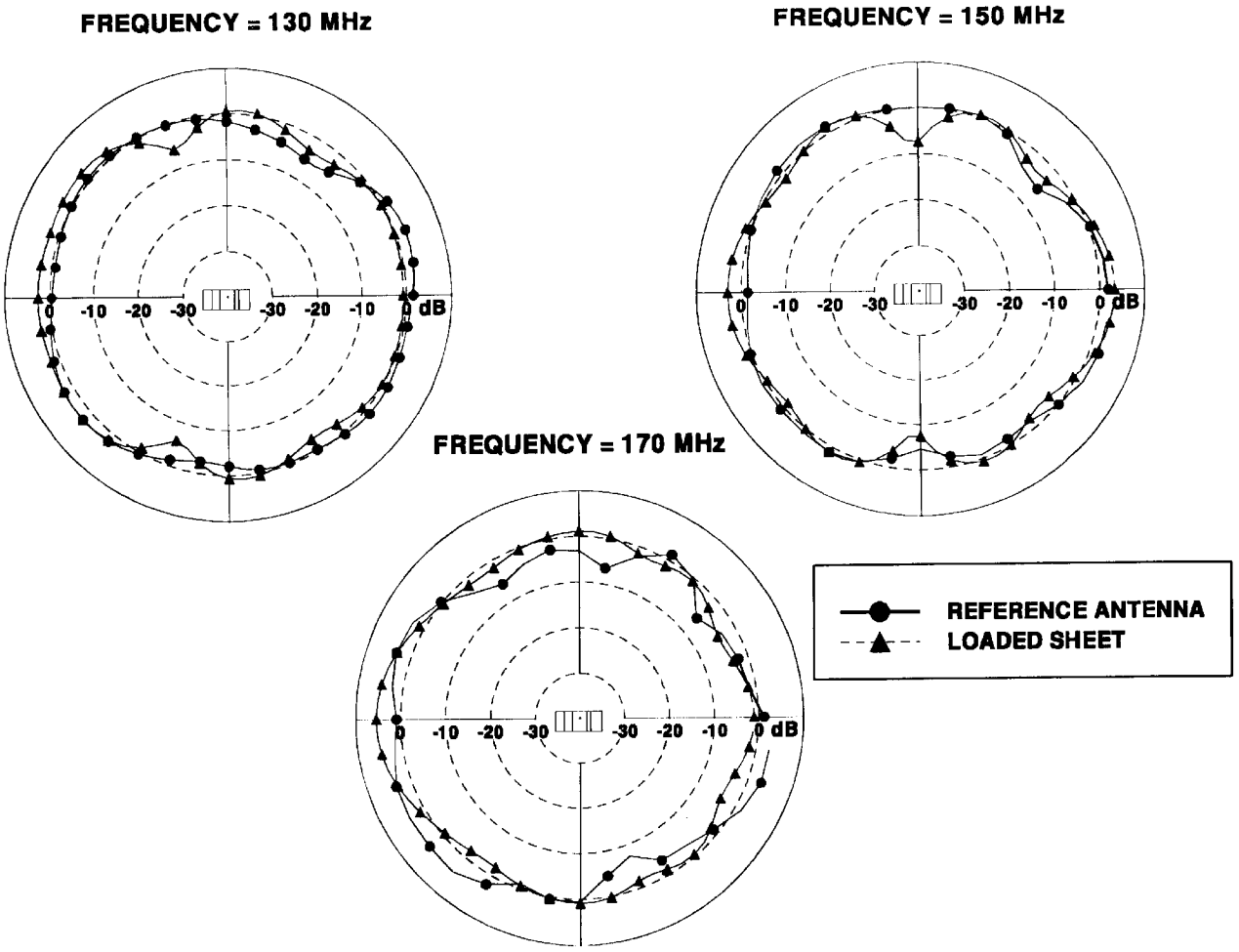
FIG. 39 shows computed azimuth surfacewave radiation patterns of conical sheet on-glass antenna.
Figure 40:
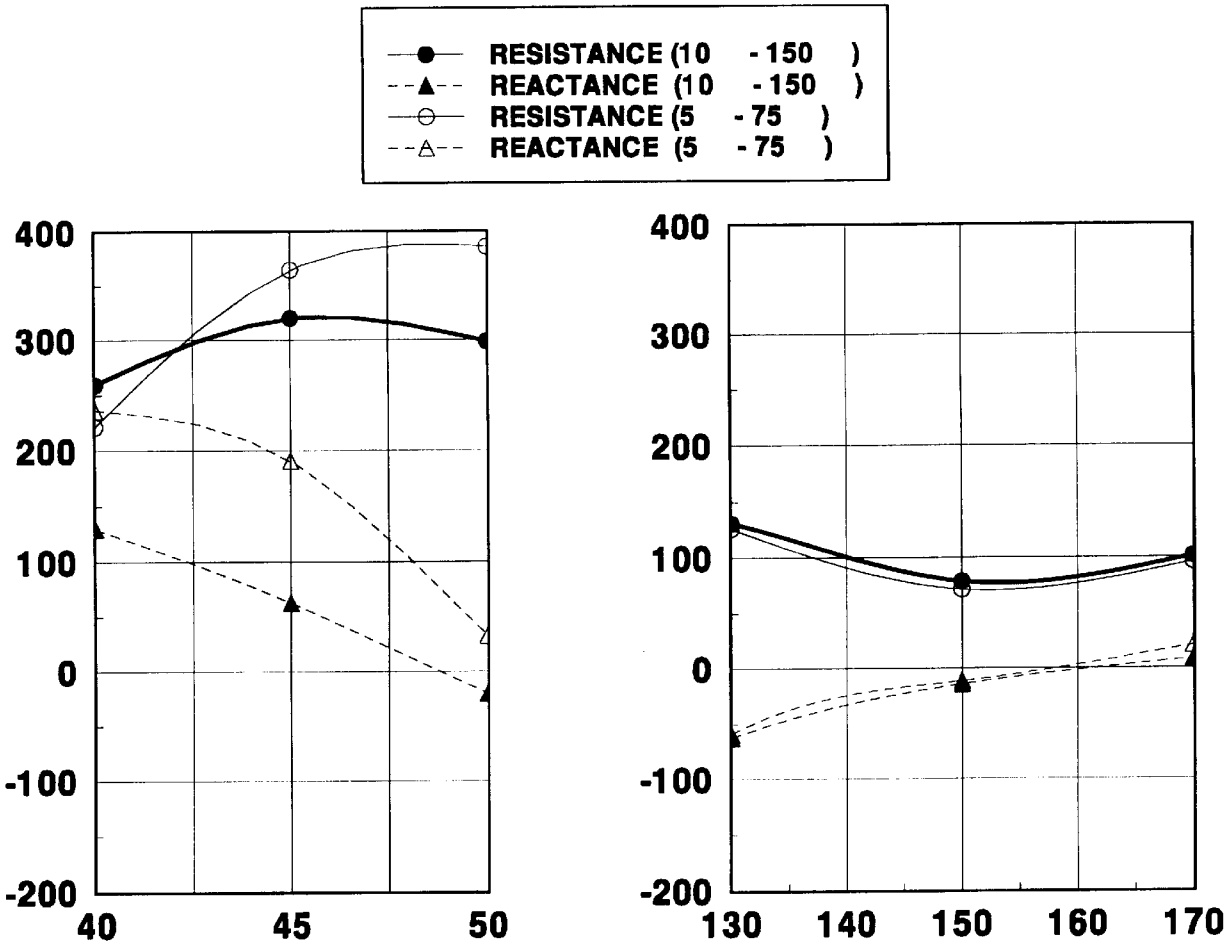
FIG. 40 shows input impedance of loaded conical sheets.

Impedance loaded rectangular and conical sheet antennas for on-glass mounting were also analyzed. The rectangular sheet was 1.2 meters wide and 0.8 meters high and had a surface impedance ranging from 10Ω/square at the lower edge to 150Ω/square at the upper edge. Results were also obtained with half these values, i.e., 5Ω/square to 75Ω/square. The radiation patterns at 40, 50, 130, 150 and 170 MHz are shown in FIGS. 34 and 35. The radiation patterns of the reference 32" whip are superimposed for comparison. Patterns are normalized in each case to an average value of 0 dB. The input impedance is shown in FIG. 36. Values of $E_{max}/E_{min}$ and surfacewave gain relative to the 32" reference antenna are given in FIG. 37. The conical sheet antenna was 1.2 meters wide at the top. The same profile values were used as for the rectangular sheet. The radiation patterns at 40, 50, 130, 150 and 170 MHz are shown in FIGS. 38 and 39. The radiation patterns of the reference 32" whip are again superimposed for comparison. The input impedance is shown in FIG. 40. Values of $E_{max}/E_{min}$ and average surfacewave gain relative to the 32" reference are given in FIG. 41. The results show an average surfacewave gain of −6.6 dB for both rectangular and conical sheets in the 40–50 MHz band and −5.9 dB and −5.1 dB in the 130–170 MHz band for the 5 to 75Ω/square loading profile.

The azimuth radiation patterns of both rectangular and conical sheets are omnidirectional within ±3.5 dB in the 40 to 50 MHz band. The omnidirectionality obtained with the rectangular sheet is better at all frequencies than the reference antenna.

Measurements have been done on two lumped-constant brassboard prototypes of on-glass broadband antennas (loaded single and two-element vertical monopoles, FIGS. 1 and 2) mounted on the Taurus windshield. Included were measurements of the effectiveness of three grounding schemes: direct connection to the car structure at the top and bottom of the windshield; through-the-paint capacitive pads; and a self-grounding system consisting of two horizontal on-glass conducting counterpoise strips.

Detailed measurements of the vertical two-element, on glass, resistively loaded brassboard antenna fed against two on-glass (top and bottom) metallic counterpoise strips were made on the Taurus including: impedance and VSWR; sensitivity to detuning by windshield wipers and front seat passengers; surfacewave azimuthal radiation patterns for both the loaded brassboard antenna and reference metallic whips; and relative broadband response to signals-of-opportunity of the loaded on-glass brassboard antenna system compared to reference antennas.

The resistively loaded broadband dipoles were much less sensitive to the metallized film in the windshield compared to conducting dipoles.

Figure 42A:
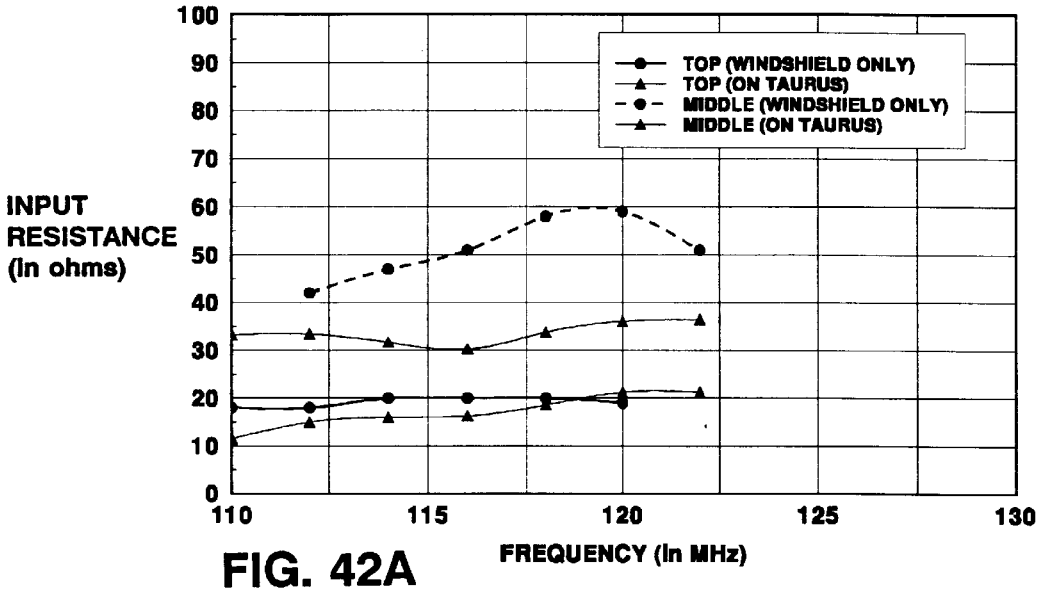
FIG. 42 shows the effect of windshield and car on input impedance of conducting on-glass dipole.
Figure 42B:
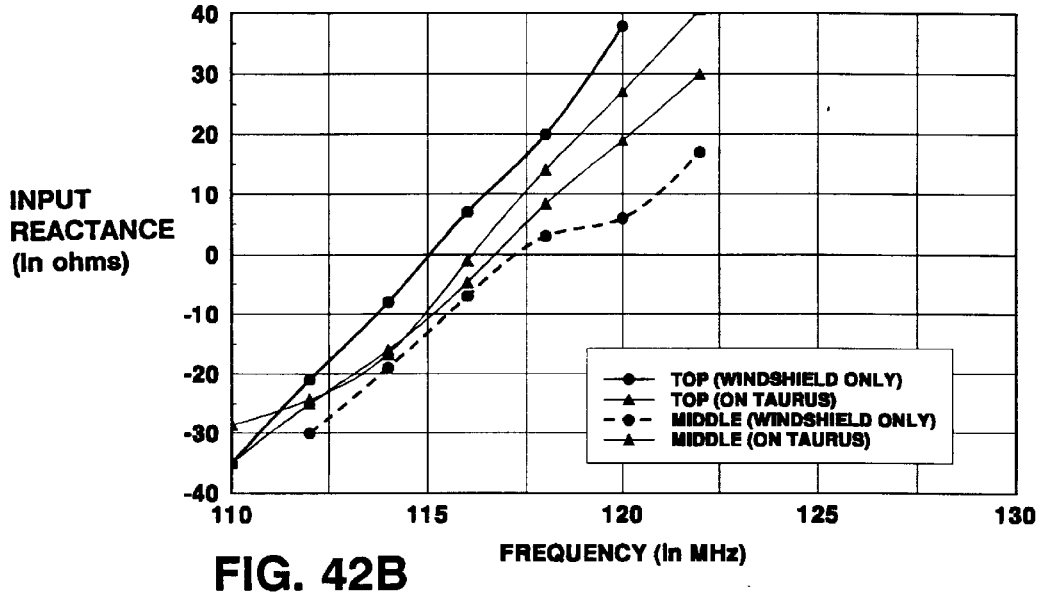

FIG. 42 compares the complex impedance of the conducting dipole at the top and in the center of an isolated windshield and on the windshield on a Ford Taurus. There is significant detuning evident between free space and an isolated windshield but only slight additional detuning when the windshield was on the Taurus. This indicates that the first order effect on the antenna impedance is due to the heavy metallization within the windshield rather than the metal structure of the car. The windshield wipers, when operated, changed the impedance of the conducting dipole by approximately 59%, but no measurable change was observed with a left or right front seat passenger.

Figure 43A:
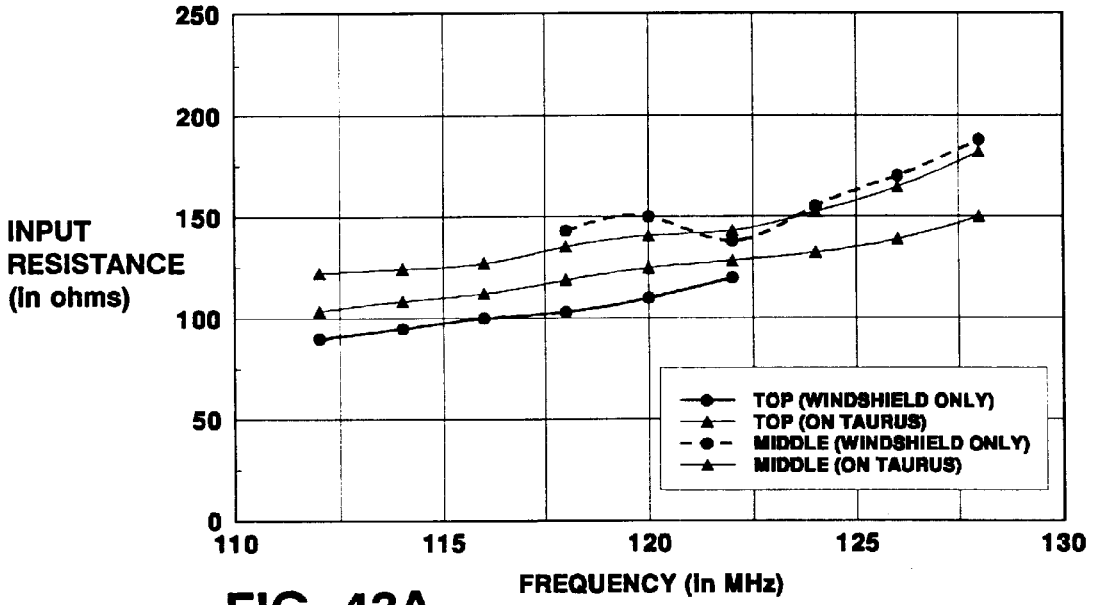
FIG. 43 shows the effect of windshield and car on input impedance of loaded dipole 1.
Figure 43B:
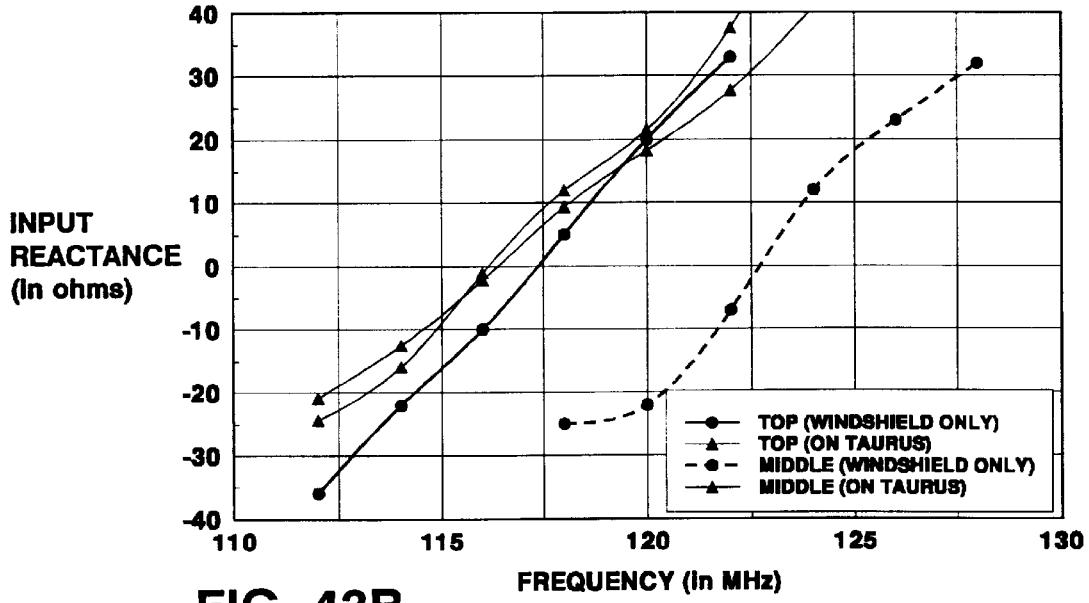
Figure 44A:
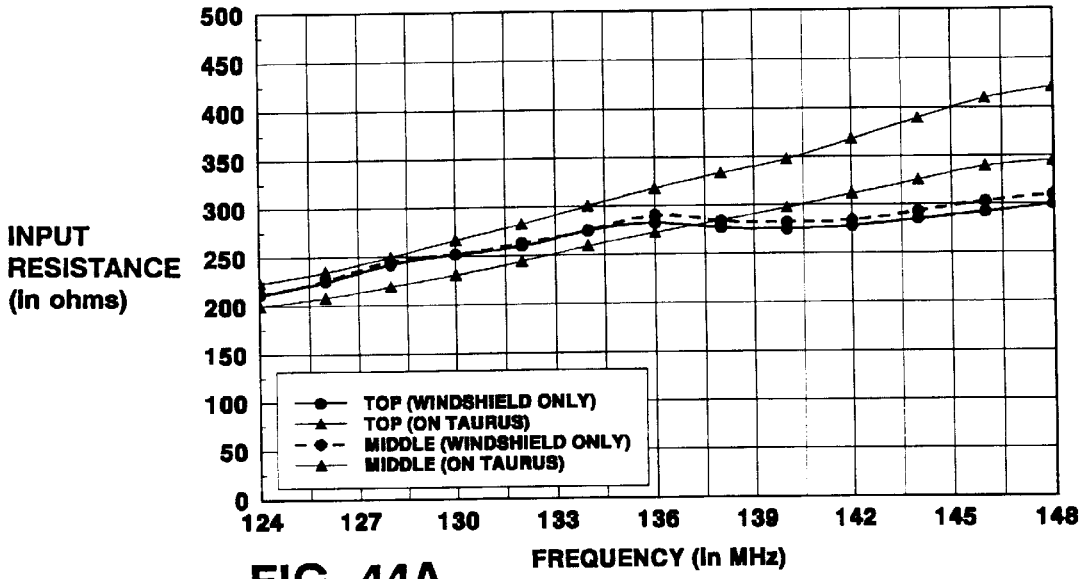
FIG. 44 shows the effect of windshield and car on input impedance of loaded dipole 2.
Figure 44B:
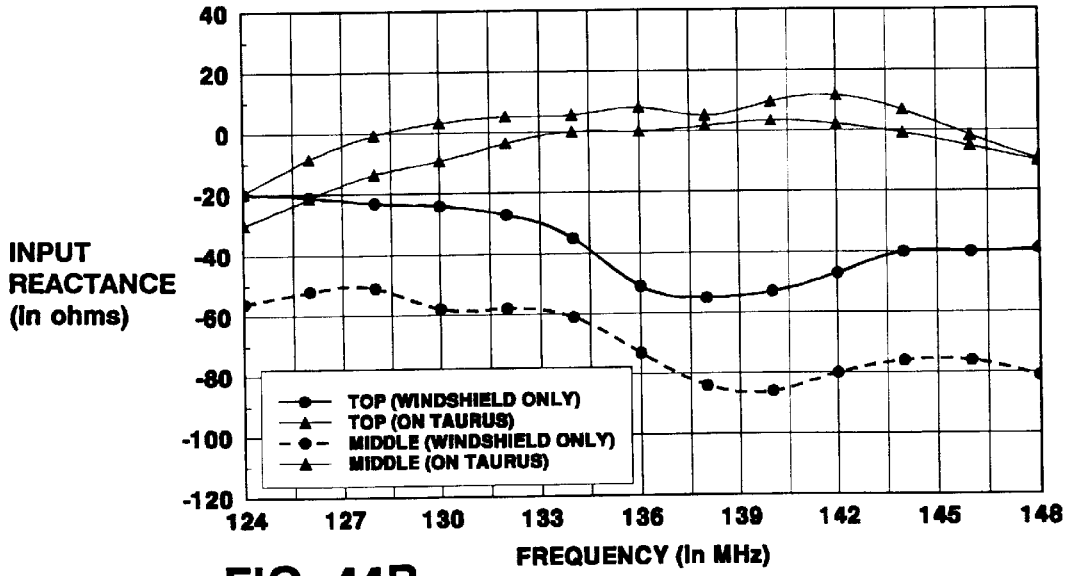
Figure 45:
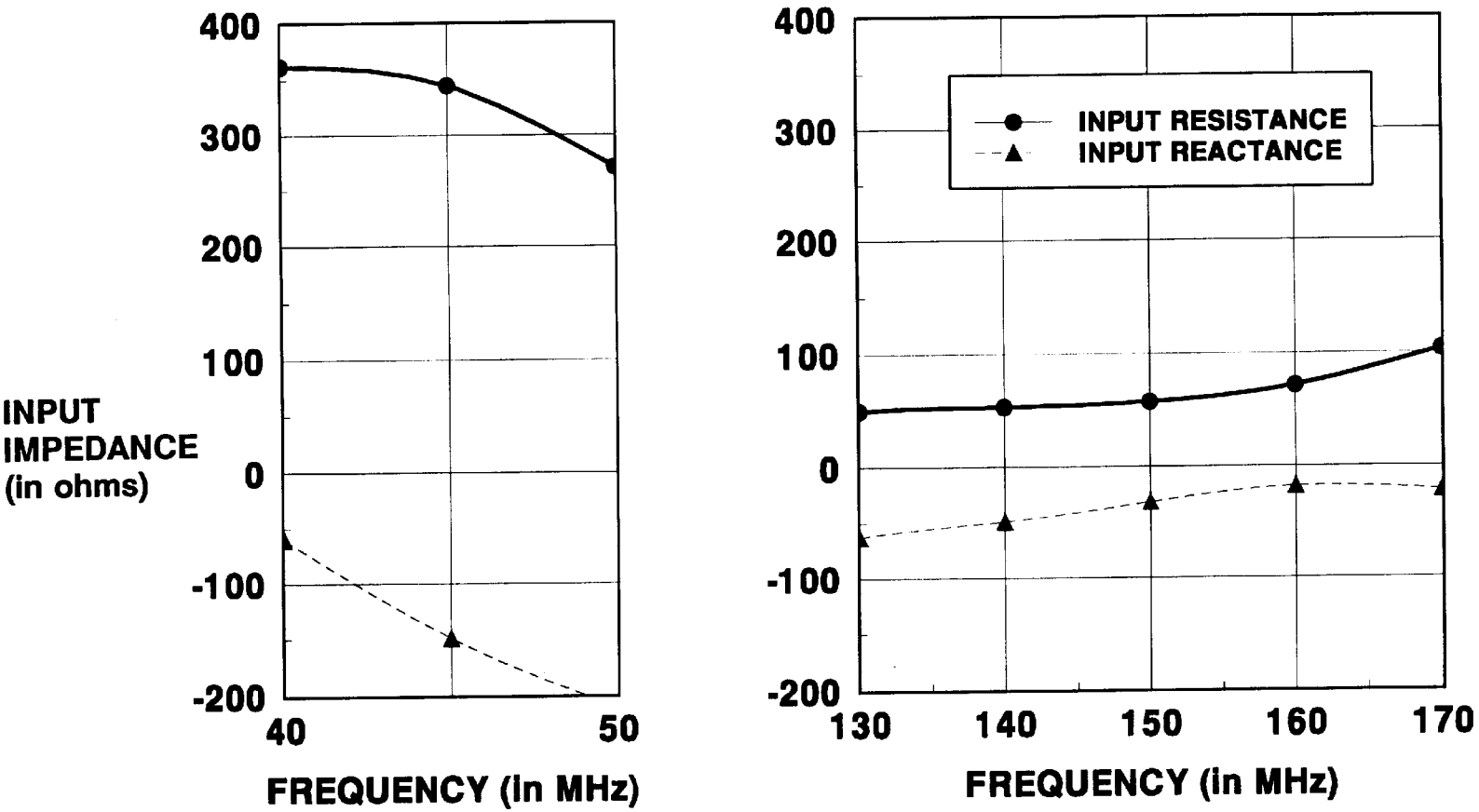
FIG. 45 shows the measured input impedance of single element vertical monopole on Ford Taurus using through-the-paint capacitive grounding.
Figure 46:
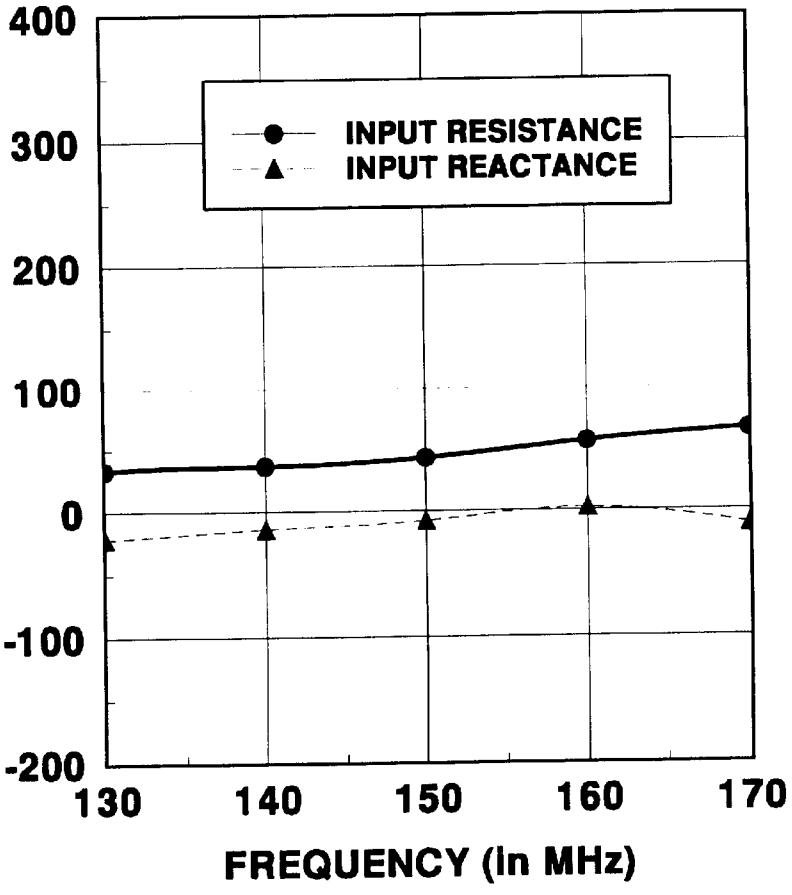
FIG. 46 shows the measured input impedance of two-element vertical monopole on Ford Taurus using through-the-paint capacitive grounding.
Figure 46:
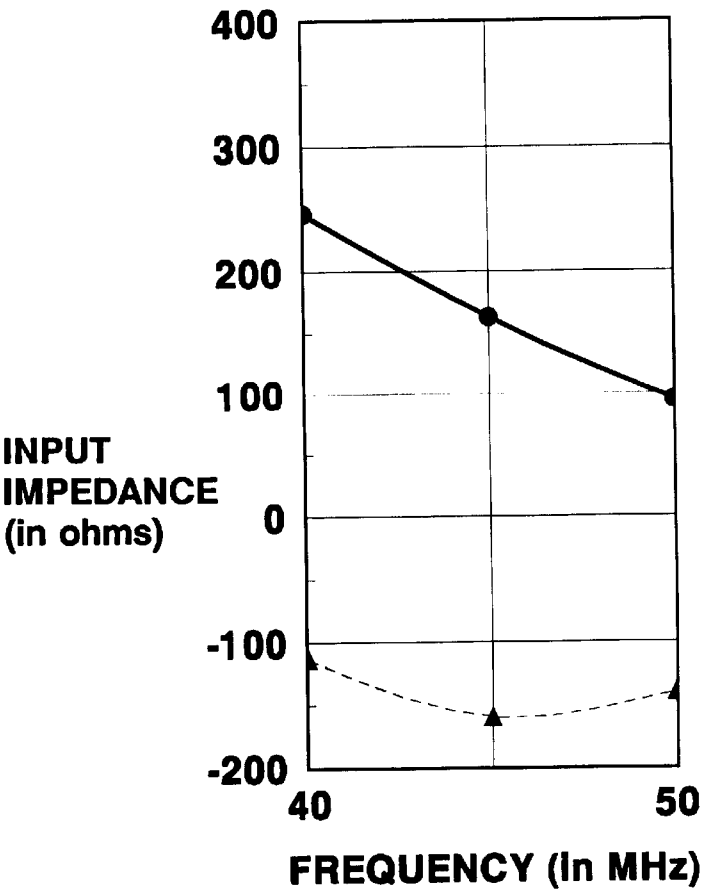
Figure 47:
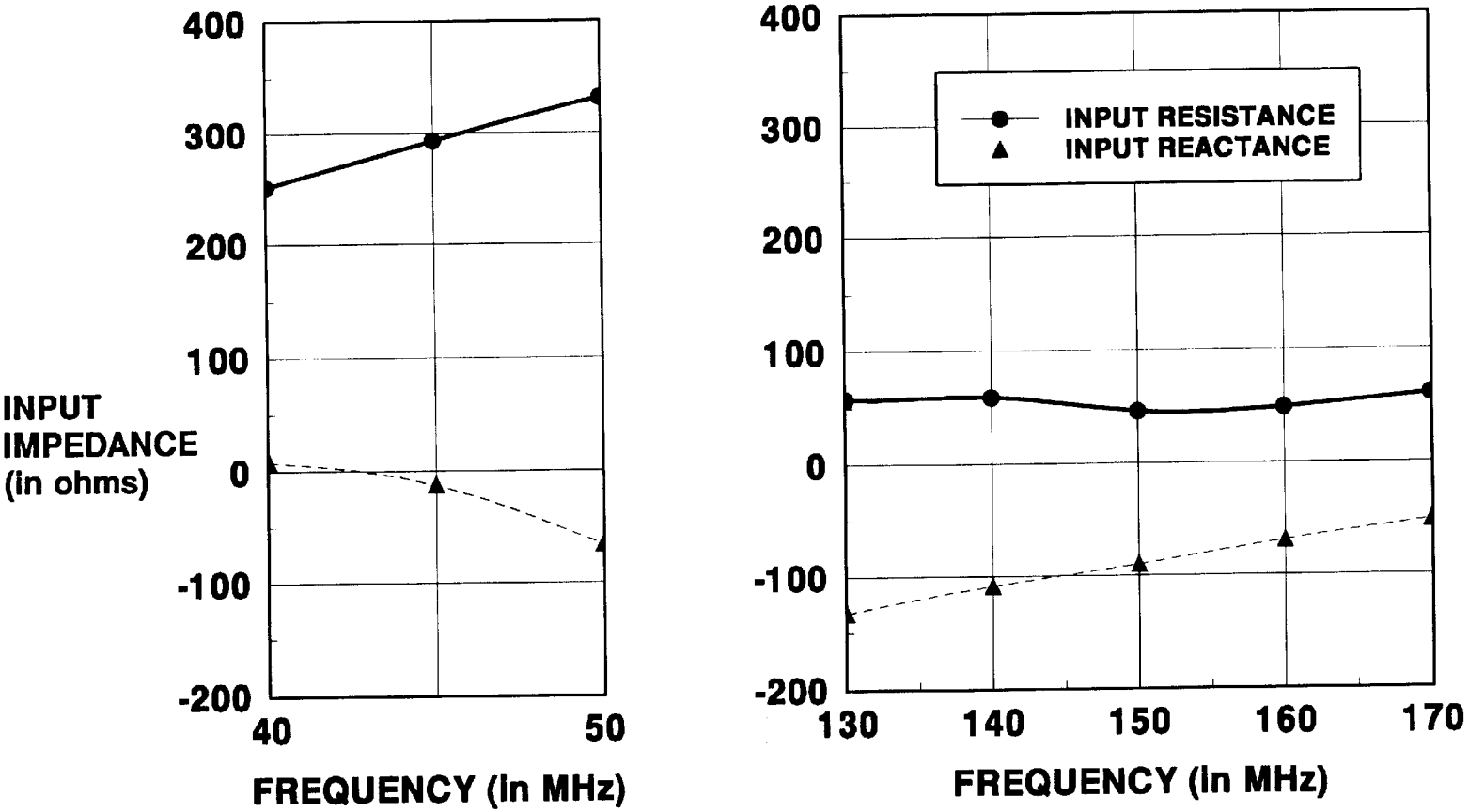
FIG. 47 shows the measured input impedance of single element vertical monopole on Ford Taurus using a self-grounding system.
Figure 48:
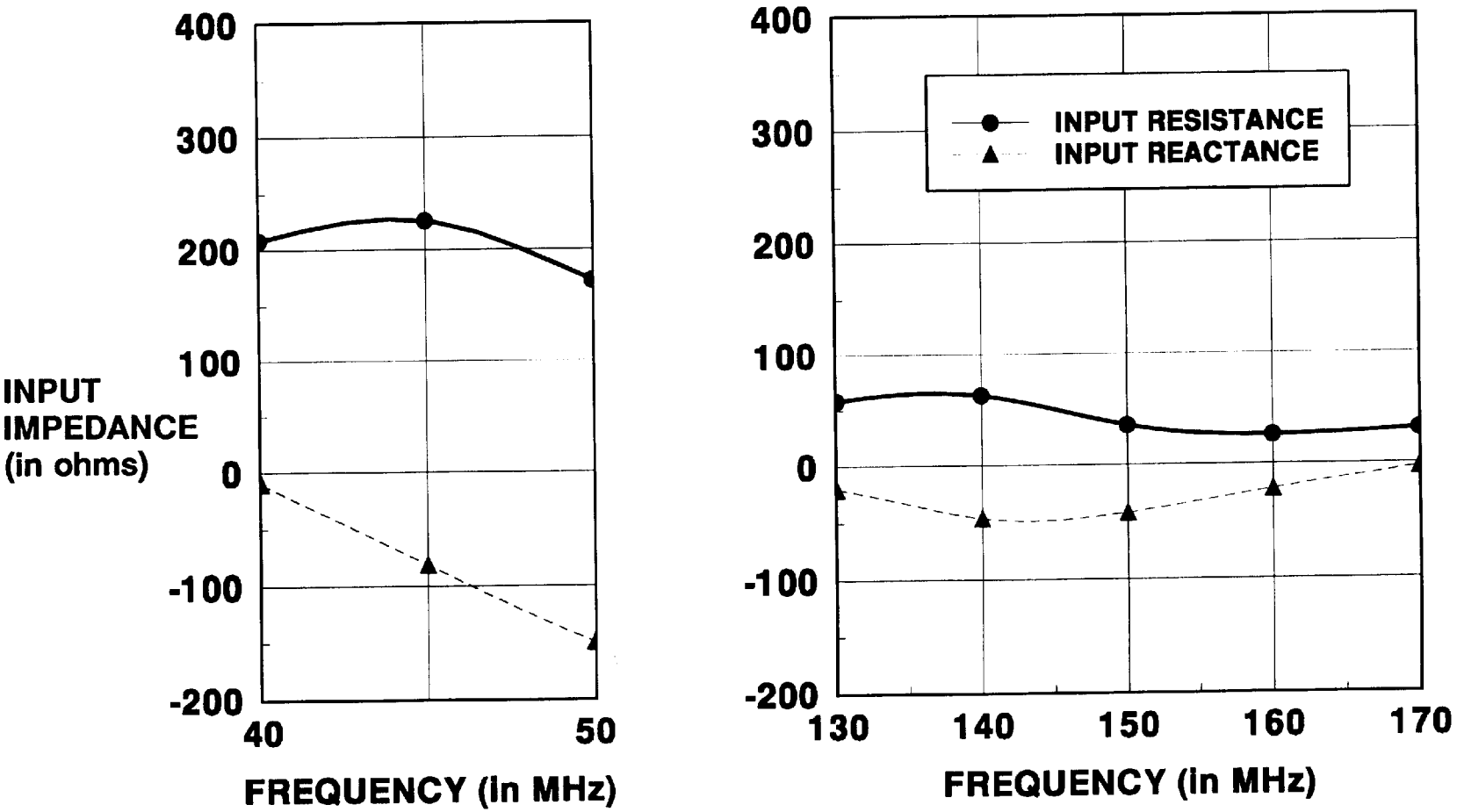
FIG. 48 shows the measured input impedance of two-element vertical monopole on Ford Taurus using self-grounding system.

FIGS. 43 and 44 compare the measured complex impedances for the two resistively loaded dipoles at the top and in the center of an isolated metallized windshield and finally on a metallized windshield on a Ford Taurus. These figures show that the input impedance of loaded dipole #1 is not affected as much by the windshield glass as that of the conducting dipole and that loaded dipole #2 is not significantly affected by the windshield. These figures also show that the real component (resistance) of impedance of both loaded dipoles was only slightly shifted when they were mounted on the Taurus' windshield compared to when on an isolated windshield. It can be seen that the imaginary component (reactance) of impedance was more affected than the resistance when the dipoles were mounted on the Taurus' windshield compared with the isolated windshield case. From an antenna system design viewpoint the measured changes can be considered small. The windshield wipers changed the impedance of loaded dipole #1 by approximately 23% and loaded dipole #2 by less than 10%. No change in either dipole's impedance was measured with front seat passengers.

The bottom (feed point) and top grounding to the car's metal structure achieve a more uniform azimuthal radiation pattern and improved efficiency. Initial impedance measurements were made for brassboard (lumped-constant) versions of two antenna candidates (loaded single and two-element monopoles) by grounding their tops to the roof just above the Taurus' windshield using 1.5" of 1/16" wide copper braid. The impedance of this length of braid varied from approximately 5 to 21 ohms between 40 and 170 MHz. The bottom ground connection was via 12.5" of ½" wide copper strap connected to a large bolt on the Taurus firewall. This length of braid exhibited significant impedance: 46 ohms at 40 MHz, increasing to 1,479 ohms at 170 MHz. Using the above described ground connection, which represents the nearest accessible ground point to the bottom center of the windshield, the feed-point impedance for the two antennas was measured. Neither impedance resembled those predicted due to the high series impedance of the bottom ground strap, which was especially significant in the 130 to 170 MHz band.

Two other ground schemes were tested. One scheme was through-the-paint capacitive grounding using 3"×3" thin pads of copper tape at the top and bottom of the antenna. The second ground scheme used horizontal on-glass 3" wide copper strips 49. The latter scheme is operationally more attractive than the former since: it can be implemented using the same manufacturing techniques proposed for the antenna element; and the entire antenna and ground system is confined to the windshield and requires no direct connection to the car chassis. FIGS. 45 to 48 show the measured complex impedance of the loaded single and two-element monopoles using the alternative grounding methods.

Figure 49:
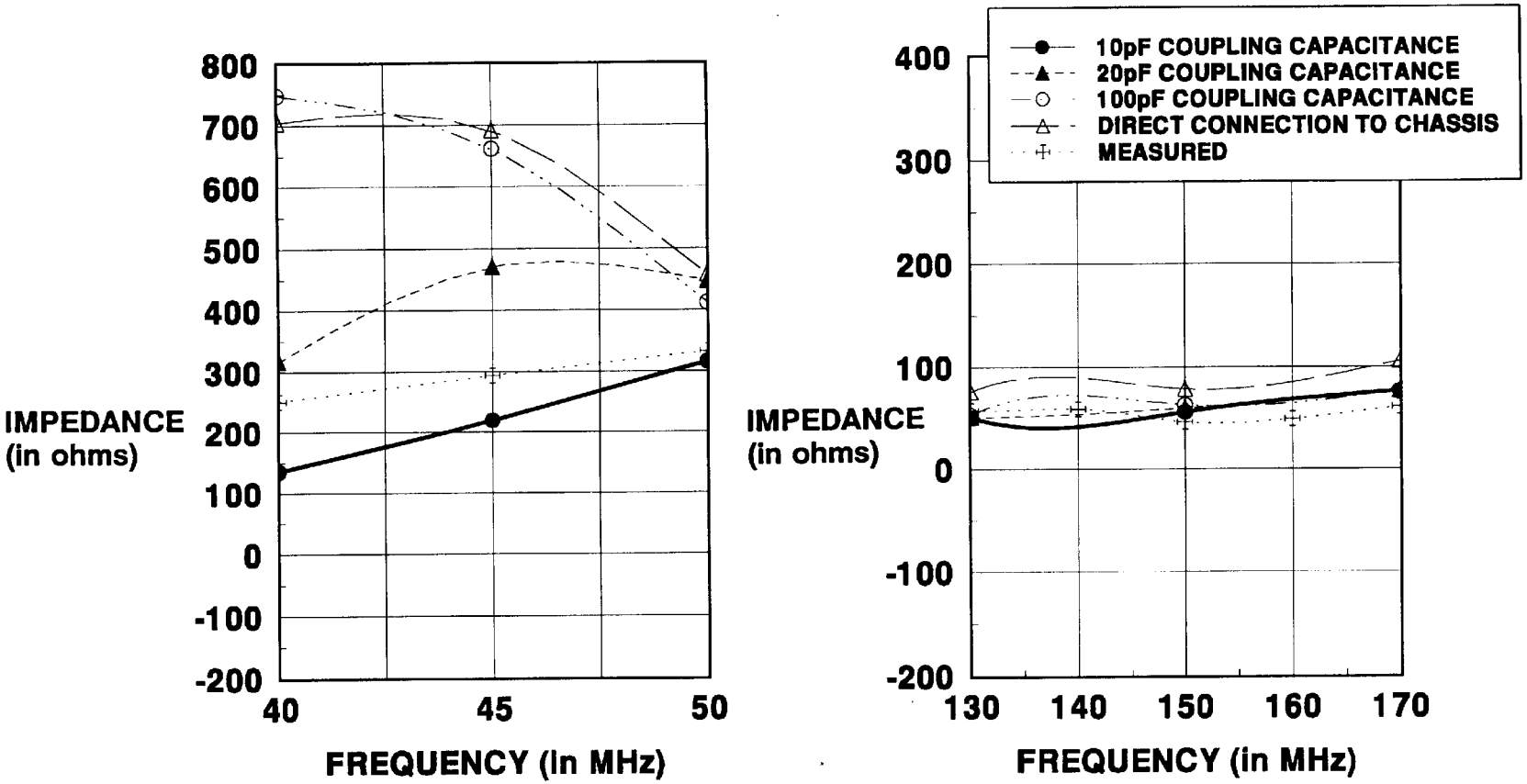
FIG. 49 shows a comparison of measured resistance of two-element on-glass antenna with NEC computations as a function of coupling capacitance to the car chassis.
Figure 50:
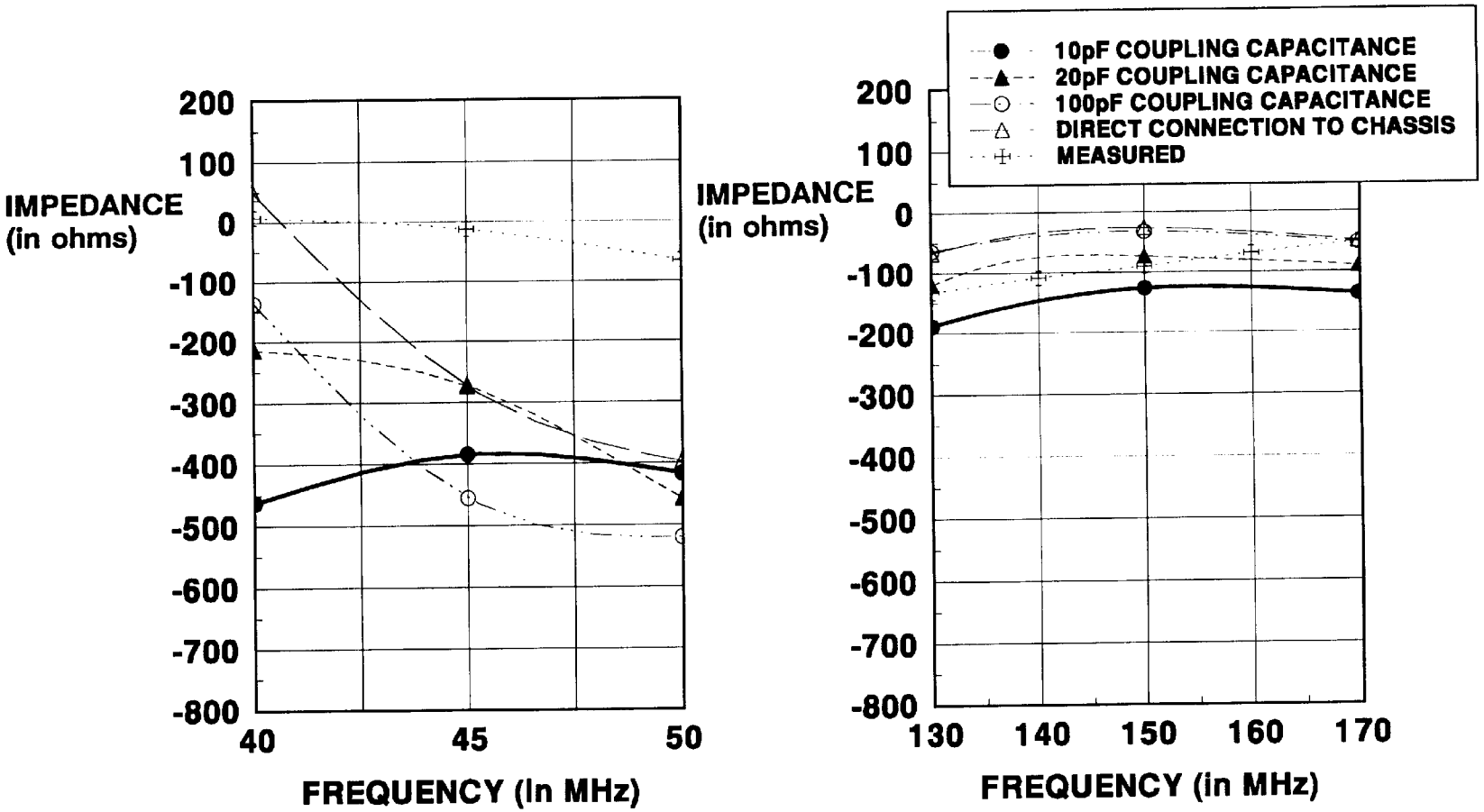
FIG. 50 shows a comparison of measured reactance of two-element on-glass antenna with NEC computations as a function of coupling capacitance to the car chassis.

The measured resistance and reactance of the two-element monopole with the self-grounding system are compared to the calculated values from NEC in FIGS. 49 and 50. Since the self-grounding system is capacitively coupled to the vehicle, NEC results for this configuration were obtained as a function of the value of the capacitive coupling between the antenna and the roof and chassis of the car. In the 40–50 MHz band, the measured resistance, shown in FIG. 49, corresponds to a capacitive coupling between the antenna and car chassis of between 10 and 20 pF. The input resistance for this band decreases as the antenna is decoupled from the car structure. In the 130–170 MHz band, there is a smaller spread of resistance values with capacitive coupling as would be expected, since the equivalent reactance of the coupling capacitor is less significant at these frequencies. The measured and computed antenna input reactance shown in FIG. 50, shows less agreement in the 40–50 MHz band. This is, however, of no consequence to the overall system design since the measured data indicates a very low input reactance. Excellent agreement between measured and computed data is observed. In the 130–170 MHz band, excellent agreement between measured and computed data is again observed.

Figure 58:
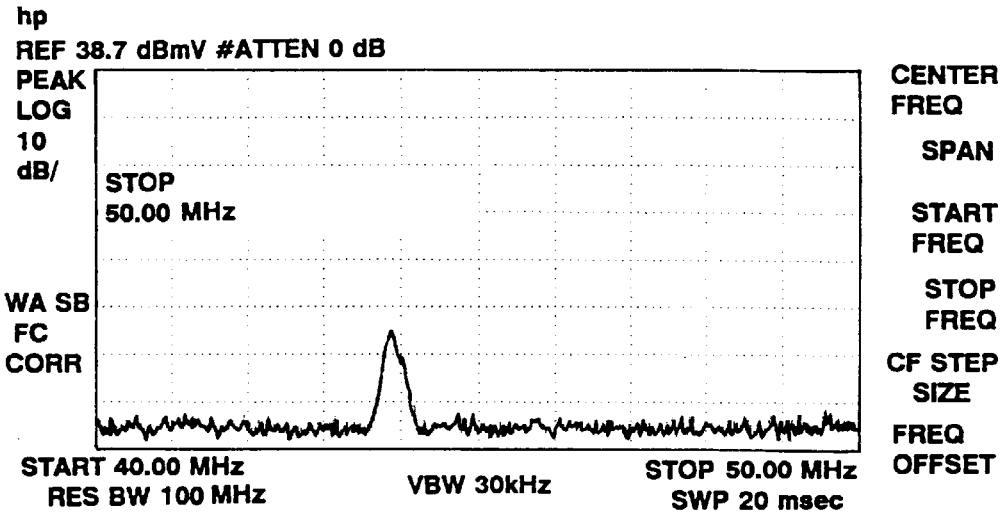
FIG. 58 shows a comparison of measured signals-of-opportunity in the 40–50 MHz band using brassboard antenna with 4:1 transformer and 32" reference whip.
Figure 58:
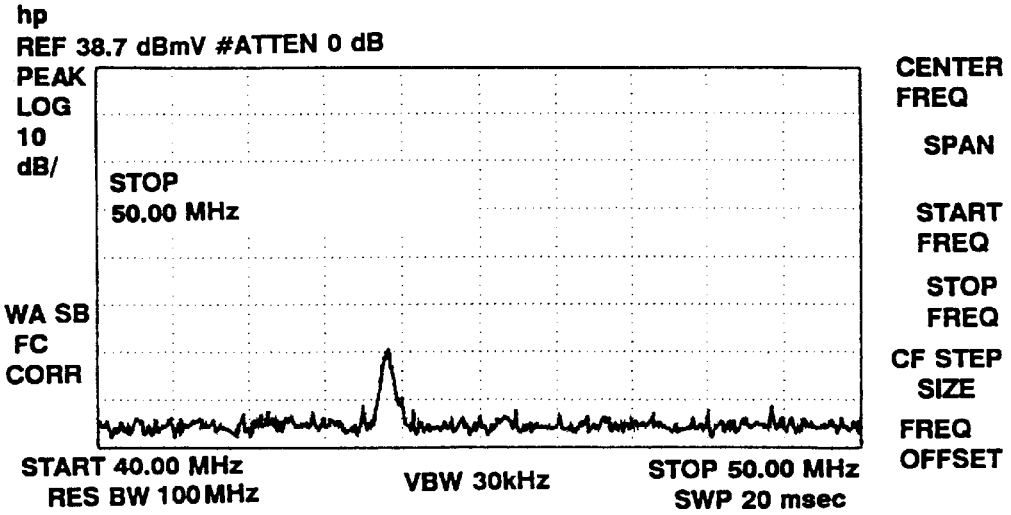
Figure 59:
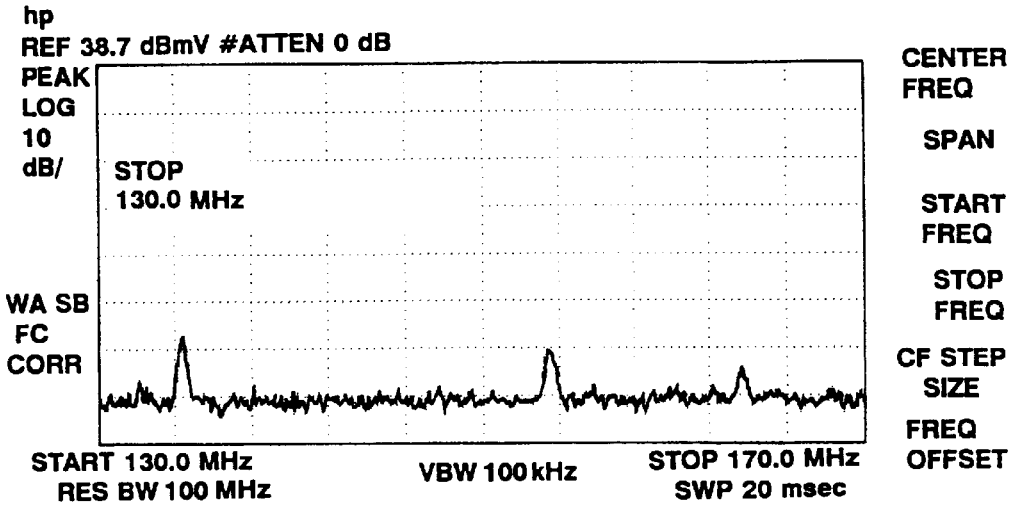
FIG. 59 shows a comparison of measured signals-of-opportunity in the 130–170 MHz band using brassboard antenna (no transformer) and 20" reference whip.
Figure 59:
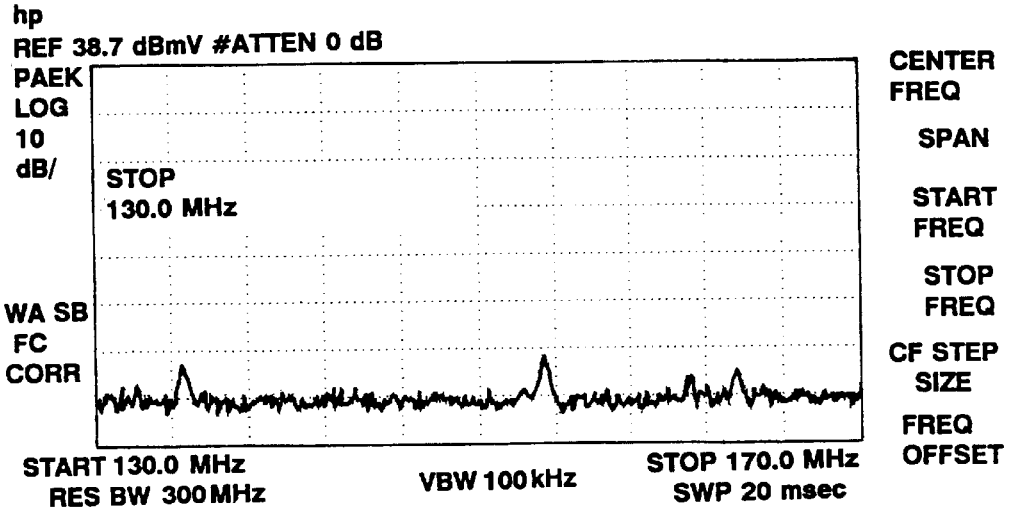

The brassboard on-glass antenna system, using the two-element loaded monopole with the self-grounding configuration (on-glass top and bottom horizontal counterpoise strips) was installed on the 1994 Ford Taurus' windshield as shown in FIG. 44 and the following measurements made: Impedance and VSWR (FIG. 51) using a stepdown transformer; impedance and VSWR without any stepdown transformer in the 130–170 MHz band (FIG. 52); impedance of a 32" magnetic mount reference whip, placed adjacent to the Taurus' broadcast whip's mount in the 40–50 MHz band (FIG. 53); normalized azimuthal surfacewave radiation patterns for the reference whips and loaded on-glass antenna, made at a radius of 24' and 6' above ground level from the Taurus (FIGS. 54, 55 and FIGS. 56, 57); spectrum analyzer plots of signals-of-opportunity for the 40–50 and 130–170 MHz bands when alternately connected to the 32 and 20" reference whips and broadband two-element, on-glass brassboard antenna (FIGS. 58–59).

An analysis of the above measured data leads to the following conclusions.

Figure 51:
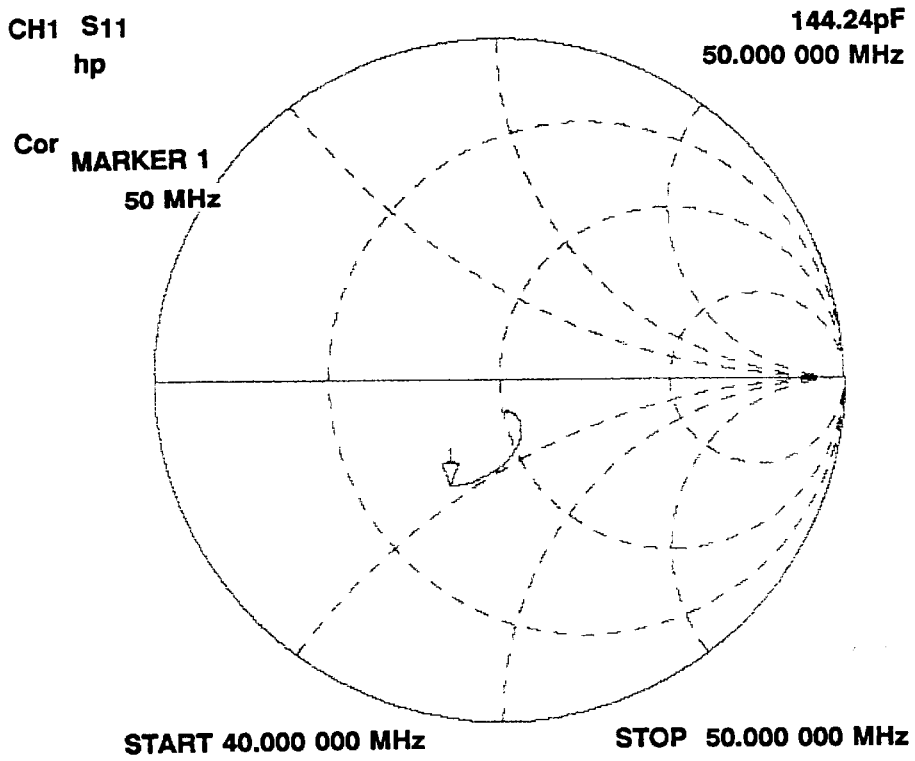
FIG. 51 shows a measured input impedance and VSWR of two-element brassboard monopole in the 40–50 MHz band with 4:1 step-down transformer.
Figure 51:
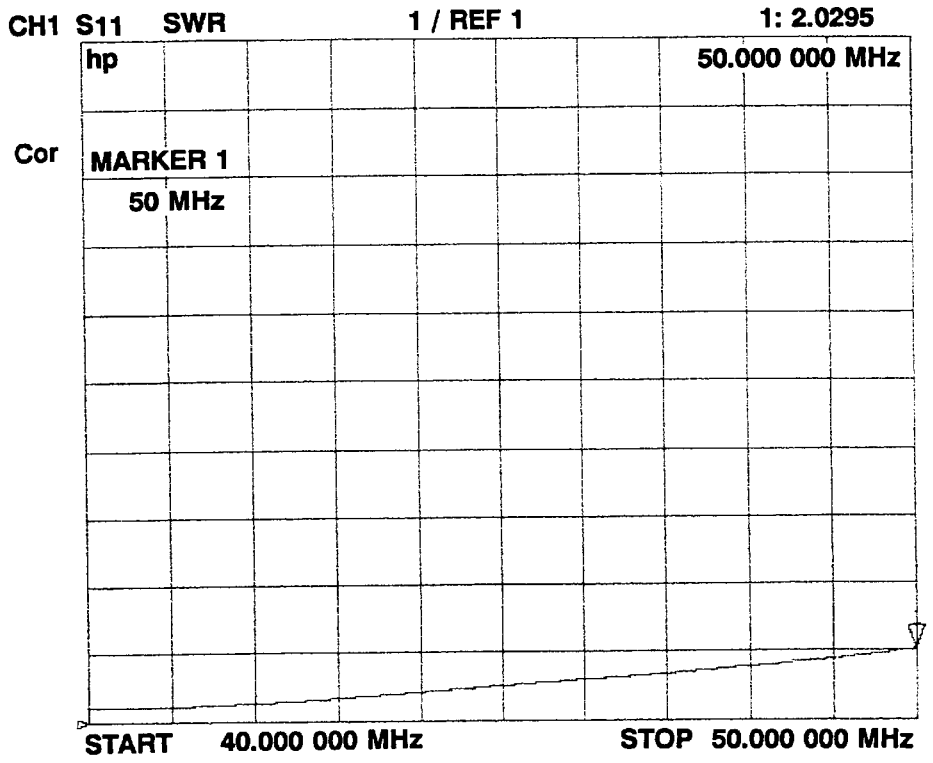
Figure 52:
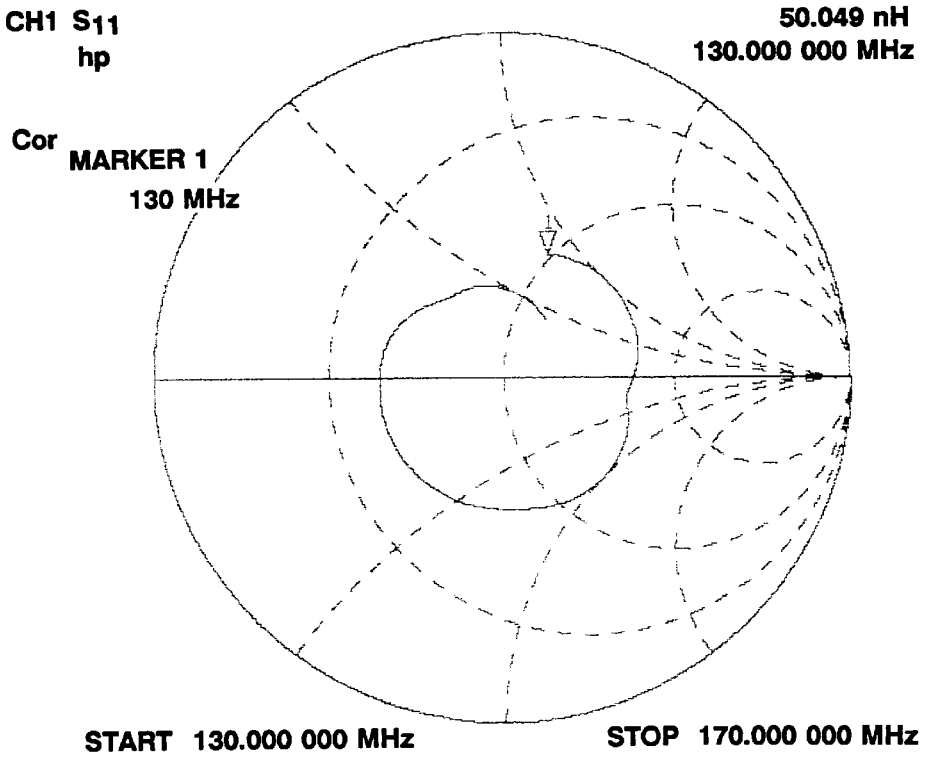
FIG. 52 shows a measured input impedance and VSWR of two-element brassboard monopole in the 130–170 MHz band with no transformer.
Figure 52:
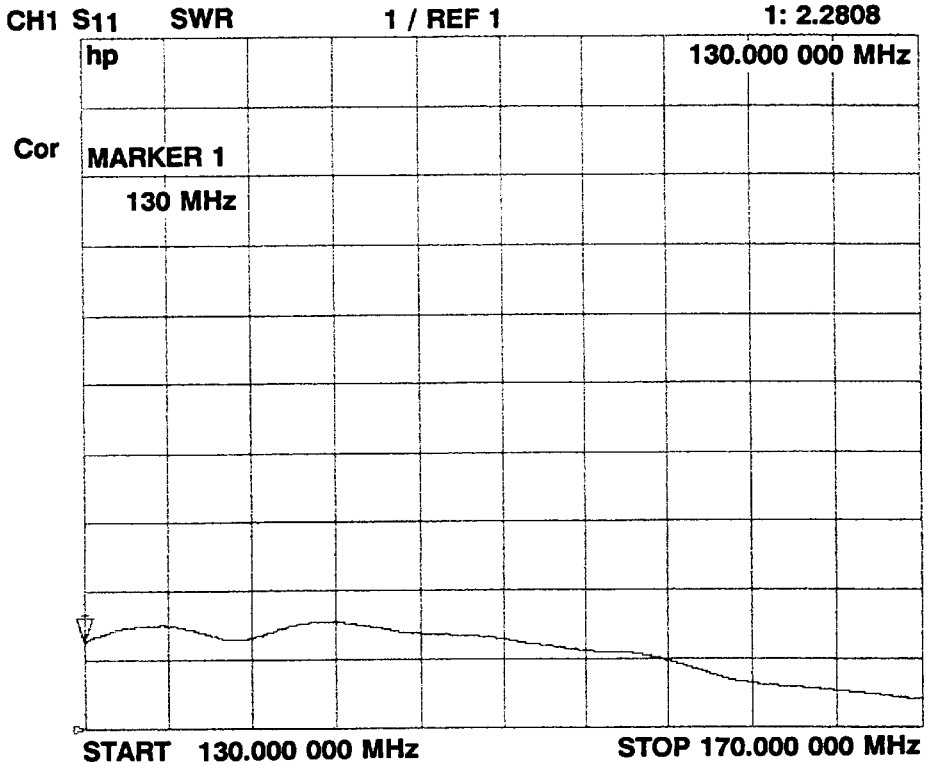
Figure 53:
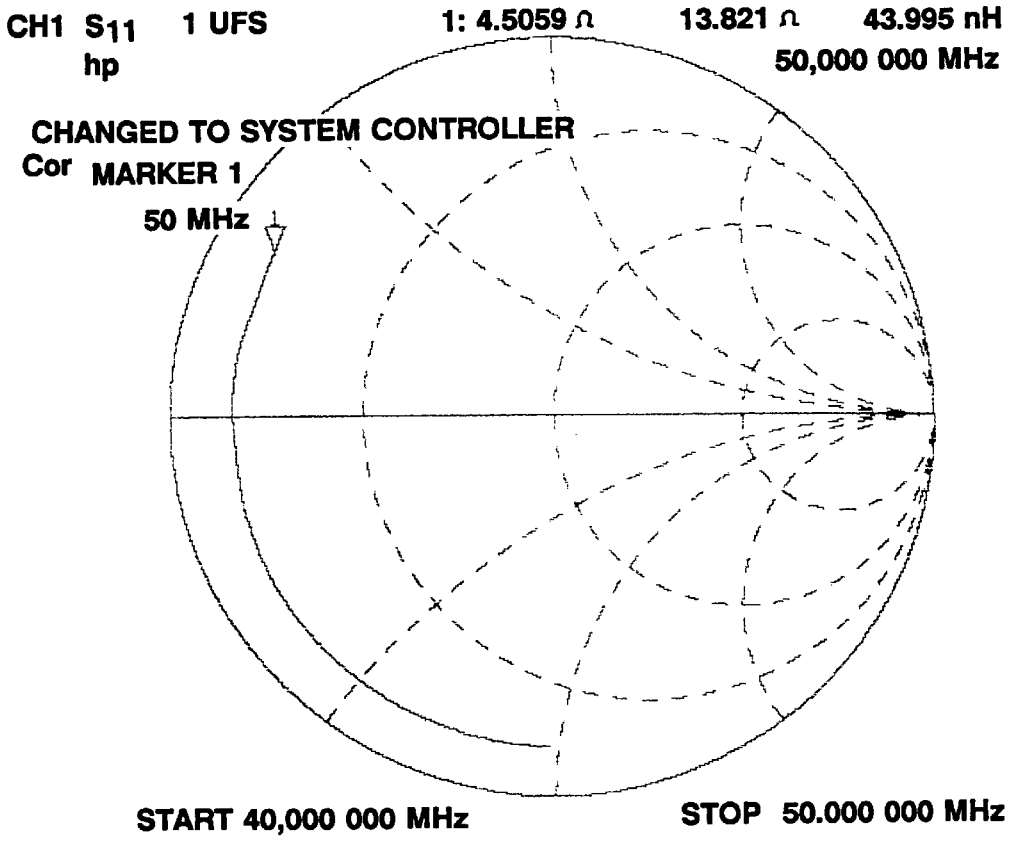
FIG. 53 shows a measured input impedance of 32" reference antenna with magnetic mount on the 40–50 MHz band.
Figure 54:
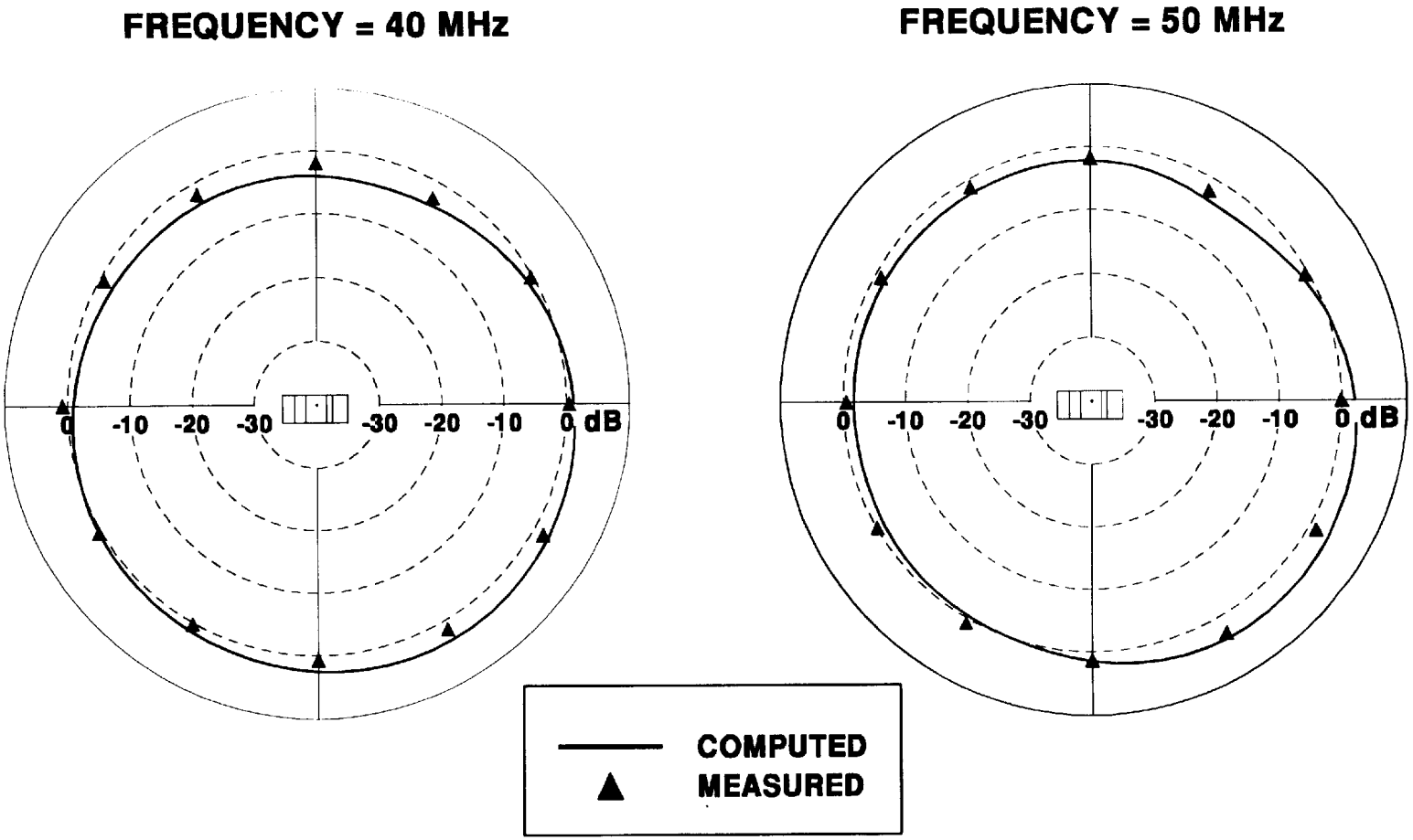
FIG. 54 shows a comparison of measured and computed azimuth surfacewave radiation patterns of 32" reference antenna on Taurus.
Figure 55:
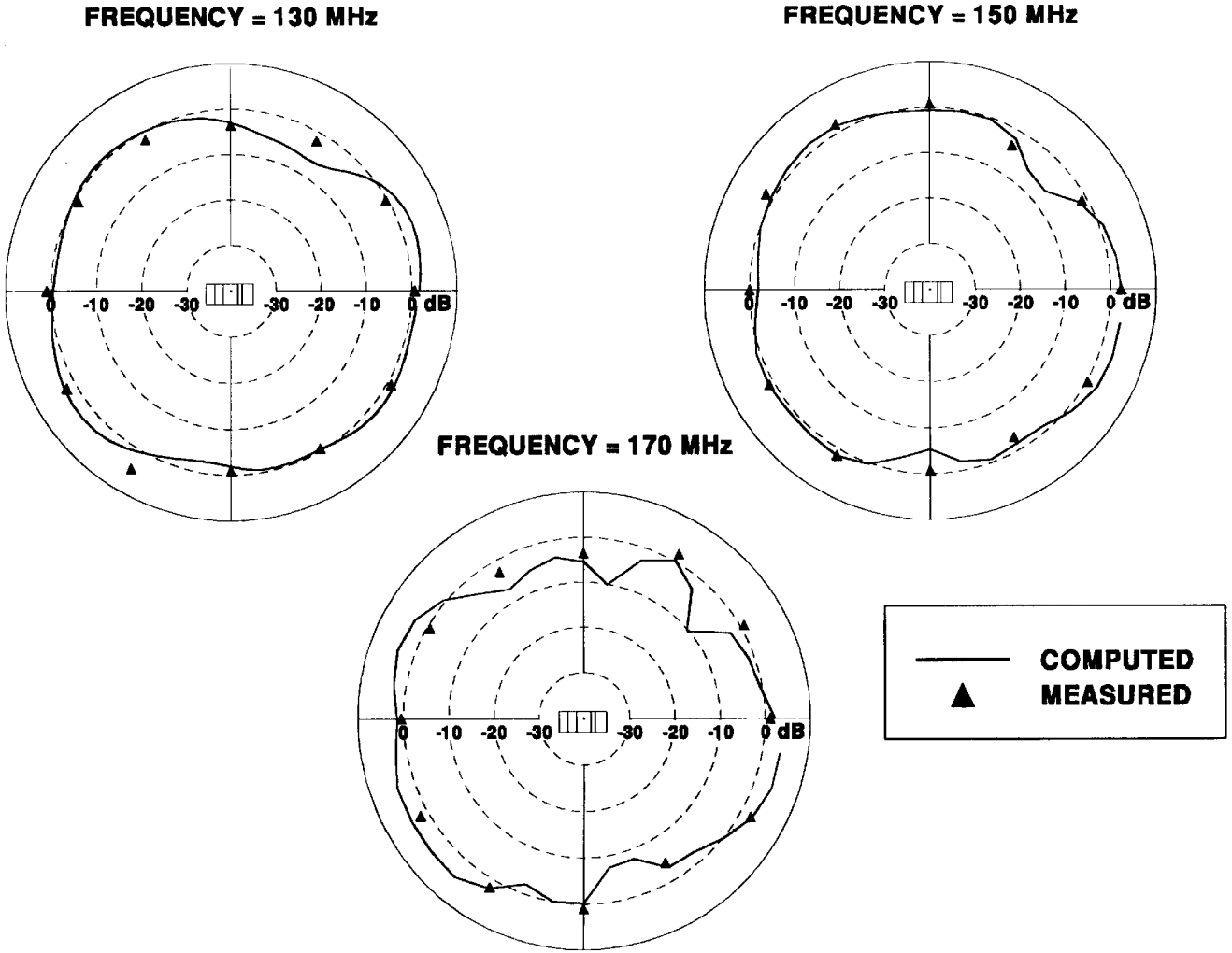
FIG. 55 shows a comparison of measured and computed azimuth surfacewave radiation patterns of 20" reference antenna on Taurus.
Figure 56:
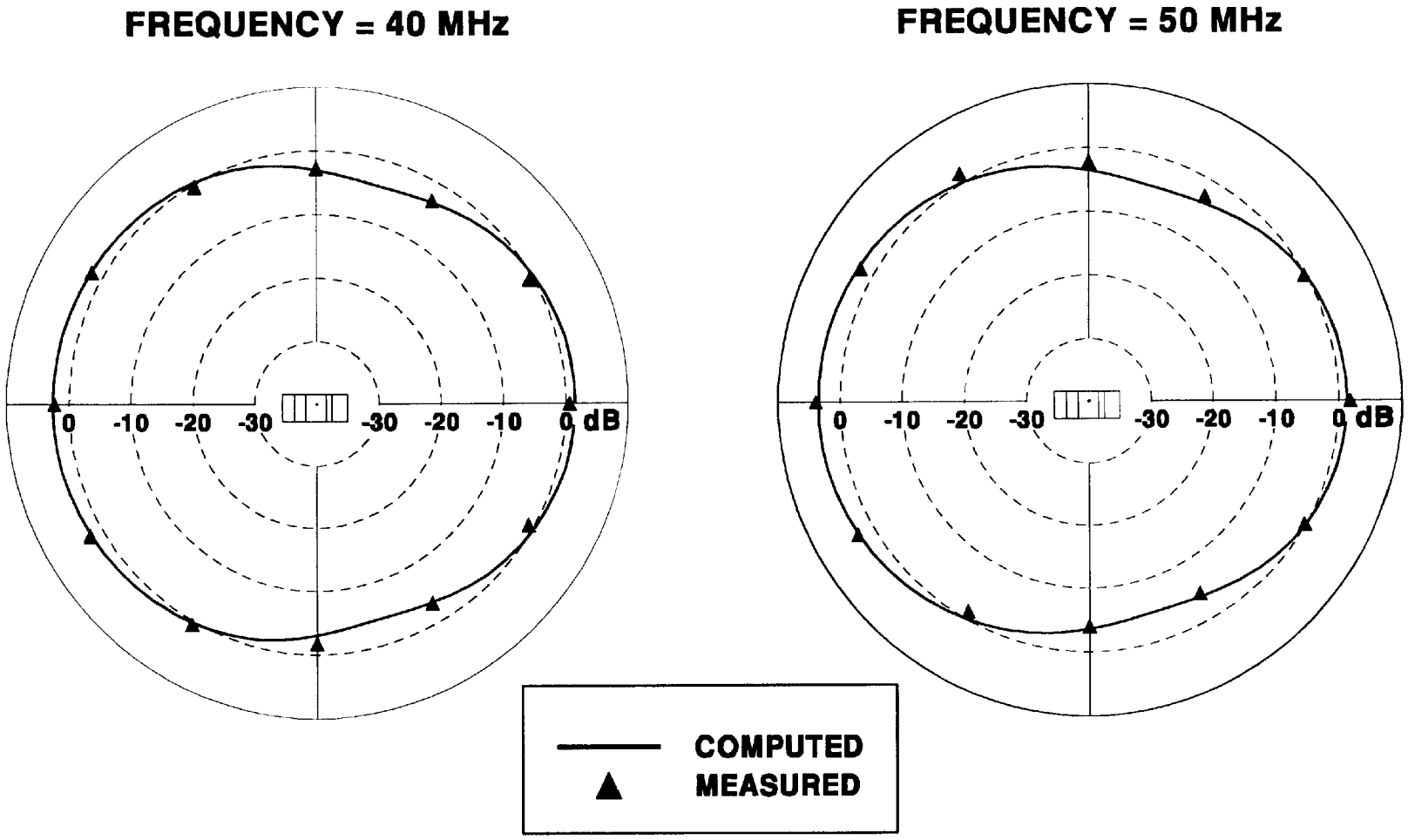
FIG. 56 shows a comparison of measured and computed azimuth surfacewave radiation patterns of loaded two-element on-glass antenna on Taurus.
Figure 57:
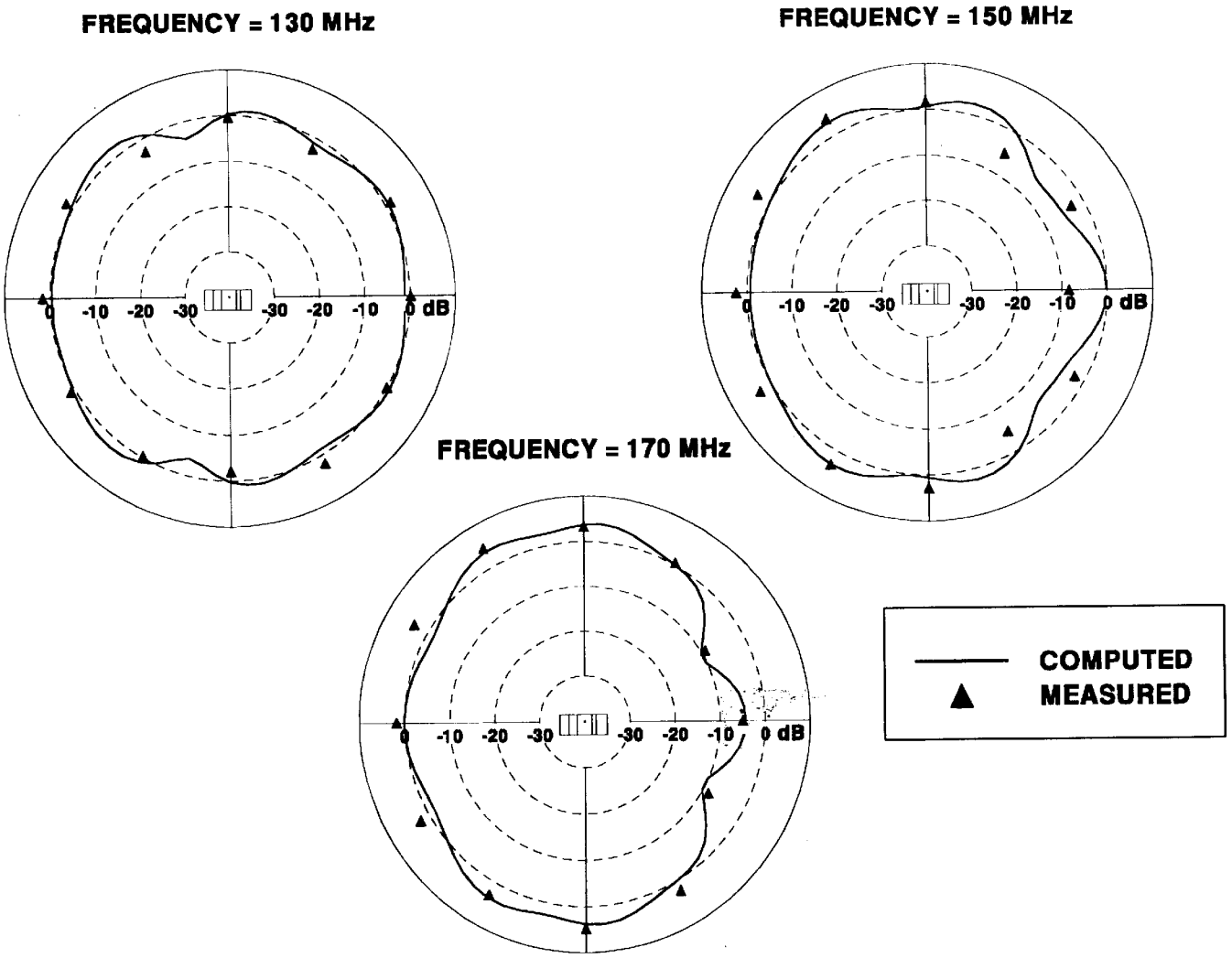
FIG. 57 shows a comparison of measured and computed azimuth surfacewave radiation patterns of loaded two-element on-glass antenna on Taurus.

The VSWR of the brassboard on-glass antenna is 2.5:1 or less over the 40–50 and 130–170 MHz bands as shown in FIGS. 51 and 52. This was achieved using only a 4:1 stepdown transformer in the 40–50 MHz band. No additional matching was needed in the 130–170 MHz band.

The 32" reference whip (FIG. 53) has a VSWR in excess of 10:1 in the 40–50 MHz band and resulting mismatch losses of 5–6 dB. The VSWR of the 20" reference whip (FIG. 51) exceeds 3:1 between 159 and 170 MHz, resulting in greater than 1 dB of mismatch loss.

Figure 62:
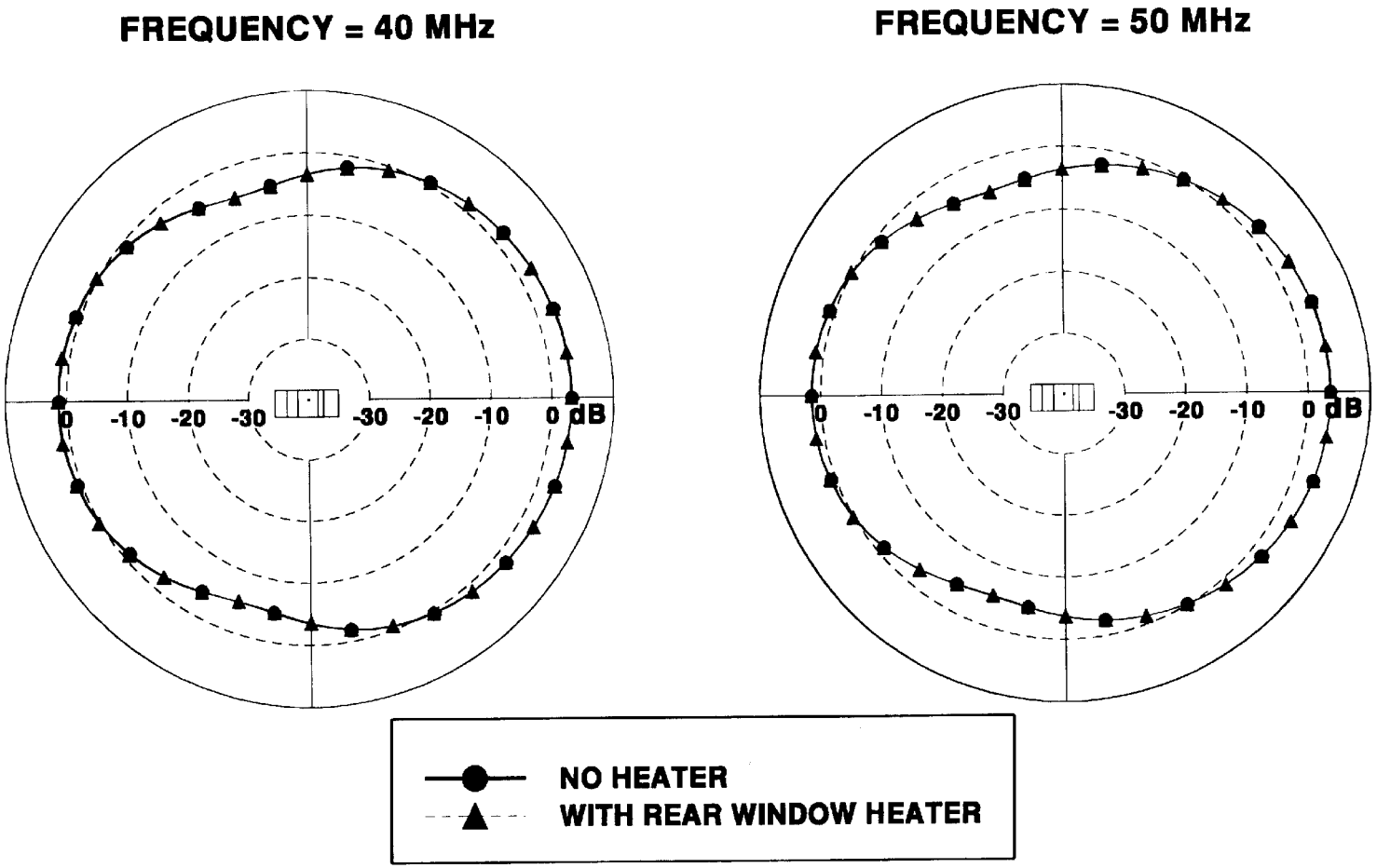
FIG. 62 shows computed azimuth surfacewave radiation patterns of top-loaded on-glass antenna on a rear window.
Figure 63:
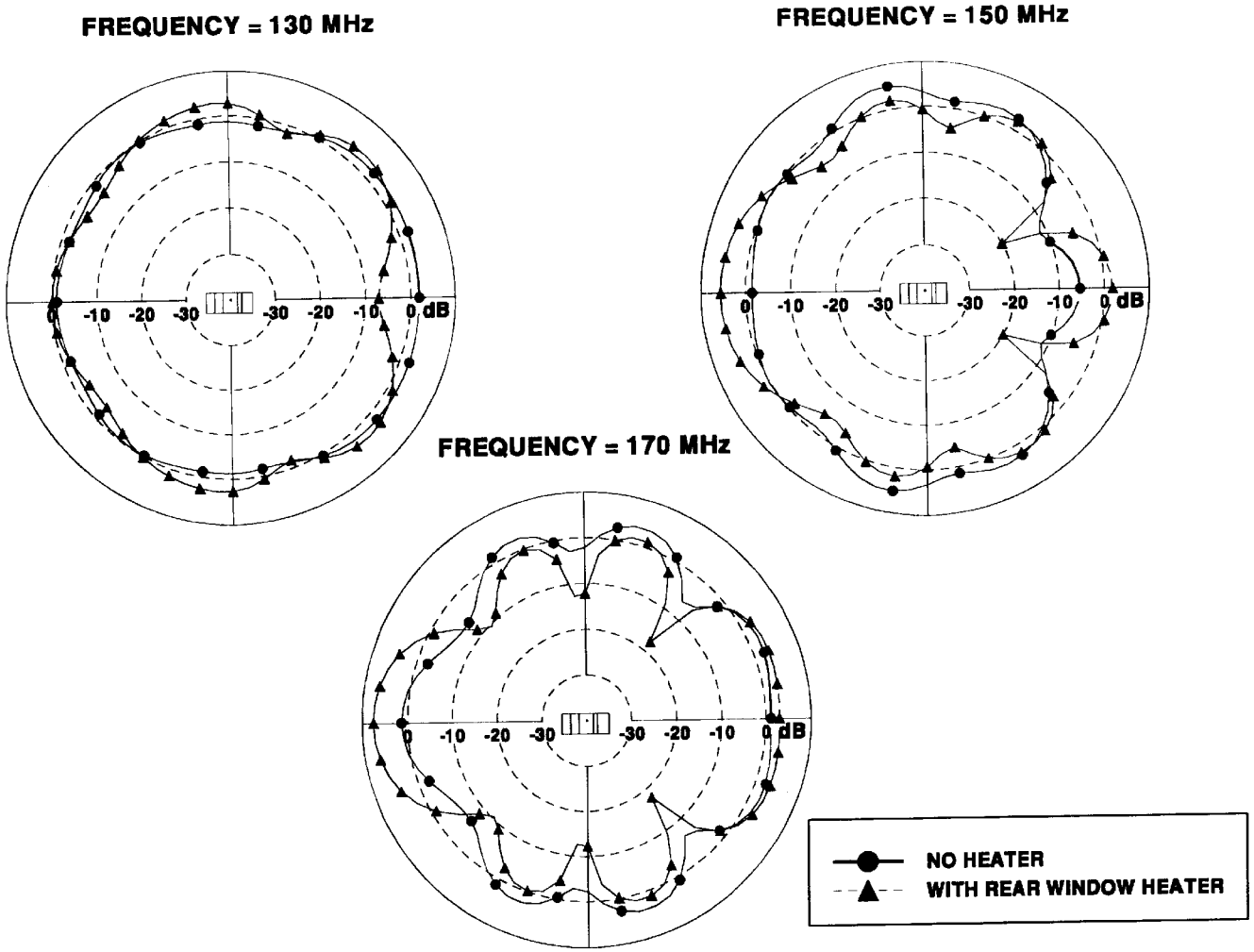
FIG. 63 shows computed azimuth surfacewave radiation patterns of top-loaded on-glass antenna on a rear window.
Figure 64:
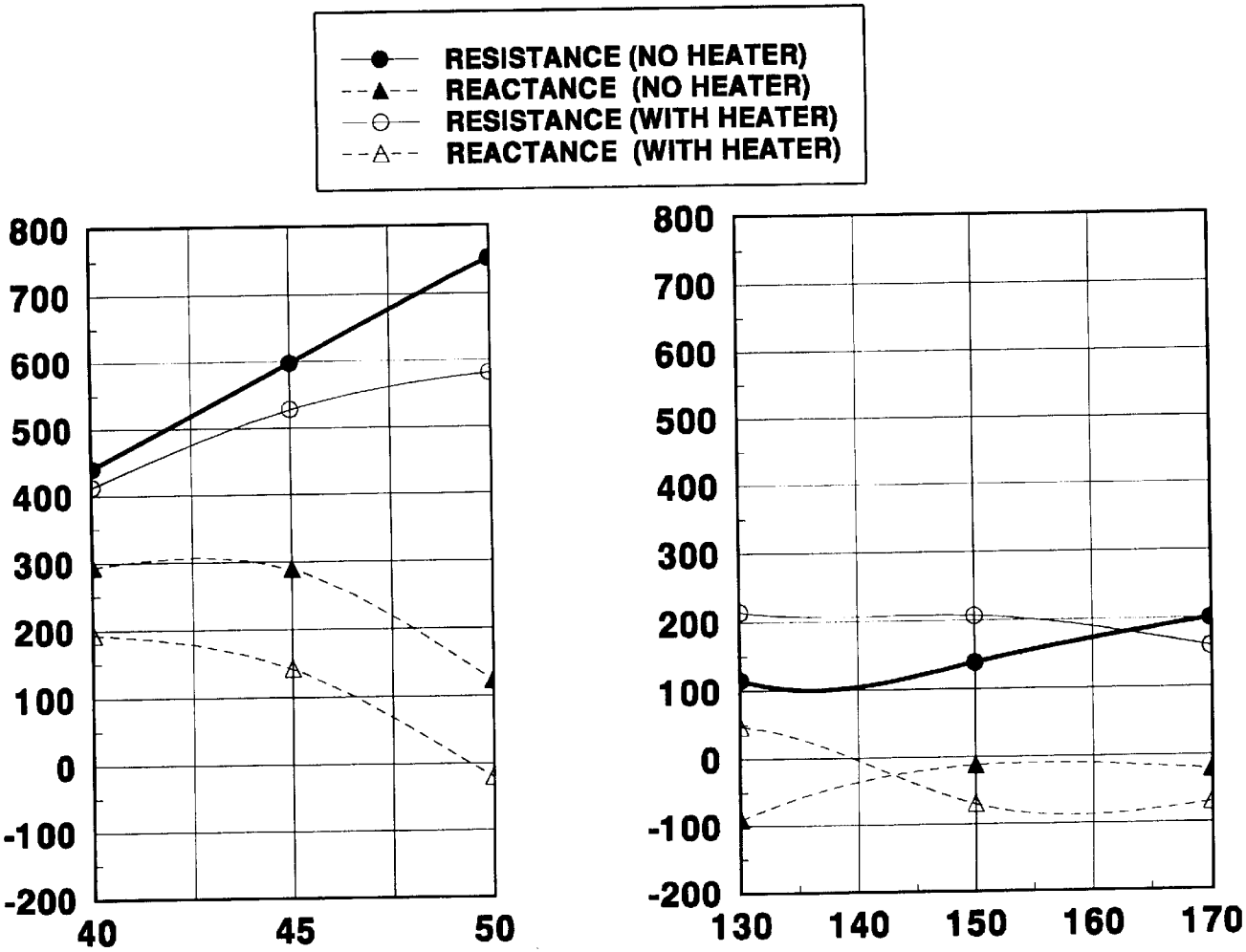
FIG. 64 shows an input impedance of top-loaded monopole on a rear window.

The measured normalized azimuthal surfacewave radiation patterns were compared with the computed patterns and reveal excellent agreement for both the reference whip and on-glass antenna (FIGS. 62–64); ±4.15 dB and ±6.90 dB maximum pattern variation in the 40–50 and 130–170 MHz bands respectively. This compares favorably with the ±2.75 dB and ±4.40 dB pattern variations measured for the reference whips in the 40–50 and 130–170 MHz bands respectively.

The VSWR of the on-glass antenna was not affected by front seat passengers. When the windshield wipers were manually placed over the two vertical elements, the VSWR increased to a maximum of 2.28:1 at 48.65 MHz and 2.87:1 at 162.24 MHz. The overall effect of the wipers was to slightly translate the entire VSWR curve shown in FIG. 3.3.2-11 upward, but the VSWR remained below 2.5:1 across the 40–50 MHz band. In the 130–170 MHz band the effect was somewhat frequency selective in that the VSWR was slightly decreased between 130 and 144 MHz, but increased between 150 and 170 MHz. The VSWR at 92% of the frequencies between 130 and 170 MHz was below 2.5:1 with the wipers placed over the antenna, as opposed to less than 2.5:1 over 100% of all frequencies in this band as was shown in FIG. 52.

Figure 60:
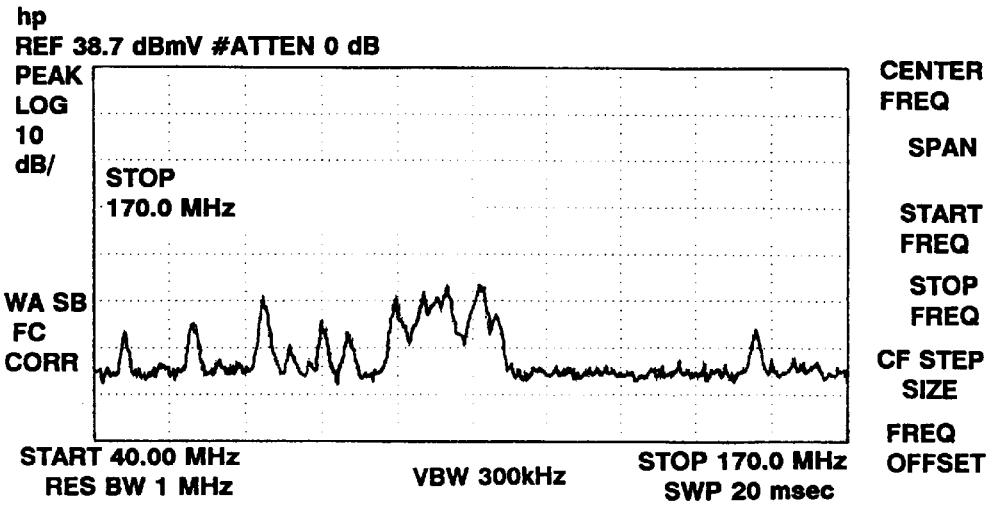
FIG. 60 shows a comparison of measured signals-of-opportunity in the 40–170 MHz band using brassboard antenna and 32" reference whip.
Figure 60:
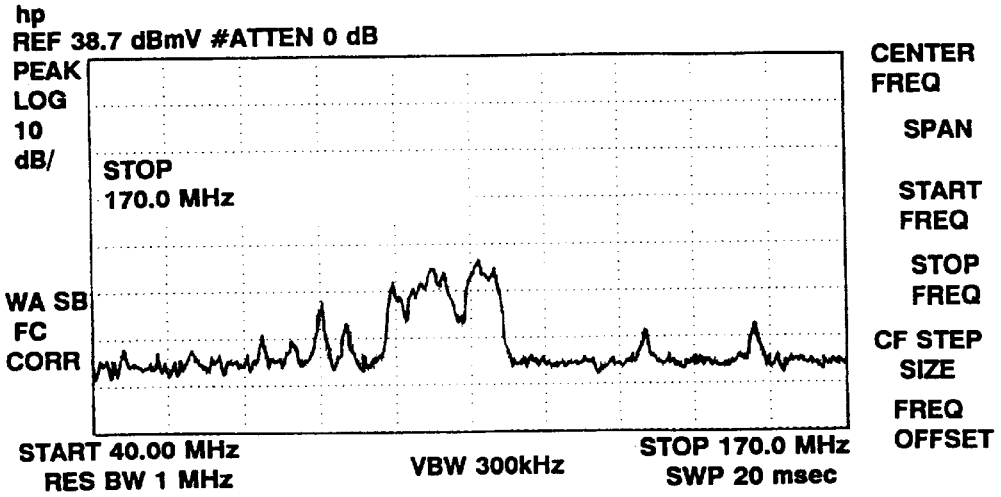
Figure 61:
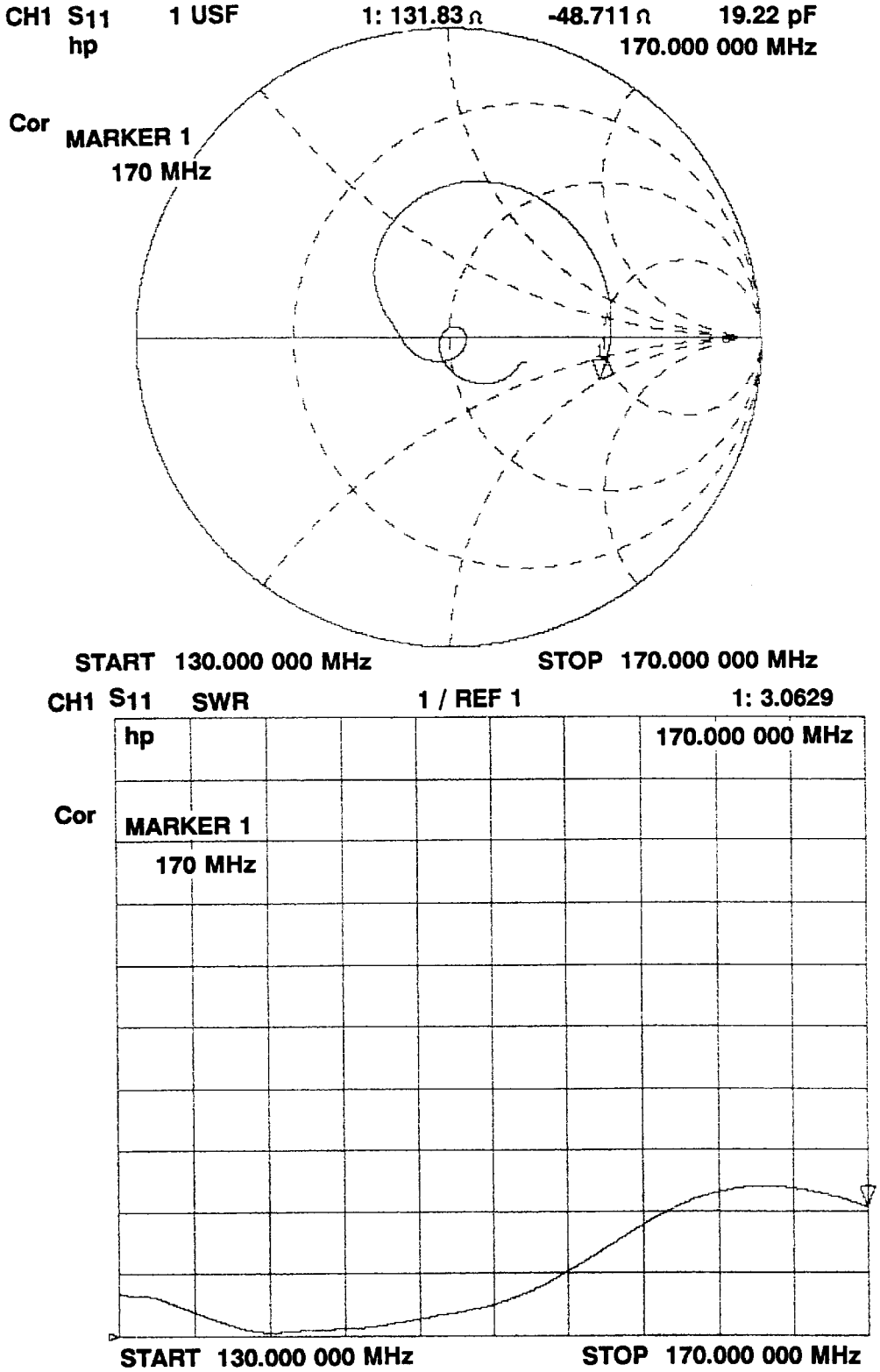
FIG. 61 shows a measured input impedance as VSWR of 20" reference antenna with magnetic mount in the 130–170 MHz band.

While somewhat subjective, the six spectrum analyzer plots shown in FIGS. 59–61 indicate comparable received signal levels for the on-glass brassboard as compared to the reference antennas. While FIG. 59 indicates that the received signal strength at 42.8 MHz from the on-glass antenna is 4 dB greater than that received by the 32" reference whip, the latter includes the substantial (over 7 dB) of cable and mismatch loss between the magnet mounted whip and the test equipment, which was connected via ¼" of RG-174/U coax. When the mismatch and cable losses are taken into account between 130 and 170 MHz using the 20" magnet mounted whip as a reference, the relative signal strengths between the two antennas at 153.75 MHz and 163.80 MHz as shown in FIG. 60 would appear to suggest that the on-glass antenna performs about as well as the 20" reference antenna assuming 3 dB of mismatch/cable loss for the reference compared to less than 0.5 dB mismatch/cable loss for the on-glass antenna. The difference in relative signal strengths at 134.5 MHz cannot be explained (except by directional gain differences between the two antennas) since both antennas were reasonably matched at this frequency, and the differential line loss was only 1.5 dB.

FIGS. 68 to 90 show similar performance analysis for the FM broadcast band 88–108 MHz. The five antennas used were: (a) single element monopole, (b) two element monopole, (c) two element conical monopole, (d) conical sheet antenna, (e) rectangular sheet antenna. In this band for the automobile case, using the original loading profile (baseline profile), we observed large structural resonances which give rise to nulls in the radiation pattern. These appear to be largely due to a resonance in the aperture caused by the rear window. To overcome this resonance, we found the following. A more optimum loading profile for the antenna elements in this band for all the antennas appears to be 2×baseline profile. The nulls are largely filled in when a rear window defroster is included in the model or when a horizontal conducting strip is added in the rear window to damp the resonance. In practice therefore, better patterns can be obtained on the car by either judicious use of additional "parasitic" resistive strips across the rear window or redesigning the rear window heater element to include this.

The best configuration is the conical sheet, where the patterns are very close to those of the whip, the impedance can be matched using a stepdown transformer and the surfacewave gain is not much worse than the whip. The worst case is the rectangular sheet. It is likely that the pattern of each candidate other than the conical sheet can be improved using the method described above or in the case of the rectangular sheet tapering the loading profile in two dimensions rather than just along the length of the element.

Manufacturing Schemes

Where the antenna is to be retrofitted to an automobile or other window, a tinted plastic film is used as the base for the antenna. The antenna element and the ground strips are formed from thin, optically transparent, vacuum deposited films. Since there is a greater than 10:1 variation in resistivity along the antenna length and a fairly high conductivity is necessary for the grounding strips, to camouflage the antenna will require blending the antenna into the overall film color in a similar way to which aesthetic tints are blended into auto windshields as a pattern of dots of gradually decreasing size.

For a retrofitted antenna, the film may be adhered by adhesive or static cling on the inside. The lower edge of the film near the antenna feedpoint is extended to form a tab to which the matching network elements can be mounted.

Figure 65:
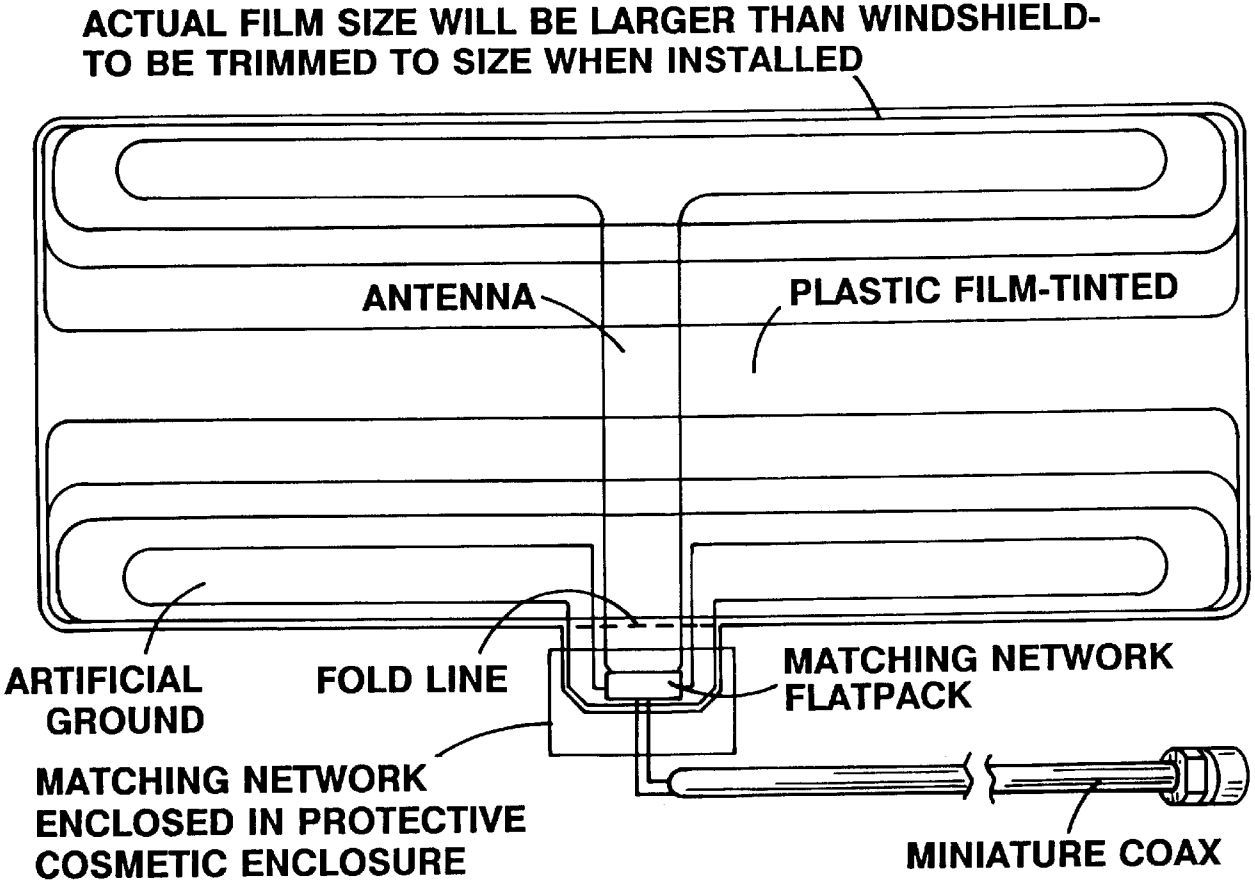
FIG. 65 shows retrofittable on-glass automobile antennas with lower antenna self-ground incorporated in film and feed point and matching network covered by cosmetic package.

The tab/matching network are enclosed in a small aesthetically designed cosmetic package. RF connectors will be available on the outside of the package for connection to the required RF devices (transceivers, receivers, transmitters). Cables can be run along the rear of the dashboard. This type of installation is shown in FIG. 65.

Figure 66:
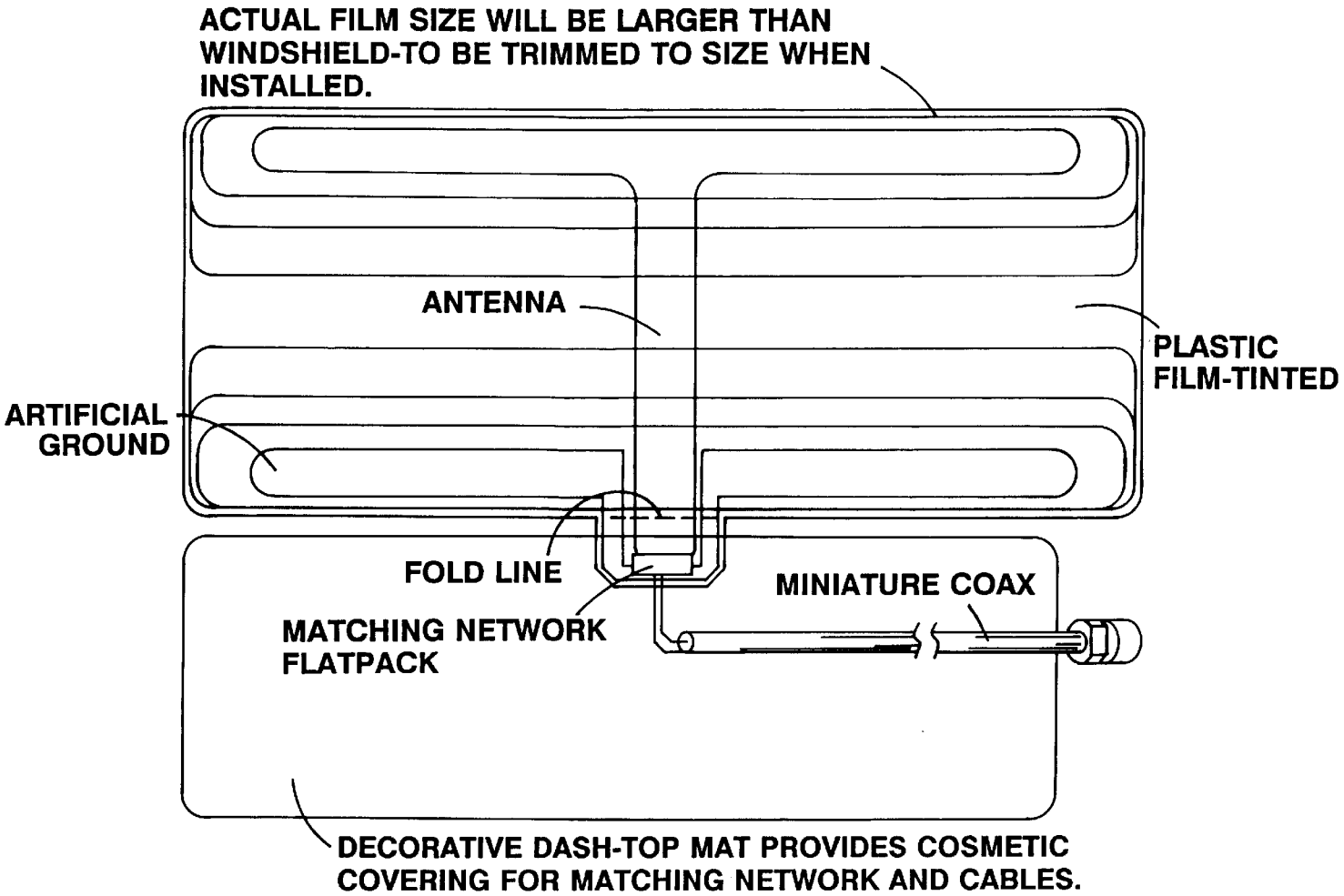
FIG. 66 shows retrofittable on-glass automobile antennas with lower antenna self-ground incorporated in film and feed point, matching network and feed cables covered by cosmetic dash cover.
Figure 67:
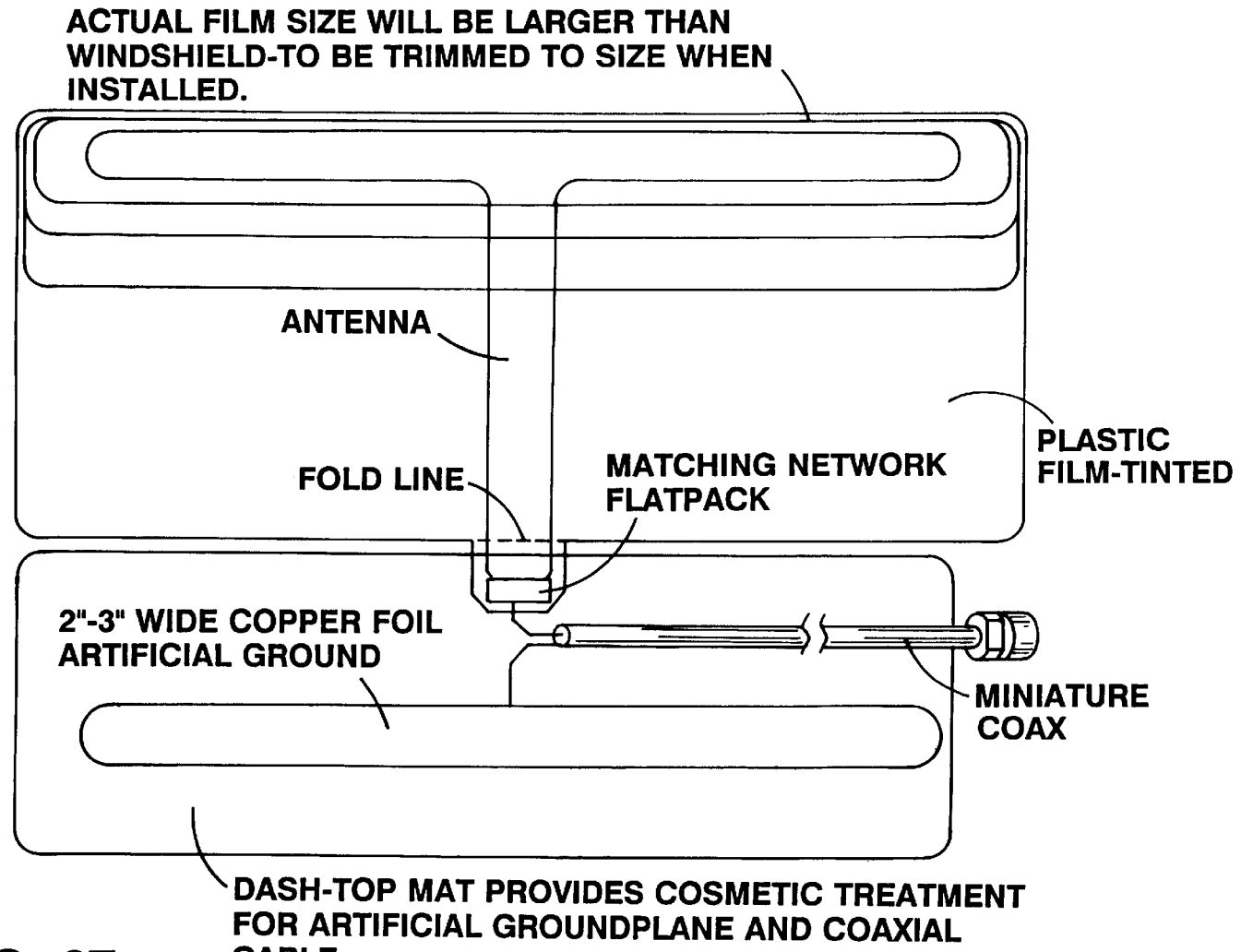
FIG. 67 shows retrofittable on-glass antennas with lower antenna self-ground incorporated in cosmetic dash cover which also covers feed point, matching network and feed cables.
Figure 68:
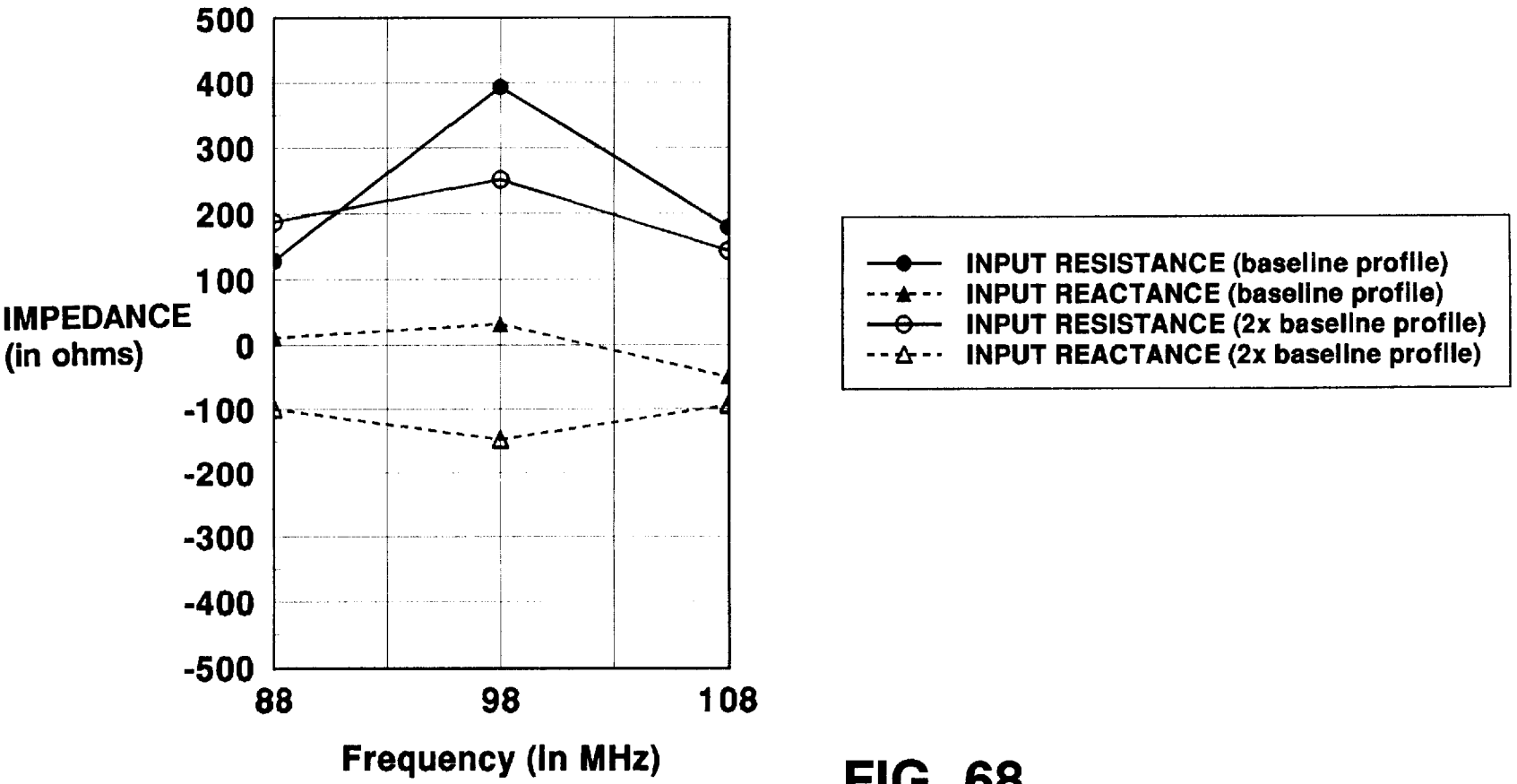
FIG. 68 shows input impedance of single-element top-loaded monopole in FM broadcast band as a function of loading profile.
Figure 69:
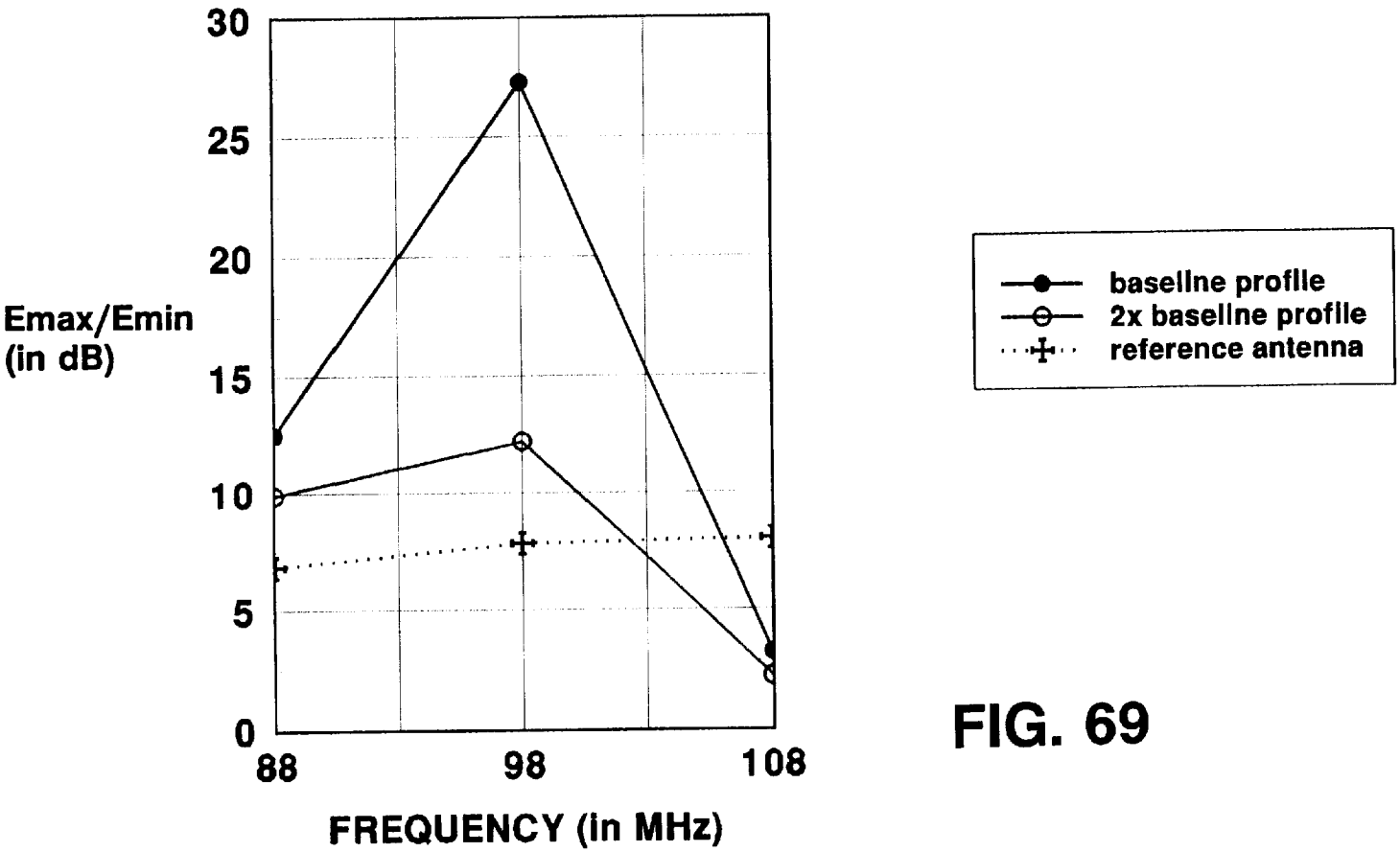
FIG. 69 shows azimuth pattern variation for single element top-loaded monopole in FM broadcast band as a function of loading profile.
Figure 70:
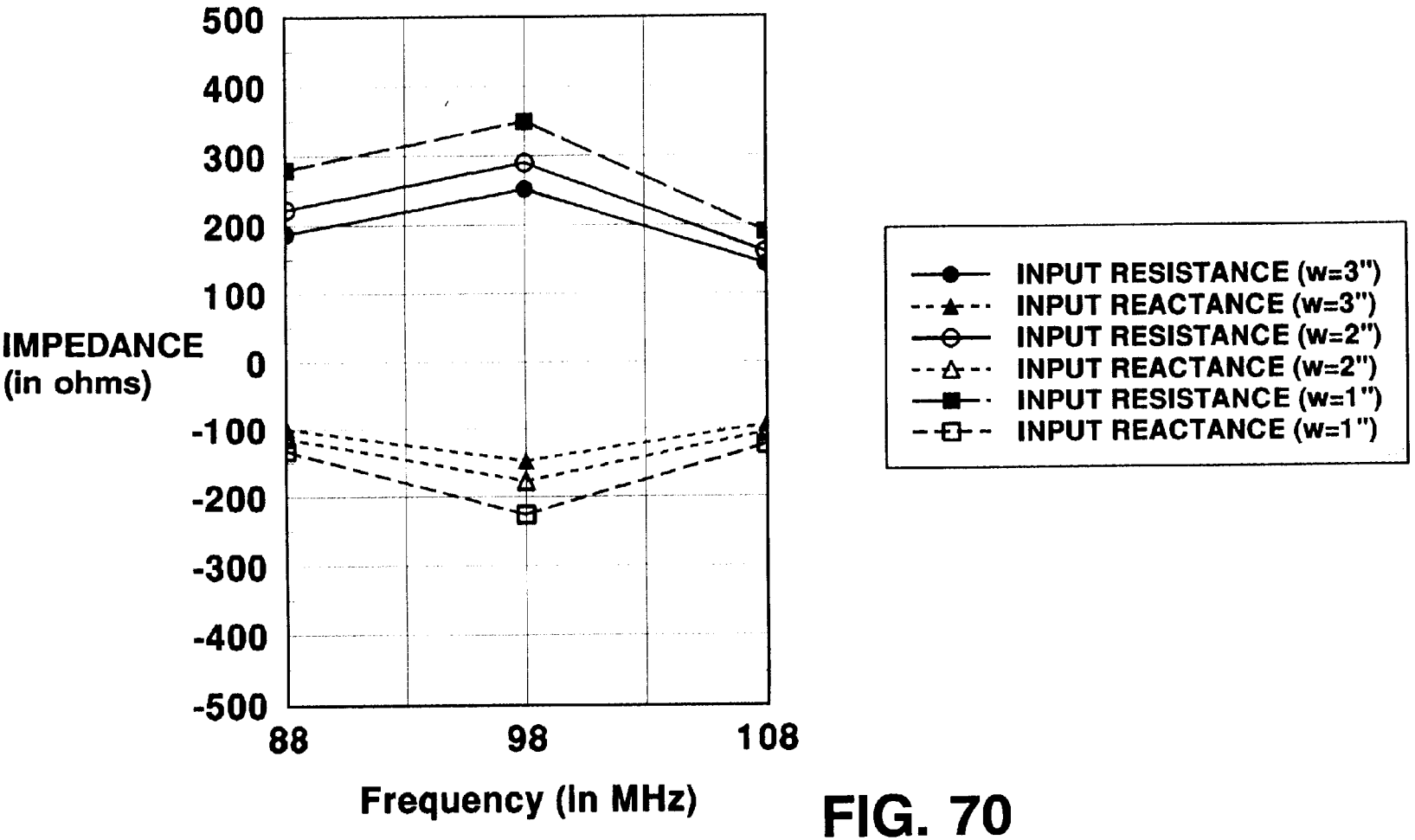
FIG. 70 shows input impedance of single-element top-loaded monopole in FM broadcast band as a function of element width.
Figure 71:
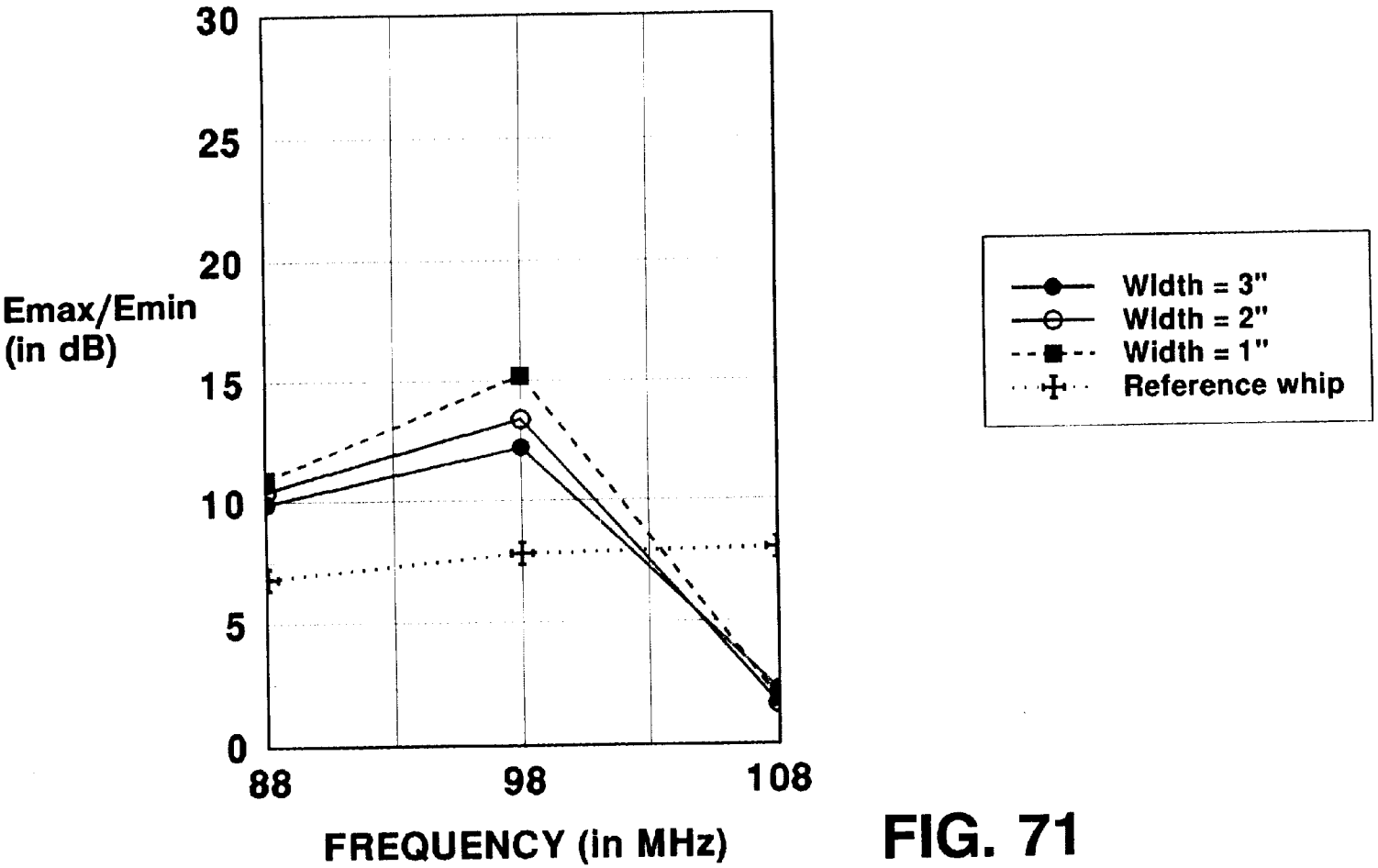
FIG. 71 shows azimuth pattern variation for a single element top-loaded monopole in FM broadcast band as a function of strip width.
Figure 72:
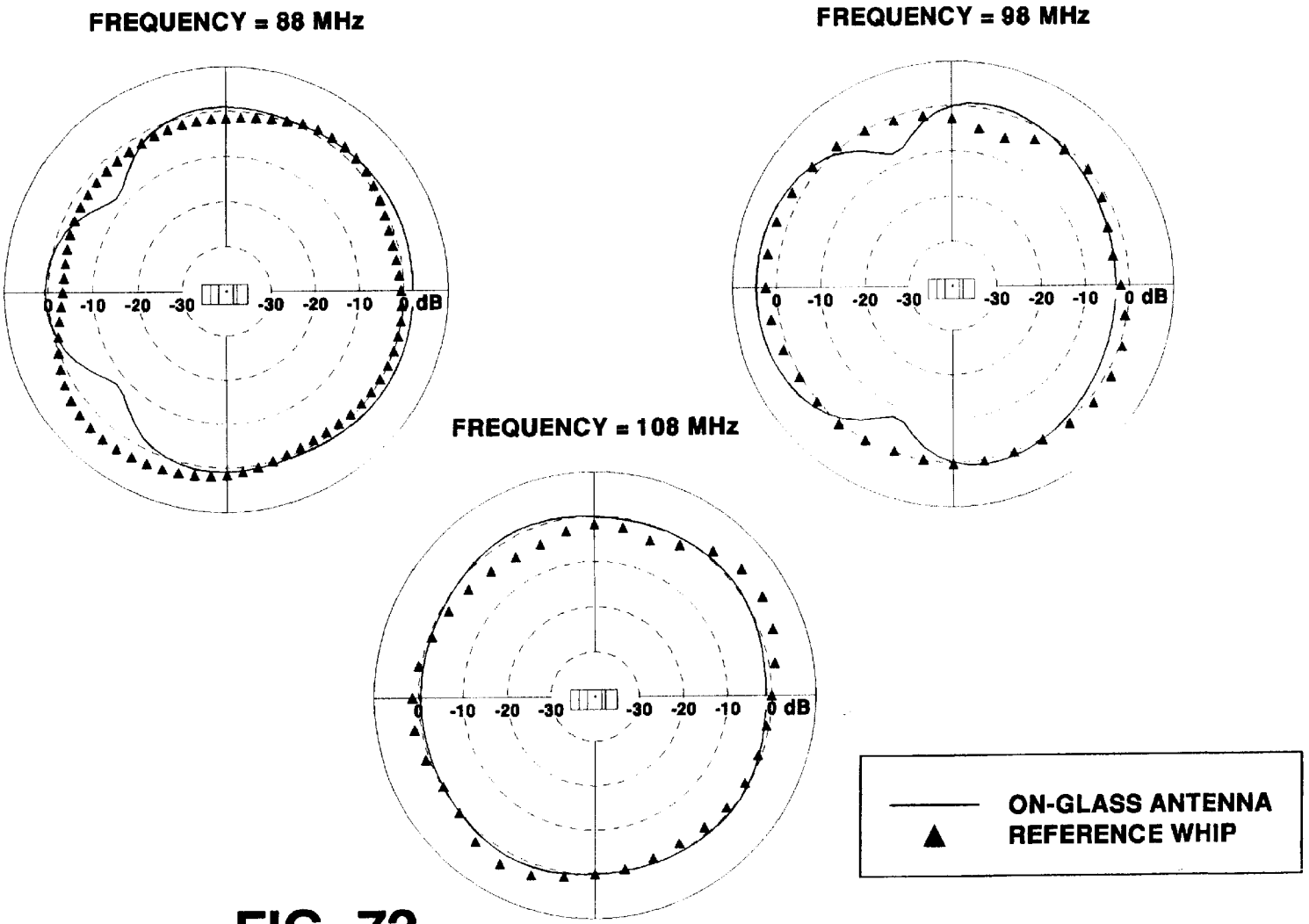
FIG. 72 shows azimuth radiation patterns of single element top-loaded monopole in FM broadcast band (2×baseline profile).
Figure 73:
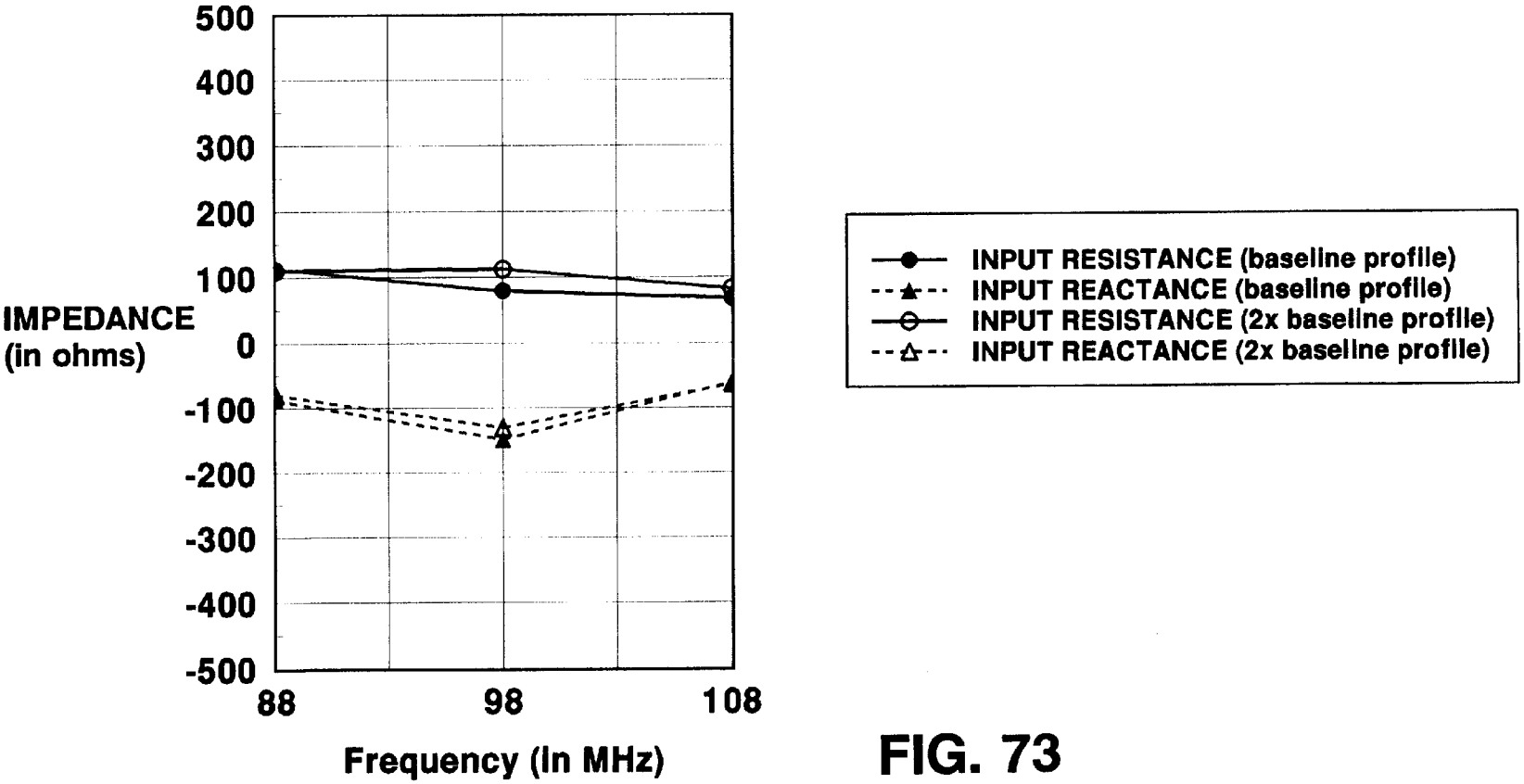
FIG. 73 shows input impedance of 2-element top-loaded monopole in FM broadcast band as a function of loading profile.
Figure 74:
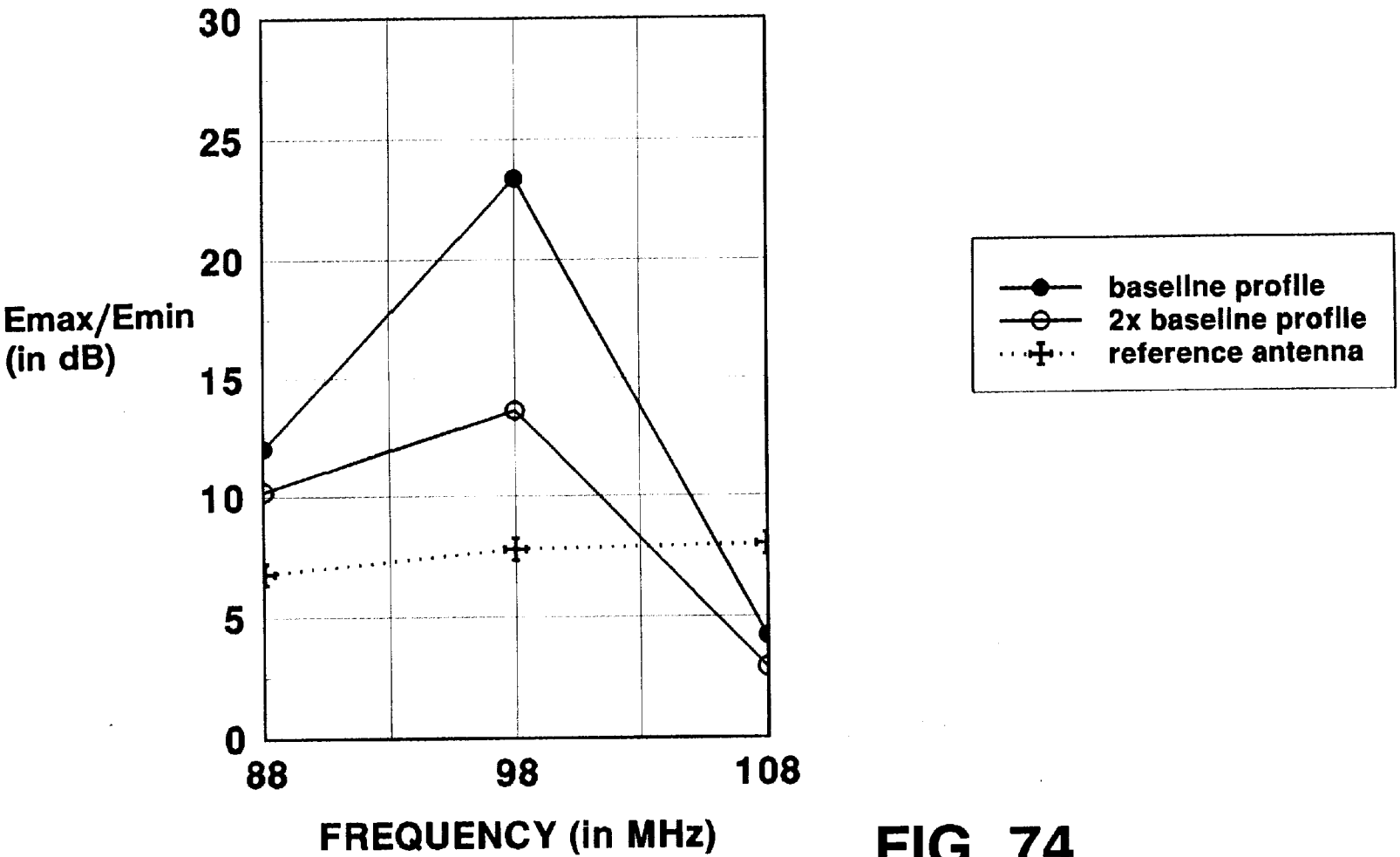
FIG. 74 shows azimuth pattern variation for two-element top-loaded monopole in FM broadcast band as a function of loading profile.
Figure 75:
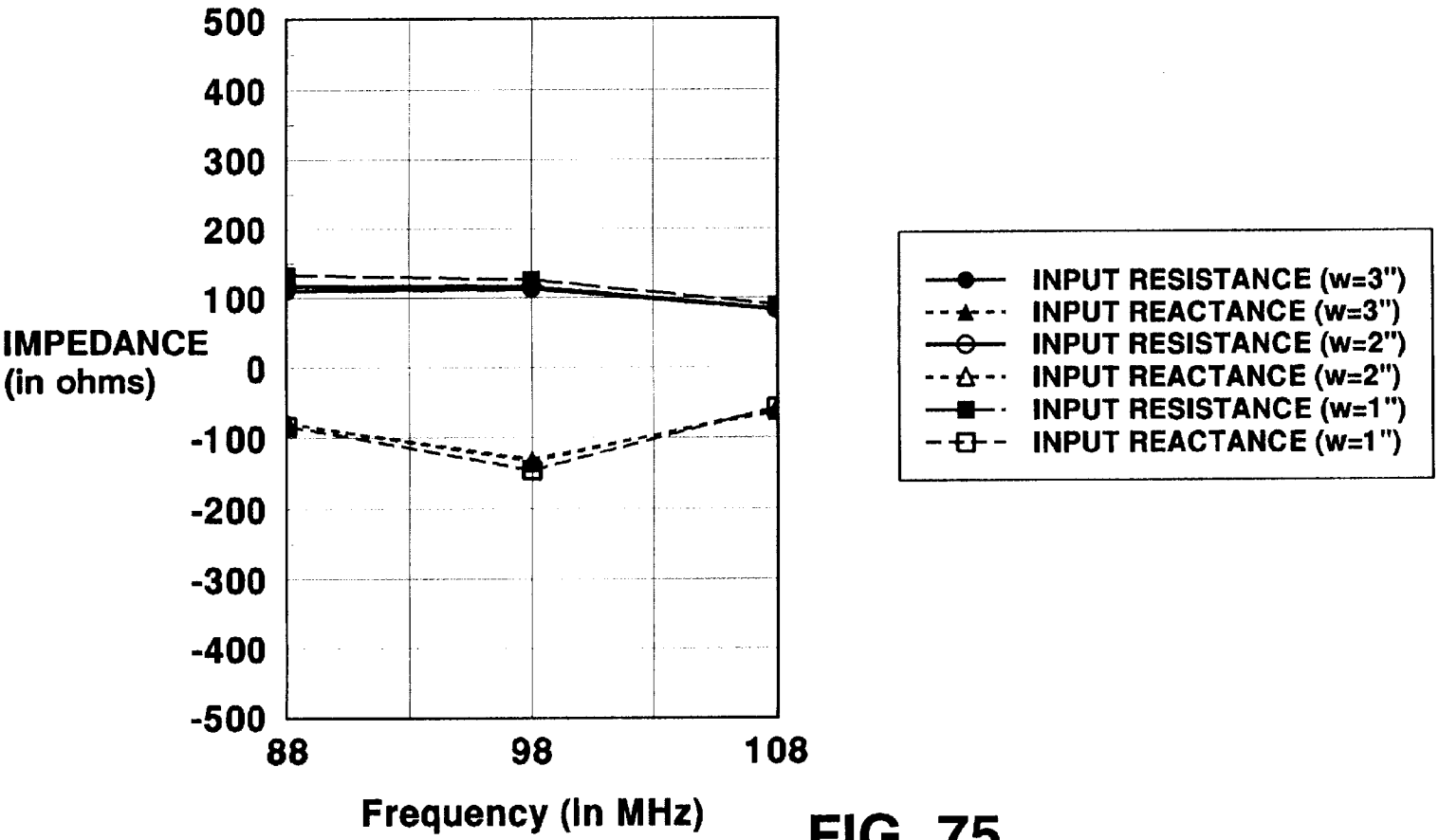
FIG. 75 shows input impedance of 2-element top-loaded monopole in FM broadcast band as a function of element width.
Figure 76:
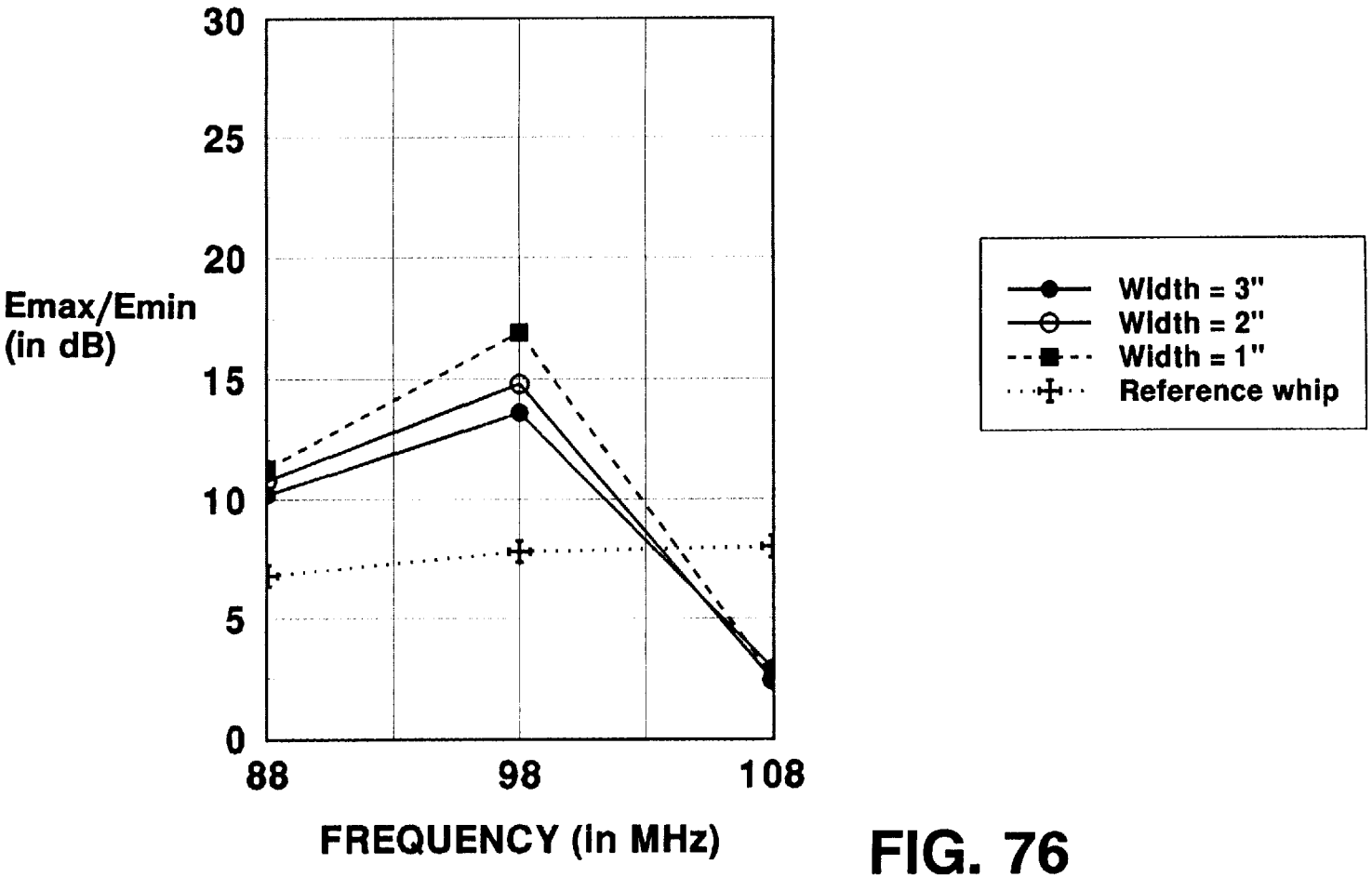
FIG. 76 shows azimuth pattern variation for 2-element top-loaded monopole in FM broadcast band as a function of strip width.
Figure 77:
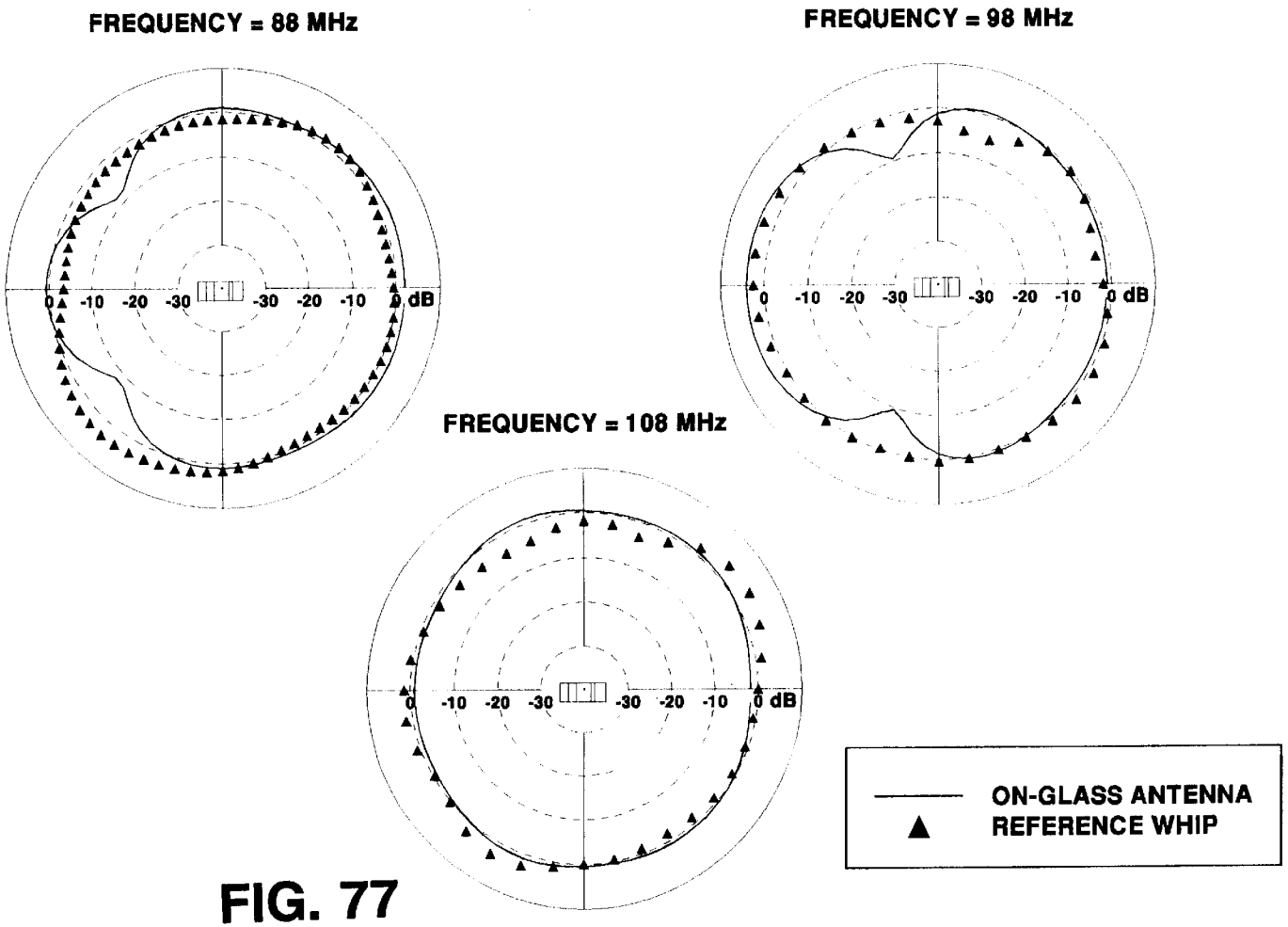
FIG. 77 shows azimuth radiation patterns of 2-element top-loaded monopole in FM broadcast band (2×baseline profile).
Figure 78:
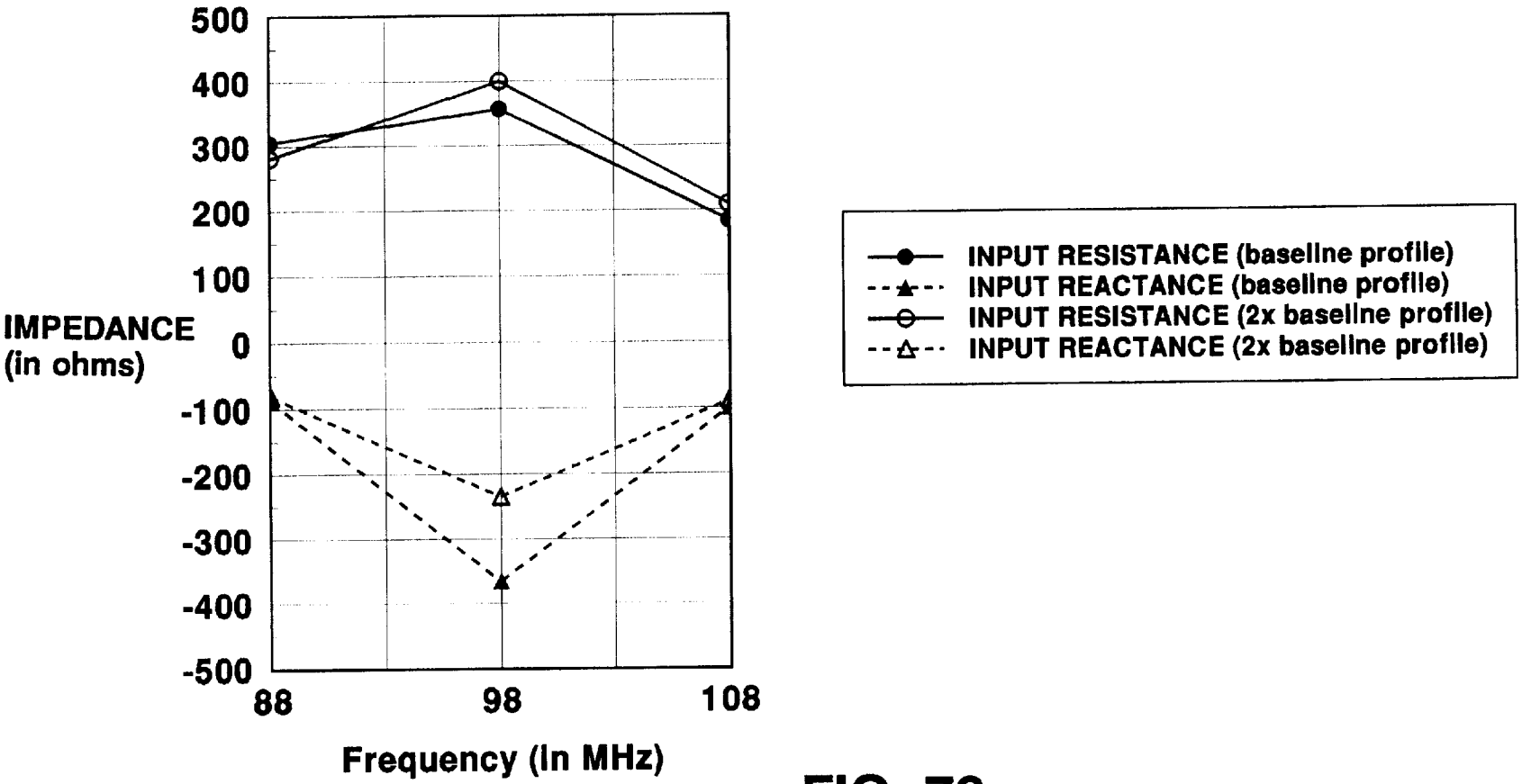
FIG. 78 shows input impedance of 2-element conical monopole in FM broadcast band as a function of loading profile.
Figure 79:
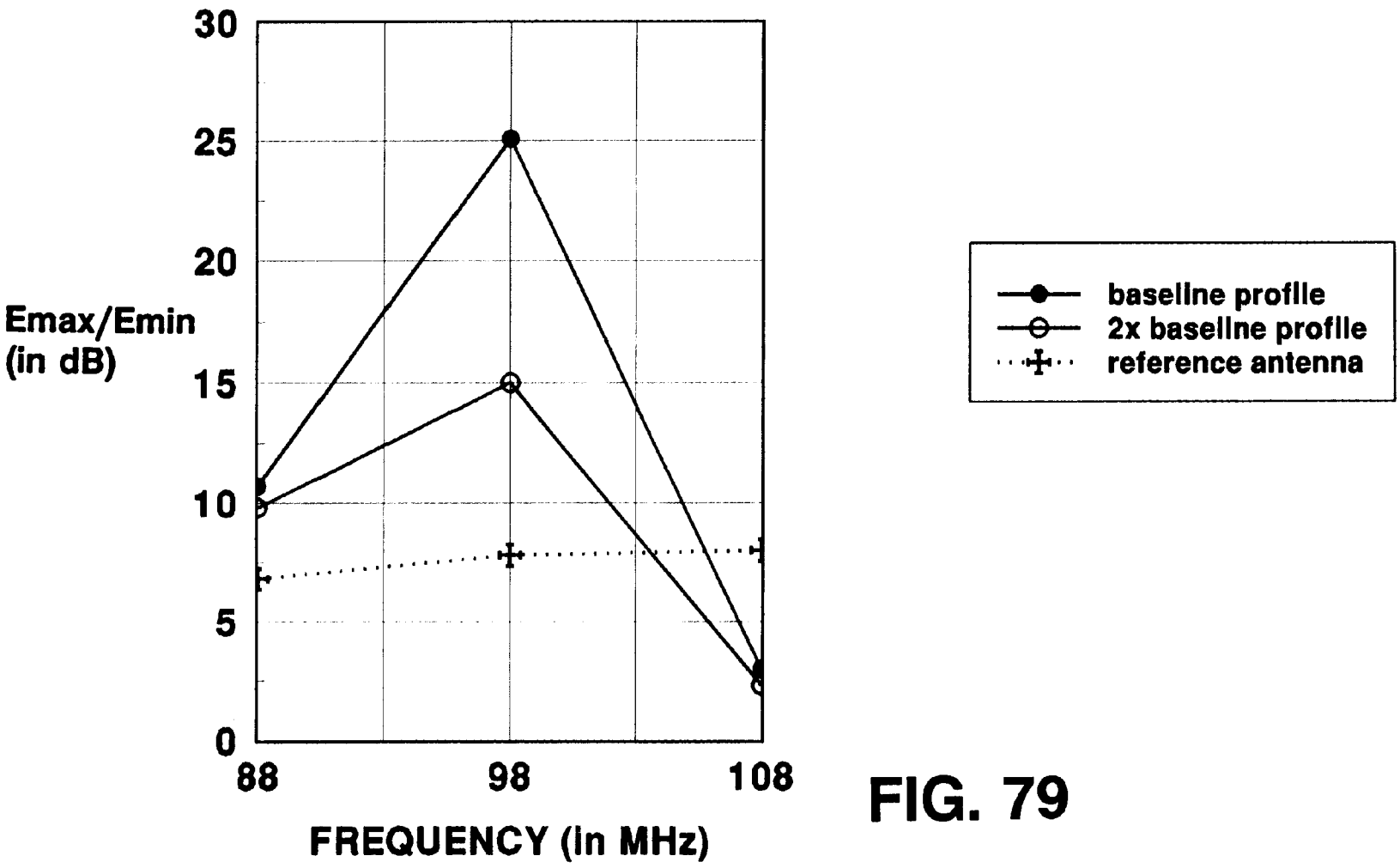
FIG. 79 shows azimuth pattern variation for two-element conical monopole in FM broadcast band as a function of loading profile.
Figure 80:
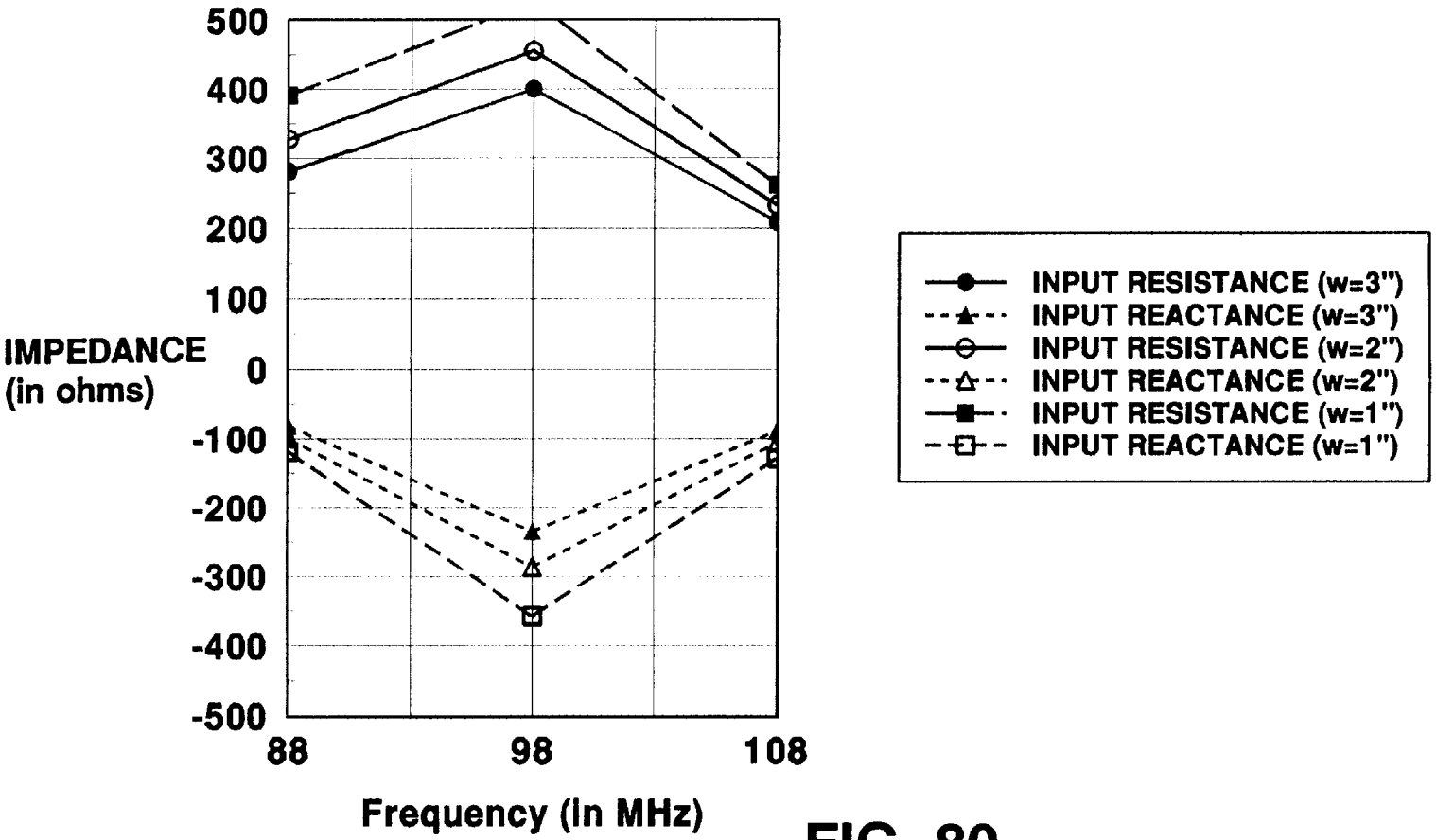
FIG. 80 shows input impedance of 2-element conical monopole in FM broadcast band as a function of element width.
Figure 81:
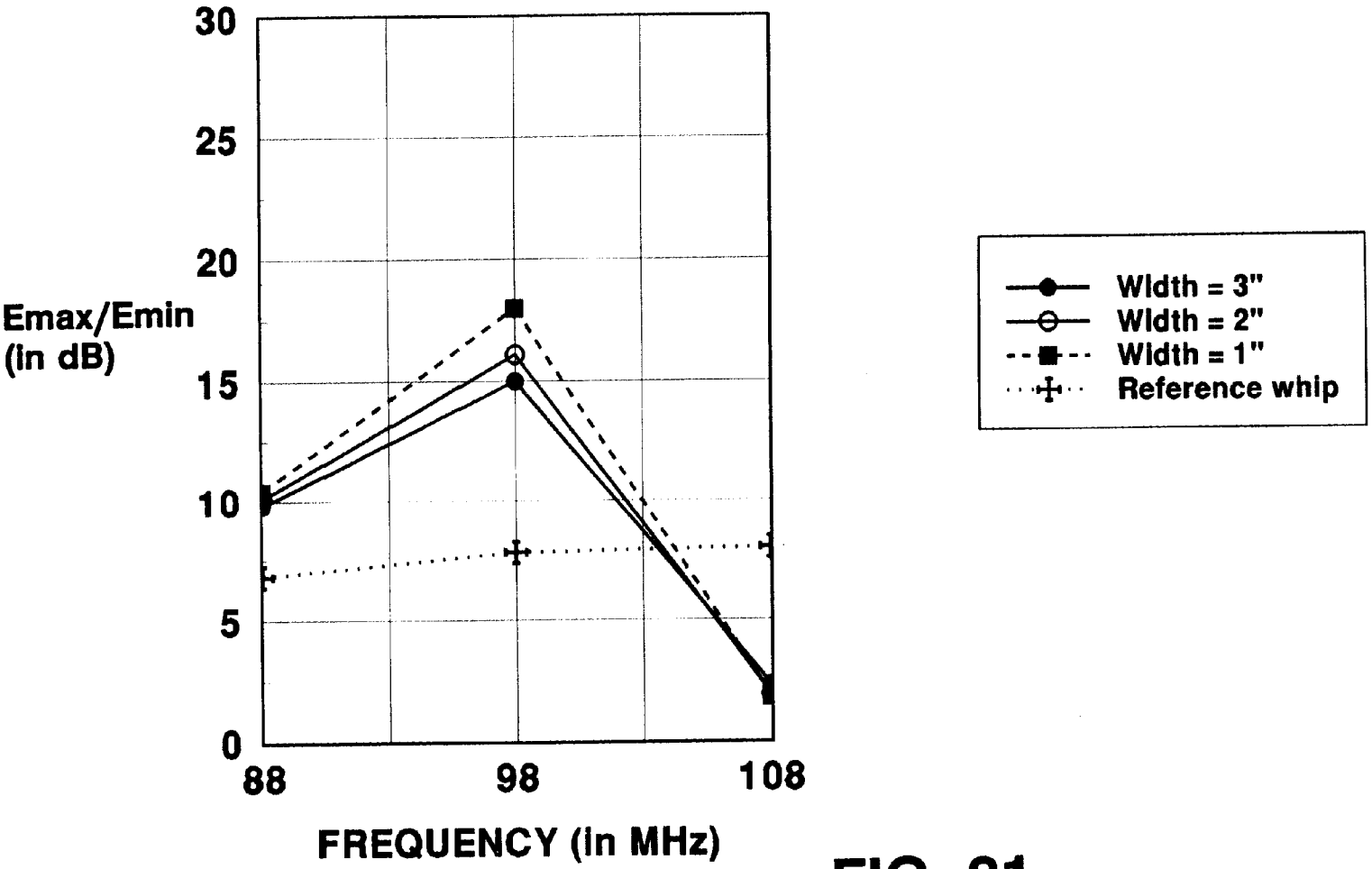
FIG. 81 shows azimuth pattern variation for 2-element conical monopole in FM broadcast band as a function of strip width.
Figure 82:
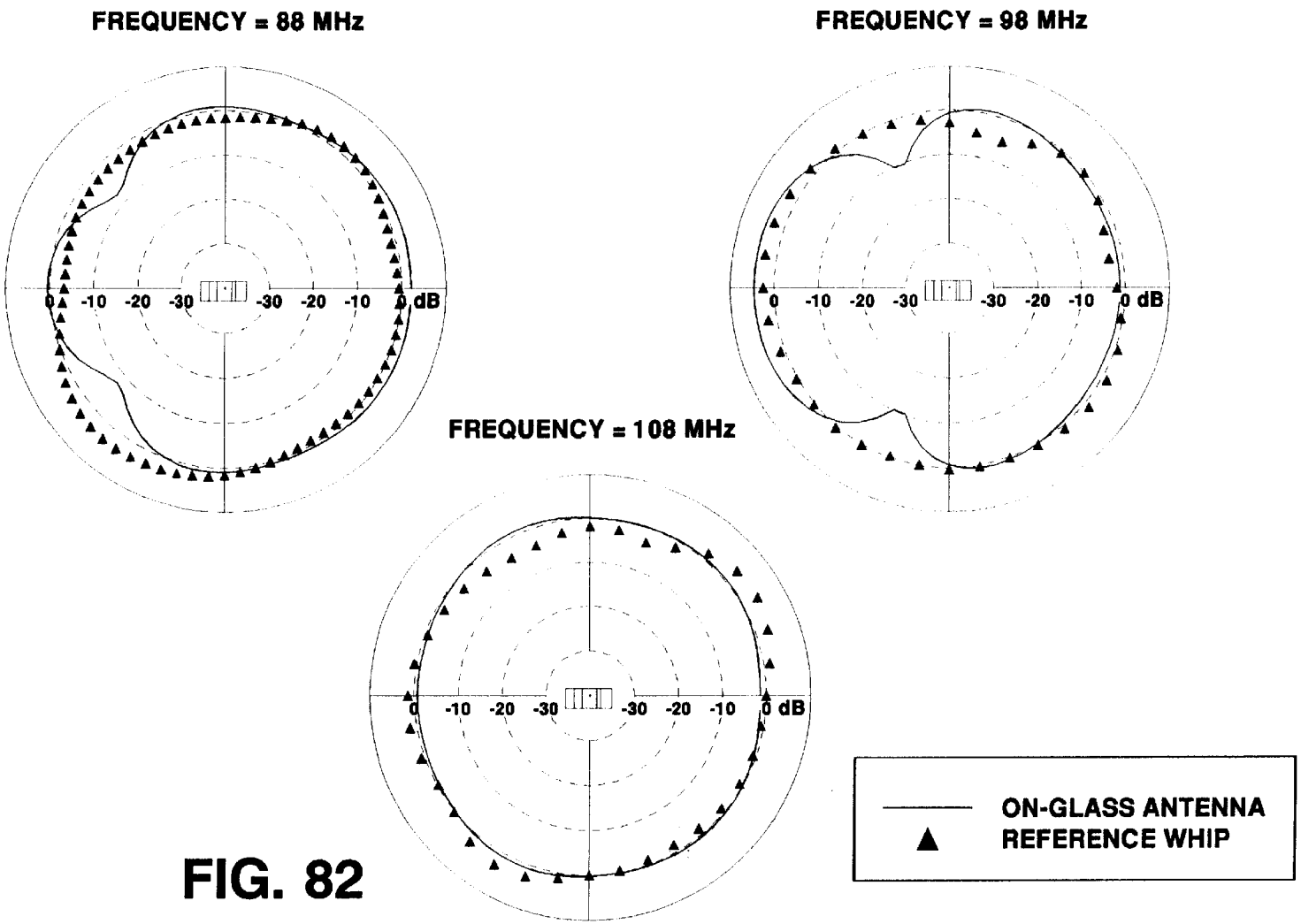
FIG. 82 shows azimuth radiation patterns of 2-element conical monopole in FM broadcast band (2×baseline profile).
Figure 83:
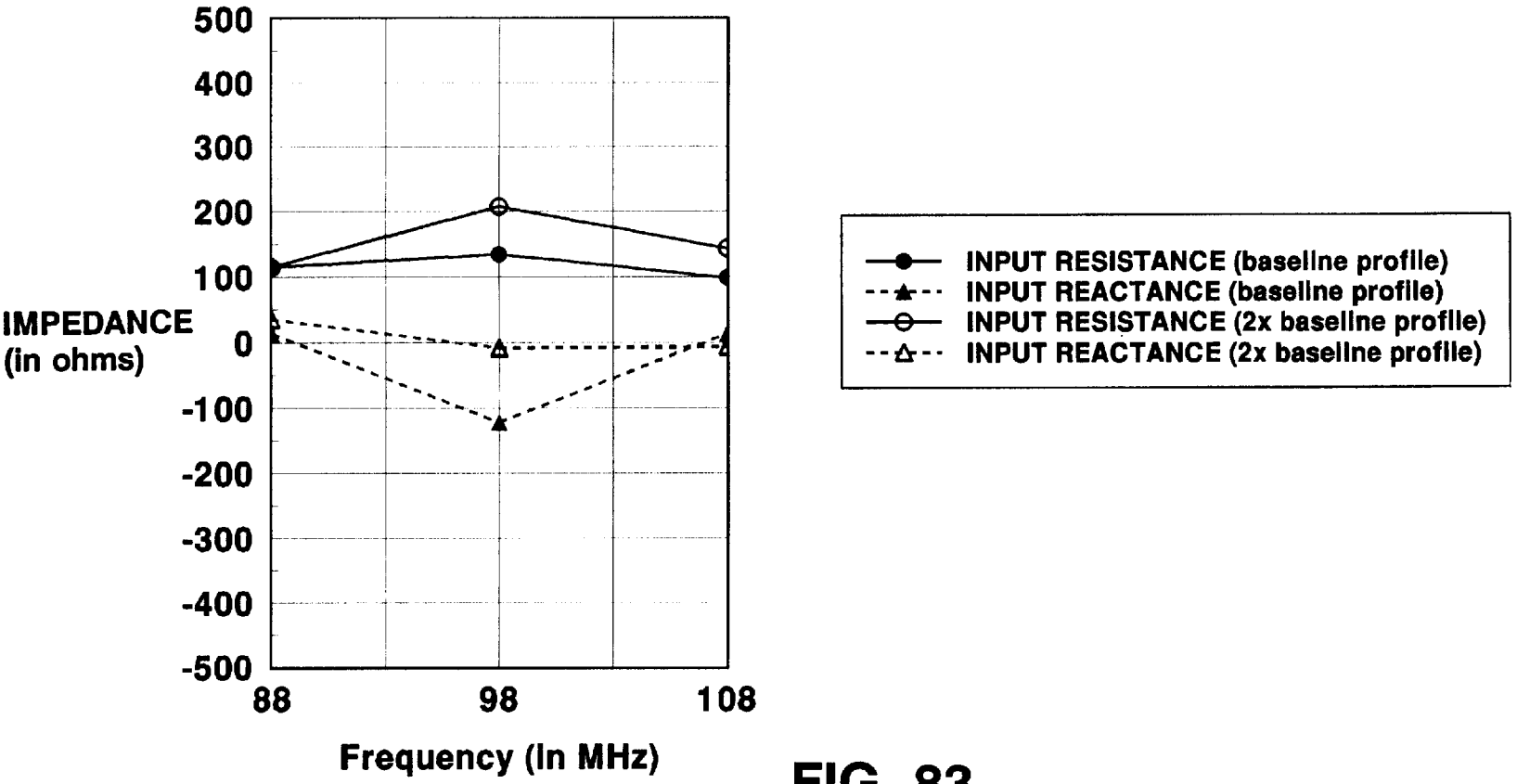
FIG. 83 shows input impedance of conical sheet antenna in FM broadcast band as a function of loading profile.
Figure 84:
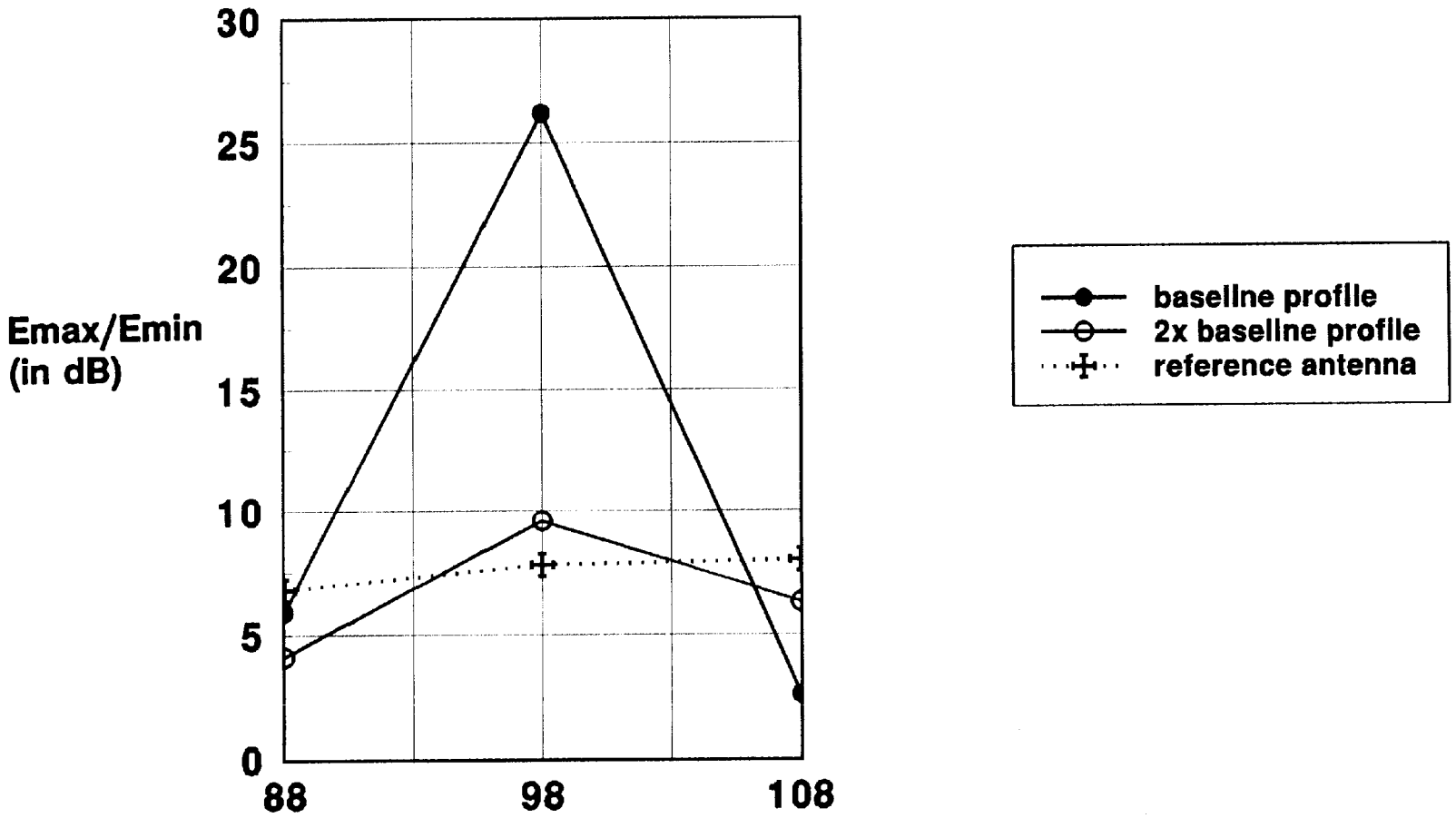
FIG. 84 shows azimuth pattern variation for conical sheet antenna in FM broadcast band as a function of loading profile.
Figure 85:
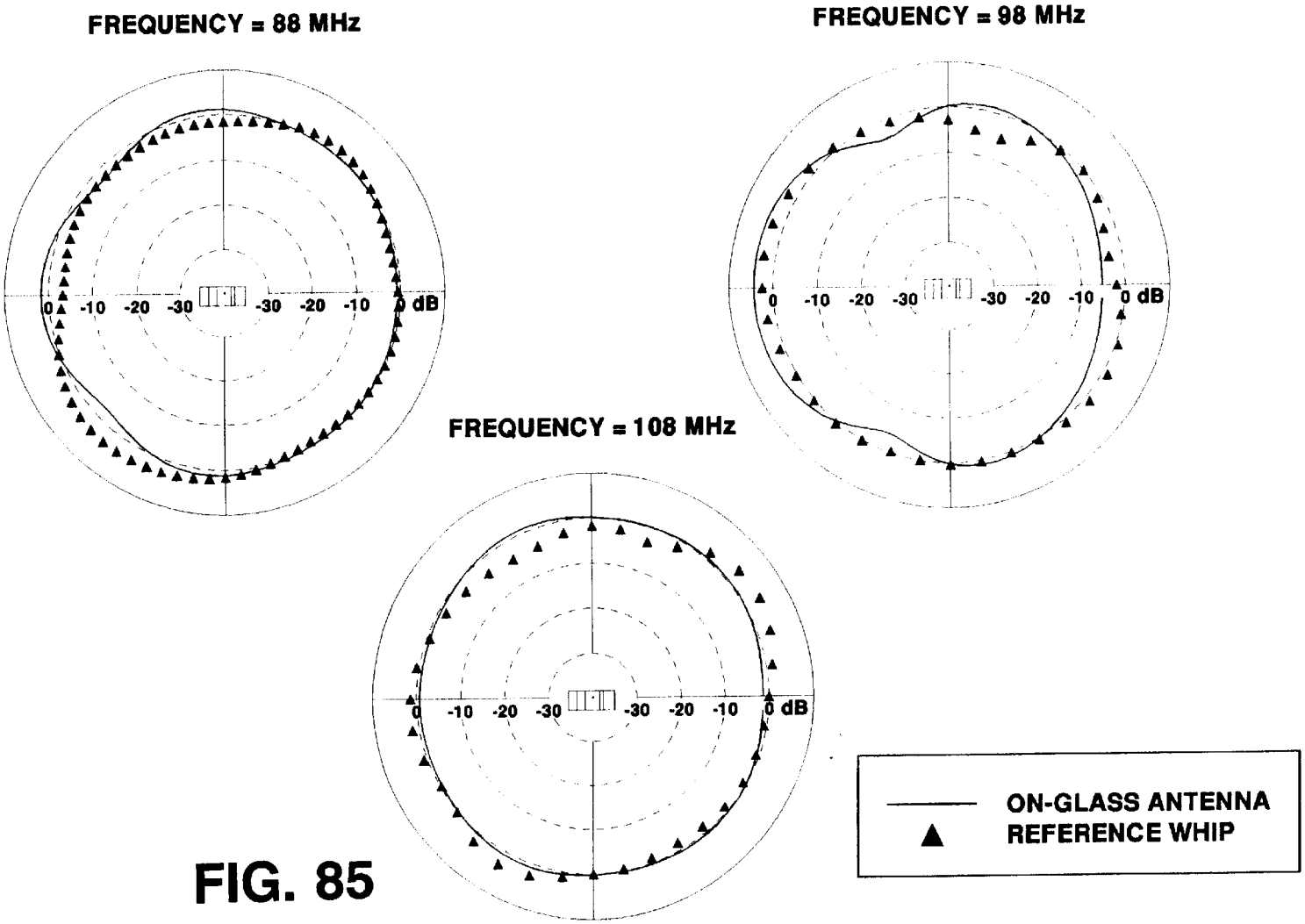
FIG. 85 shows azimuth radiation patterns of conical sheet antenna in FM broadcast band (2×baseline profile).
Figure 86:
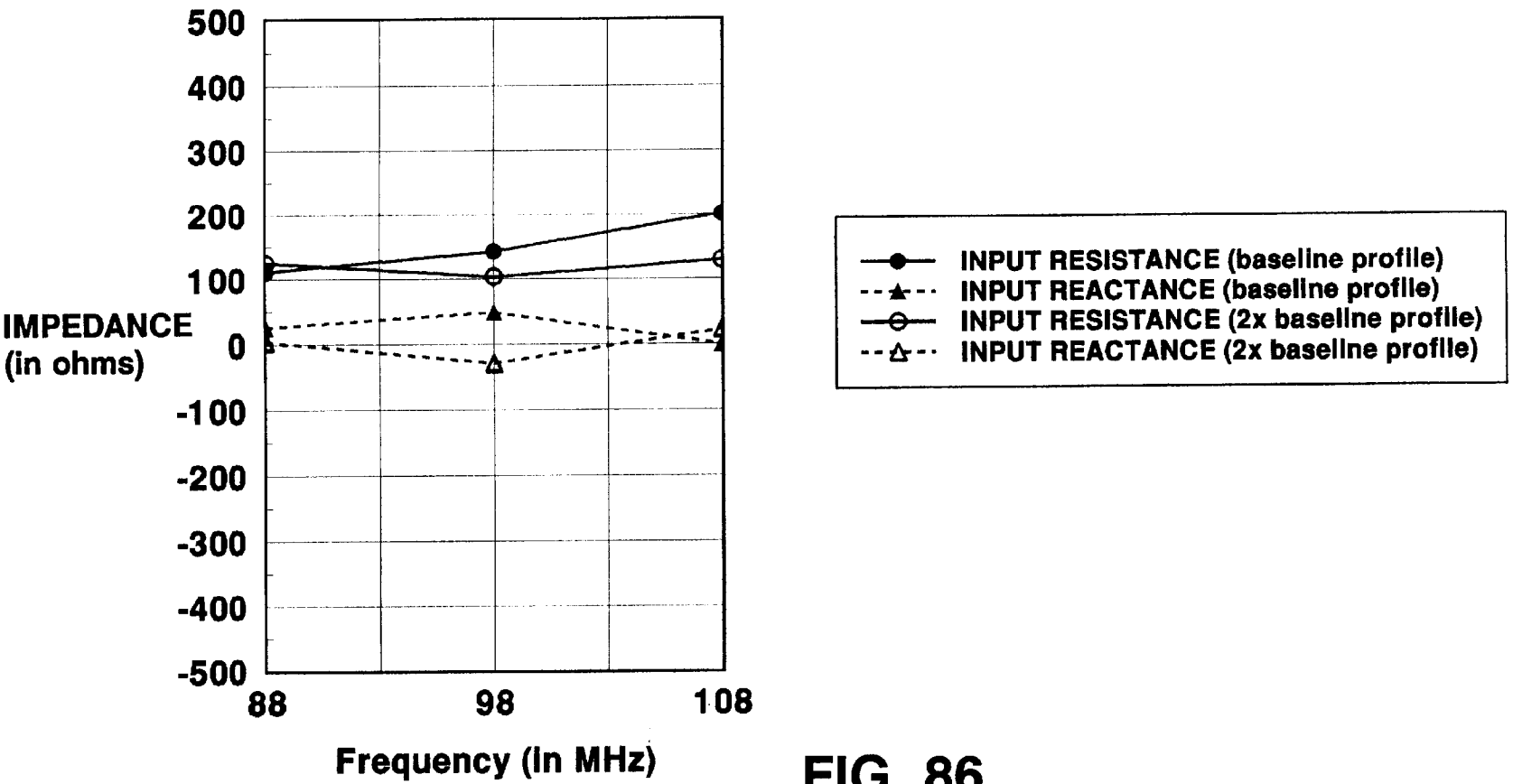
FIG. 86 shows input impedance of rectangular sheet antenna in FM broadcast band as a function of loading profile.
Figure 87:
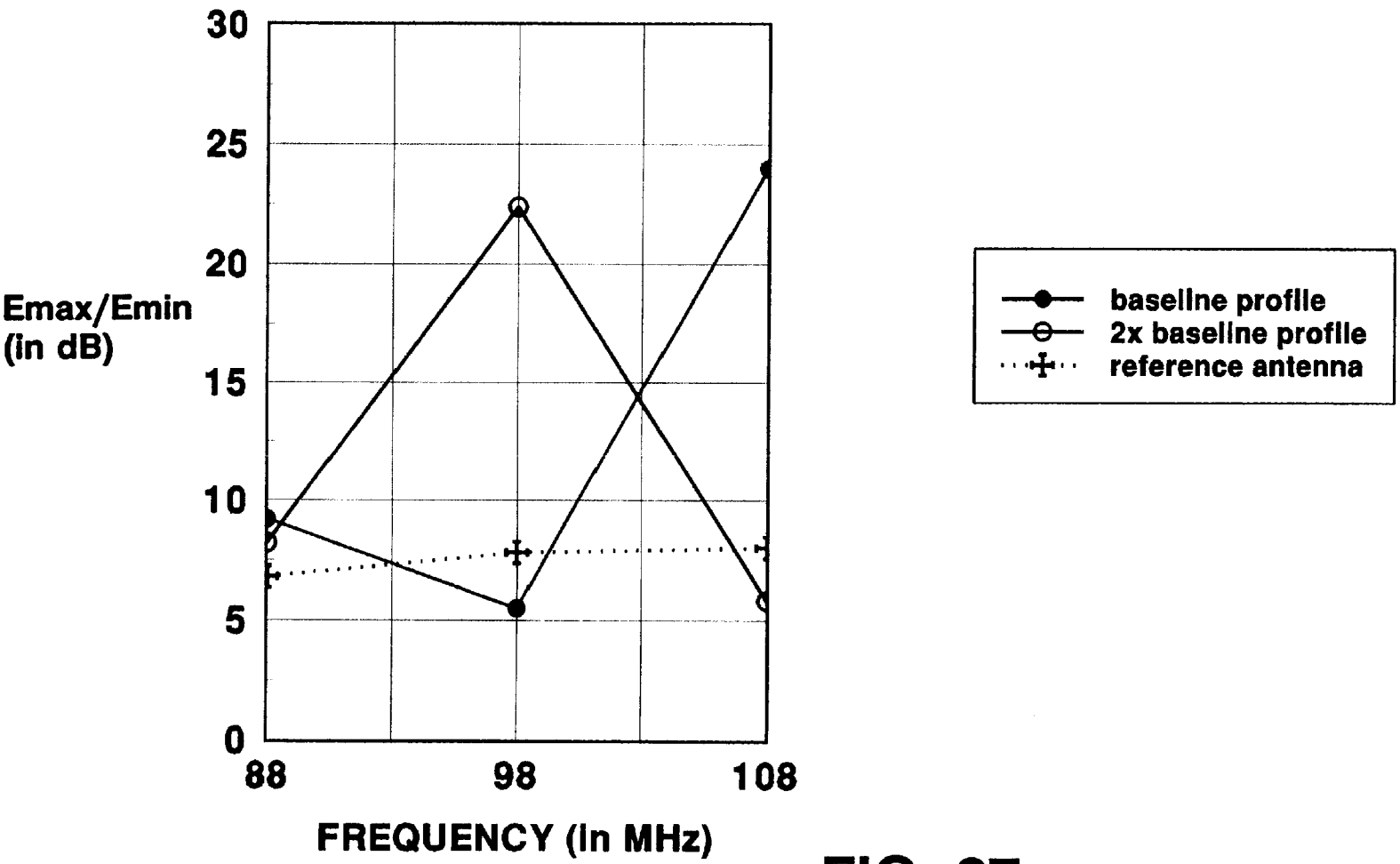
FIG. 87 shows azimuth pattern variation for rectangular sheet antenna in FM broadcast band as a function of loading profile.
Figure 88:
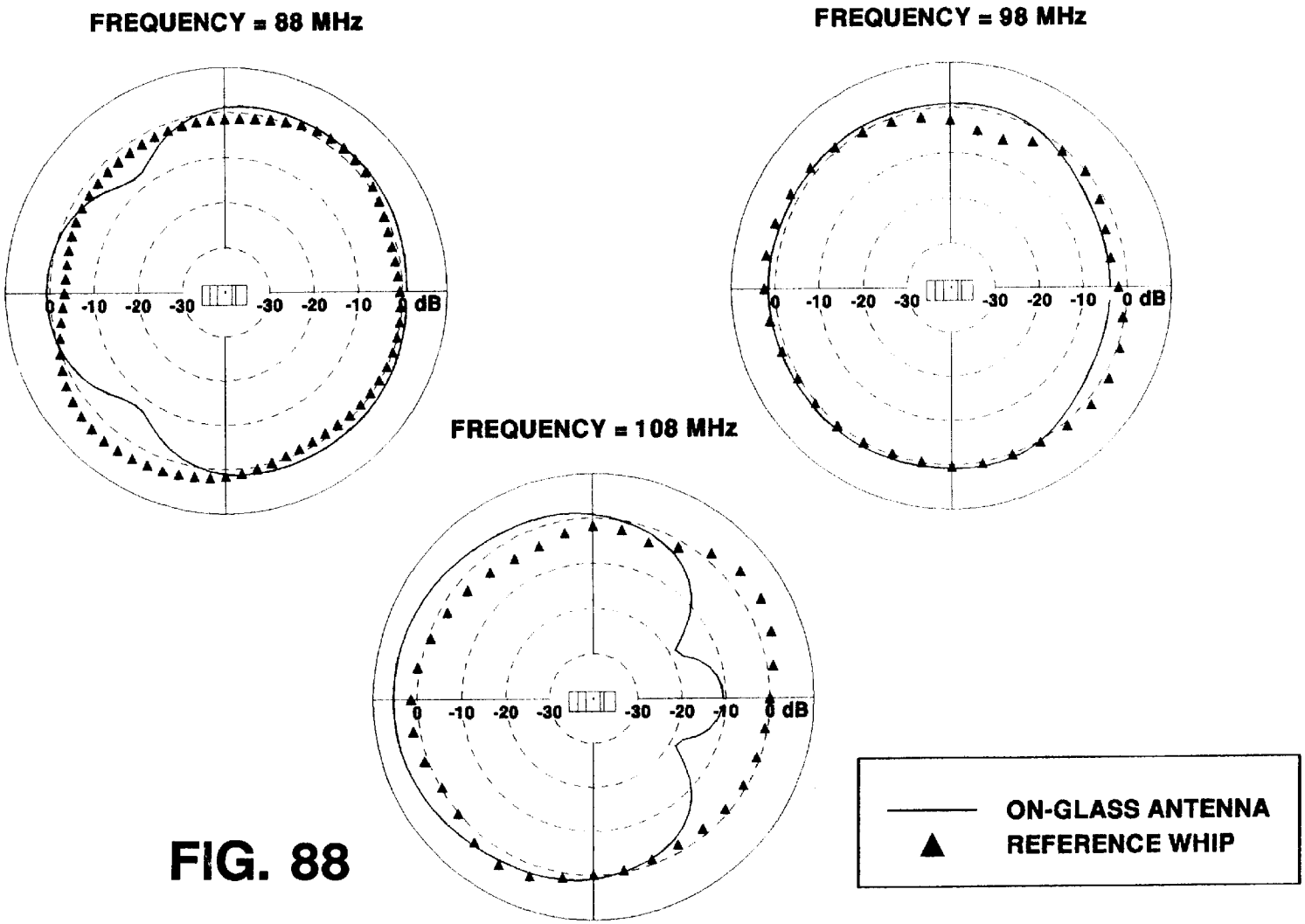
FIG. 88 shows azimuth radiation patterns of rectangular sheet antenna in FM broadcast band (baseline profile).
Figure 89:
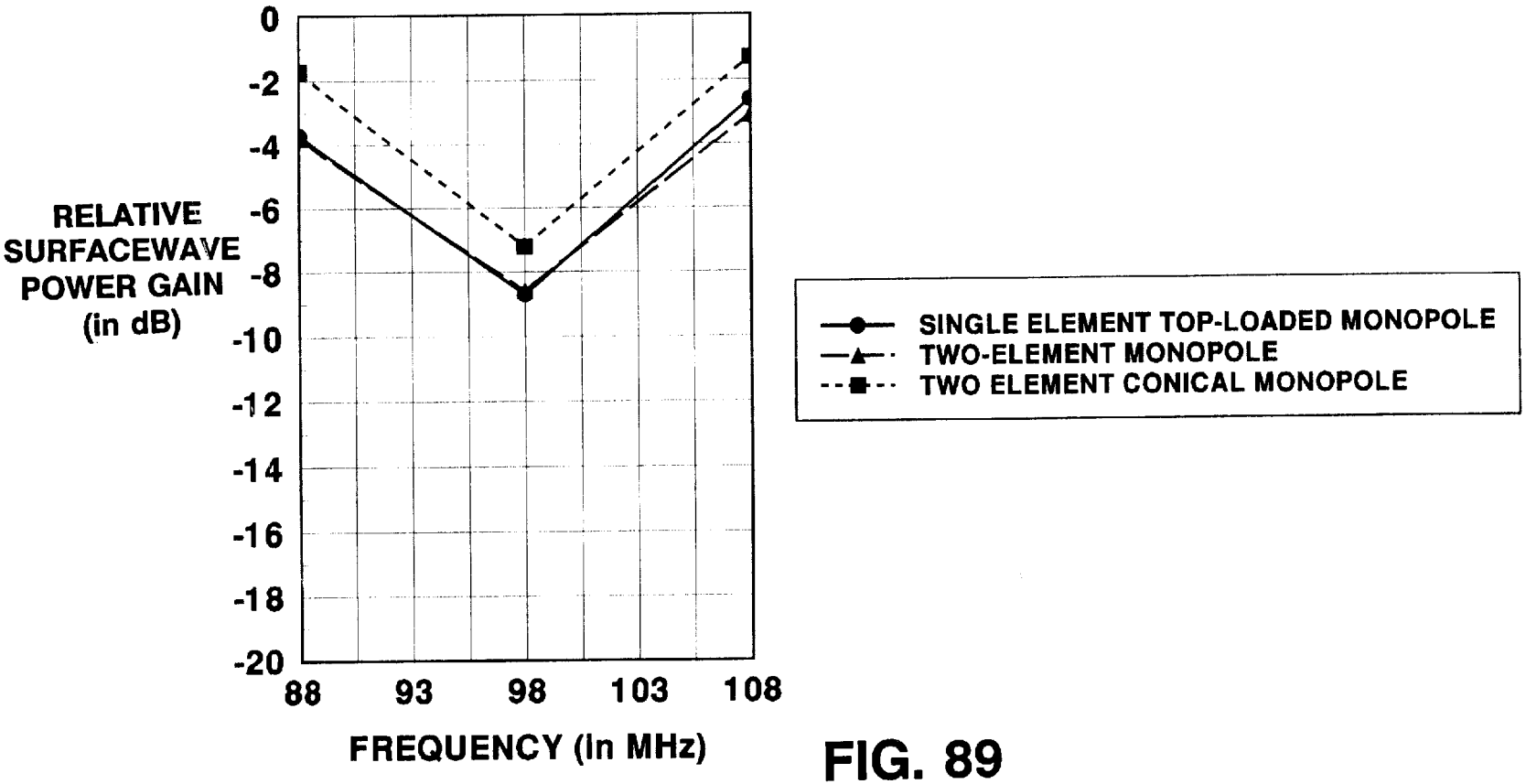
FIG. 89 shows average surfacewave power gain of on-glass antennas relative to 32" while in FM broadcast band.
Figure 90:
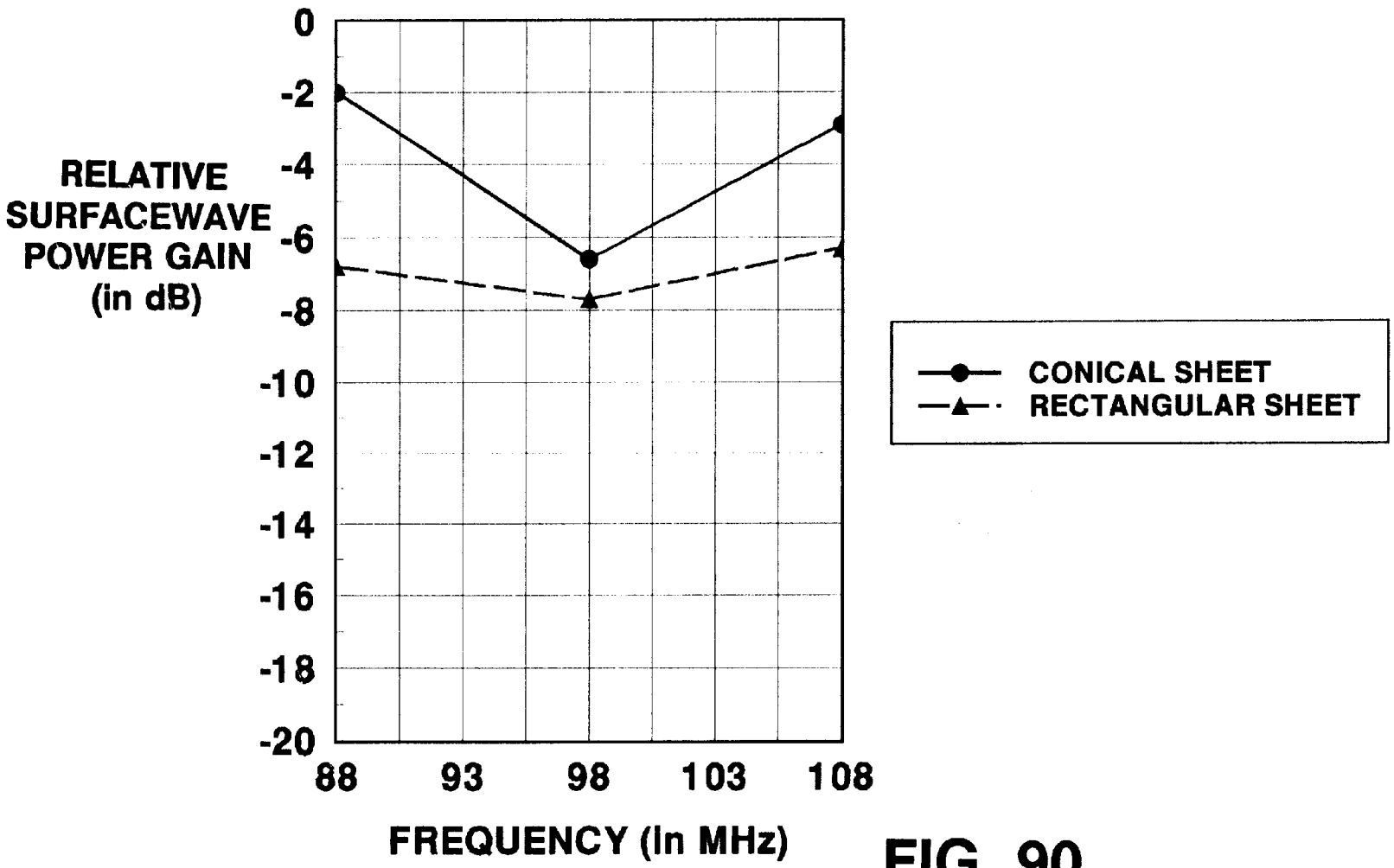
FIG. 90 shows average surfacewave power gain of flat sheet on-glass antennas relative to 32" whip in FM broadcast band.

Further cosmetic packaging can be effected by covering the feed point and feed cables with an aesthetically designed dash cover. The cover could be a custom, low profile, vacuum-formed, contoured dash cover secured in place with small localized applications of a silicone adhesive. The vacuum-formed dash cover could be supplied in several, snap together sections. Alternatively the cover could consist of a flexible foam rubber/plastic decorative laminate self-adhesive sheet material with a peel-off backing paper. The backing paper would double as the template for trimming the sheet to suit different auto models. Feed cables would be routed beneath the cover using pre-embossed channels and making maximum use of the contour features of the dashboard top to optimize appearance. This form of cover would be shipped in a roll form. For this type of installation, the lower element of the antenna self-grounding system can be incorporated into the plastic film as shown in FIG. 66, or the dashboard cover, in either form, could be metallized on its under surface to act as the lower ground element as shown in FIG. 67.

Other embodiments are within the scope of the following claims. For example, the antenna may be mounted on other surfaces including windows in buildings and windows or other non-conducting surfaces in pleasure boats, aircraft, trains and buses, automobile windows other than the windshield, residential or commercial building windows, in clothing, in hats or helmets, on any non-conducting rigid or flexible surface.

What is claimed is:

1. An antenna exhibiting a wide bandwidth, a low standing wave ratio, and an essentially omnidirectional radiation pattern, the antenna comprising an antenna element in the form of a sheet having a feedpoint, and a resistance per unit length having non-uniform variation with distance along the element from the feedpoint, the variation in resistance per unit length being achieved by a pattern of voids and non-voids along the element.

2. The antenna of claim 1 in which the element is generally rectangular.

3. The antenna of claim 1 in which the element is generally triangular.

4. The antenna of claim 1 in which there are multiple antenna elements each in the form of a sheet connected to the feedpoint.

5. The antenna of claim 4 in which the elements are in the form of fingers.

6. The antenna of claim 4 in which the elements radiate in a cone from the feedpoint.

7. The antenna of claim 1 in which the element is in the form of a monopole.

8. The antenna of claim 7 in which the monopole has more than two elements.

9. The antenna of claim 1 in which the element is formed as a loop.

10. The antenna of claim 1 in which the element is generally planar.

11. The antenna of claim 1 in which the non-uniform variation comprises a monotonically increasing value with distance from the feedpoint.

12. The antenna of claim 1 in which the element has a thickness profile that varies along the element.

13. The antenna of claim 1 in which the shape of the element is visually camouflaged.

14. The antenna of claim 1 in which the element has a width profile that varies along the length.

15. The antenna of claim 1 in which the width profile varies randomly.

16. The antenna of claim 1 in which the element is effectively transparent.

17. The antenna of claim 1 also comprising a device for attaching the element to a transparent support layer.

18. The antenna of claim 1 also comprising a rigid transparent support.

19. The antenna of claim 18 in which the antenna element is incorporated as a safety laminate between layers of glass.

20. The antenna of claim 18 in which the transparent support comprises a window.

21. The antenna of claim 1 also comprising a sheet-like ground available in the vicinity of the feedpoint.

22. A window and antenna combination, comprising a rigid transparent support, and an antenna element in the form of a sheet attached to the rigid transparent support, the element having a feedpoint, and a resistance per unit length having non-uniform variation with distance along the element from the feedpoint.

23. A method of forming an antenna comprising applying, to a substrate, an antenna element in the form of a sheet, the element having a feedpoint, and a resistance per unit length having non-uniform variation with distance along the element from the feedpoint, the variation in resistance per unit length being achieved by a pattern of voids and non-voids along the element.

24. The method of claim 23 wherein the substrate is rigid.

25. The method of claim 23 wherein the substrate is flexible.

* * * * *